US012698582B2

(12) United States Patent
Bae et al.

(10) Patent No.: US 12,698,582 B2
(45) Date of Patent: Aug. 4, 2026

(54) CLOTHING TREATMENT APPARATUS

(71) Applicant: LG Electronics Inc., Seoul (KR)

(72) Inventors: Suncheol Bae, Seoul (KR); Kyunghoon Kim, Seoul (KR); Younghan Cho, Seoul (KR); Inwoo Han, Seoul (KR)

(73) Assignee: LG Electronics Inc., Seoul (KR)

( * ) Notice: Subject to any disclaimer, the term of this patent is extended or adjusted under 35 U.S.C. 154(b) by 52 days.

(21) Appl. No.: 18/715,852

(22) PCT Filed: Dec. 5, 2022

(86) PCT No.: PCT/KR2022/019589
§ 371 (c)(1),
(2) Date: Jun. 3, 2024

(87) PCT Pub. No.: WO2023/101534
PCT Pub. Date: Jun. 8, 2023

(65) Prior Publication Data

US 2025/0034780 A1 Jan. 30, 2025

(30) Foreign Application Priority Data

Dec. 3, 2021 (KR) ..... 10-2021-0172092

(51) Int. Cl.

| | |
|---|---|
| ***D06F 34/18*** | (2020.01) |
| ***D06F 23/02*** | (2006.01) |
| ***D06F 23/04*** | (2006.01) |
| ***D06F 33/32*** | (2020.01) |
| ***D06F 34/30*** | (2020.01) |

(Continued)

(52) U.S. Cl.
CPC ..... *D06F 34/18* (2020.02); *D06F 23/02* (2013.01); *D06F 23/04* (2013.01); *D06F 33/32* (2020.02); *D06F 34/30* (2020.02); *D06F 34/32* (2020.02); *D06F 37/304* (2013.01); *D06F 39/088* (2013.01); *D06F 39/14* (2013.01); *D06F 58/08* (2013.01); *D06F 58/20* (2013.01); *D06F 58/36* (2020.02); *D06F 2103/04* (2020.02); *D06F 2105/02* (2020.02); *D06F 2105/44* (2020.02); *D06F 2105/46* (2020.02); *D06F 2105/58* (2020.02)

(58) Field of Classification Search
None
See application file for complete search history.

(56) References Cited

U.S. PATENT DOCUMENTS

2010/0037402 A1 2/2010 Koo et al.

FOREIGN PATENT DOCUMENTS

EP 3257995 B1 10/2019
WO WO-2013062314 A1 * 5/2013 ..... H02K 7/003

OTHER PUBLICATIONS

KR 100239553 B1, Operation Control Device and Method of Washing Machine, Yoon (Year: 2000).*

(Continued)

*Primary Examiner* — Cristi J Tate-Sims
(74) *Attorney, Agent, or Firm* — Fish & Richardson P.C.

(57) ABSTRACT

The present invention relates to a laundry treatment apparatus, which senses laundry weight through operation of a driving unit and, if the driving portion does not operate due to an overload and the like, pauses the sensing of the laundry weight until the overload is removed, and can display a temporary laundry weight value on the outside thereof.

20 Claims, 32 Drawing Sheets

(51) Int. Cl.

| | |
|---|---|
| ***D06F 34/32*** | (2020.01) |
| ***D06F 37/30*** | (2020.01) |
| ***D06F 39/08*** | (2006.01) |
| ***D06F 39/14*** | (2006.01) |
| ***D06F 58/08*** | (2006.01) |
| ***D06F 58/20*** | (2006.01) |
| ***D06F 58/36*** | (2020.01) |
| *D06F 103/04* | (2020.01) |
| *D06F 105/02* | (2020.01) |
| *D06F 105/44* | (2020.01) |
| *D06F 105/46* | (2020.01) |
| *D06F 105/58* | (2020.01) |

(56) References Cited

OTHER PUBLICATIONS

KR 20230135416 A, Washing Machine and Controlling Method for the Same, Sungmo (Year: 2023).*
Extended European Search Report in European Appln. No. 22901892.4, mailed on May 21, 2025, 10 pages.

* cited by examiner (a)

(b)

CLOTHING TREATMENT APPARATUS

CROSS-REFERENCE TO RELATED APPLICATIONS

This application is a National Stage application under 35 U.S.C. § 371 of International Application No. PCT/KR2022/019589, filed on Dec. 5, 2022, which claims the benefit of Korean Application No. 10-2021-0172092, filed on Dec. 3, 2021. The contents of the prior applications are incorporated by reference herein in their entirety.

TECHNICAL FIELD

The present disclosure relates to a laundry treating apparatus. More specifically, the present disclosure relates to a laundry treating apparatus that may sense an amount of laundry and display the amount to a user.

BACKGROUND

Generally, the term "laundry treating apparatus" refers to a device capable of washing, drying, or washing/drying laundry. Here, the laundry treating apparatus may perform only a washing or drying function, or may perform both washing and drying.

Such a laundry treating apparatus includes a random course or option for washing or drying laundry, and an execution time of the course or option is calculated based on the amount of laundry. For example, when the laundry amount is large, the execution time may be set to be relatively long. When the laundry amount is small, the execution time may be set to be relatively small.

FIG. 1 shows a control method for performing a random course or option of a laundry treating apparatus of the related art. (Refer to Korean Patent Publication No. 10-2009-0077097, Korean Patent Publication No. 10-2008-0102611, etc.)

FIG. 1(*a*) shows a control method of performing a random course or option by a laundry treating apparatus of the related art.

Referring to FIG. 1(*a*), a laundry treating apparatus of the related art may include a power supplying step S1 of supplying power to the laundry treating apparatus by inputting a power button (on), a selecting step S2 of selecting a suitable course or option from a control panel of the laundry treating apparatus, and a starting step S3 of inputting an execution button for executing the course or option.

When the laundry treating apparatus of the related art is provided as a front load type washer having an opening provided to a front side of a cabinet to put laundry therethrough, if the starting step S3 is performed, a door locking step S4 of fixing the opening to the cabinet may be performed.

Thereafter, the laundry treating apparatus of the related art performs a laundry amount detecting step S5 of detecting a laundry amount through a current value applied while a laundry received drum and the like is rotated. Once the laundry amount is calculated, a controller of the laundry treating apparatus of the related art performs a time displaying step S6 of displaying an estimated execution time of the selected course or option to a user and an executing step S7 of executing the course or option automatically.

However, the laundry amount detecting step S5 and the time displaying step S6 of the laundry treating apparatus of the related art are performed after the starting step S3 of executing the course or option by the user. Therefore, there is a problem that the user is forced to input an execution of the course or option while failing to receive information on the laundry amount or the estimated execution time.

As a result, there are a problem in that the user is unable to control the execution time of the course or option actively and a problem in that the time display step S6 is unable to play a role above simply displaying only simple information at a service level to the user.

Furthermore, although the execution time displayed in the time displaying step S6 fails to fit user's current intention or situation, there is a problem in that the laundry treating apparatus of the related art has no room for the user to take active measures such as adding or reducing laundry.

In addition, the laundry treating apparatus of the related art has a problem in that the course or option cannot be canceled or changed unless active measures such as randomly turning off the power of the washer are taken to change the selected course or option even if the execution time of the selected course or option does not fit the intention.

This inconvenience has a problem in being further maximized when remotely controlling the laundry treating apparatus of the related art.

FIG. 1(*b*) shows a rotational state of a drum when a laundry treating apparatus of the related art senses a laundry amount.

Referring to FIG. 1(*b*), the laundry treating apparatus of the related art rotates the drum D in a direction I to detect a laundry amount of the laundry L.

Specifically, the laundry treating apparatus of the related art calculates the weight of the laundry L by measuring a current value applied to or outputted from the drive portion that rotates the drum D while rotating the drum in the direction I.

When the laundry treating apparatus of the related art rotates the drum D to detect the laundry amount, the laundry L paced on a floor surface of the drum is lifted and then falls in direction II by gravity within the drum D so as to be separated from an inner wall of the drum.

Accordingly, the laundry treating apparatus of the related art has a limitation in that a current value, which is applied or outputted while continuously rotating the drum D one or more times in the I direction I, should be aligned in order to detect an accurate weight of the laundry L.

As a result, the laundry treating apparatus of the related art has a problem that the time for sensing the laundry amount inevitably requires more time than the time for continuously rotating the drum.

In addition, since the time required for the laundry amount detecting step S5 is set to be relatively long, the laundry treating apparatus of the related art has a problem that the time displaying step S6 for displaying the execution time of the course or option may not be quickly guided to the user.

Furthermore, the existing laundry treating apparatus performs laundry amount sensing only after a start step s3, in which the user selects a course or an option and presses an execution button, is performed.

As a result, there is a limitation in that the user is not able to check the laundry amount in advance and select the course or the option, and in most cases, the user has already left the laundry treating apparatus when the laundry amount is sensed.

Therefore, the existing laundry treating apparatus has a fundamental problem in that the user is not able to check or actively use information on the laundry amount.

SUMMARY

Technical Problem

The present disclosure is to provide a laundry treating apparatus that may sense a laundry amount before pressing an execution portion that performs a course and display information corresponding to the laundry amount externally.

The present disclosure is to provide a laundry treating apparatus that senses a laundry amount via current applied to or output from a drive portion that rotates a drum while rotating the drum less than once.

The present disclosure is to provide a laundry treating apparatus that may pause laundry amount sensing when a drive portion is in an abnormal or overloaded state of not being properly controlled.

The present disclosure is to provide a laundry treating apparatus that may repeatedly attempt laundry amount sensing for a reference time when the laundry amount sensing fails.

Technical Solutions

To solve the above-mentioned problem, the present disclosure provides a laundry treating apparatus that controls a drive portion to sense an amount of laundry before an execution portion that performs a course is pressed, and finalizes the amount of the laundry as a reference value when the drive portion is not controlled during a reference time.

The control panel may further include a display portion that displays a state of the controller, and the display portion may be controlled to display one or more of a weight, a course execution time, and a detergent amount corresponding to the reference value after the reference time.

The control panel may further include a selection portion that receives a selection command for selecting or changing the one of the arbitrary courses, and when the controller finalizes the amount of the laundry as the reference value, the course execution time displayed on the display portion may be fixed even when the course is changed via the selection portion.

The controller may re-sense the amount of the laundry and correct the amount of the laundry from the reference value to the sensed value when the drive portion is controlled.

The display portion may be controlled to display the one or more of the weight, the course execution time, and the detergent amount corresponding to the reference value corrected to correspond to the sensed value.

The display portion may be controlled to display a state that the amount of the laundry is re-sensed when the amount of the laundry is re-sensed.

The controller may control the drive portion such that the drum rotates less than once when sensing the amount of the laundry.

The controller may repeatedly control the drive portion to rotate the drum less than once and then brake until the amount of the laundry is sensed during the reference time.

The controller may stop the rotation of the drum for a specific time when the amount of the laundry is finalized as the reference value.

The control panel may further include a display portion that displays a state of the controller, and the display portion may be controlled to display an error state indicating that the sensing of the amount of the laundry or the performing of the course is not available when the controller fails to control the drive portion even after the specific time.

The specific time may be set to be within 3 minutes after finalizing the amount of the laundry as the reference value.

The controller may sense the amount of the laundry when sensing that the power portion is pressed or the door closes the opening.

The reference time may be set to be within 3 seconds after sensing that the power portion is pressed or the door closes the opening.

The controller may re-sense the amount of the laundry when sensing that the door opens and closes the opening again.

The locker may be controlled to lock the door only when the controller completes the sensing of the amount of the laundry.

The controller may wait to execute the course until the sensing of the amount of the laundry is completed even when the execution portion is pressed.

Advantageous Effects

The present disclosure may sense the laundry amount before pressing the execution portion that performs the course and display the information corresponding to the laundry amount externally.

The present disclosure may sense the laundry amount via the current applied to or output from the drive portion that rotates the drum while rotating the drum less than once.

The present disclosure may pause the laundry amount sensing when the drive portion is in the abnormal or overloaded state of not being properly controlled.

The present disclosure may repeatedly attempt the laundry amount sensing for the reference time when the laundry amount sensing fails.

DETAILED DESCRIPTION

Figure 1:
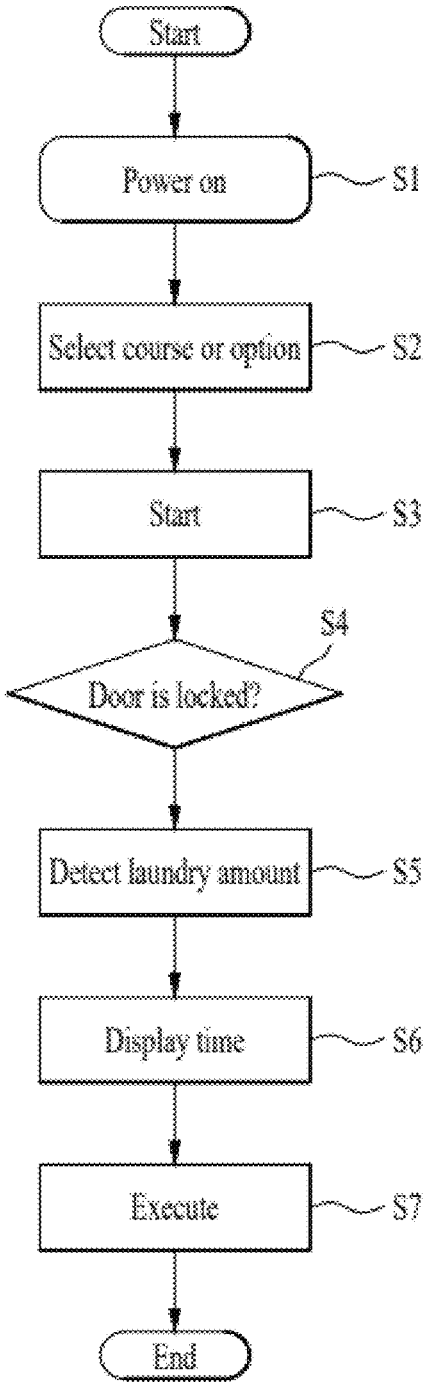
FIG. 1 shows a laundry amount sensing scheme of an existing laundry treating apparatus.
Figure 1:
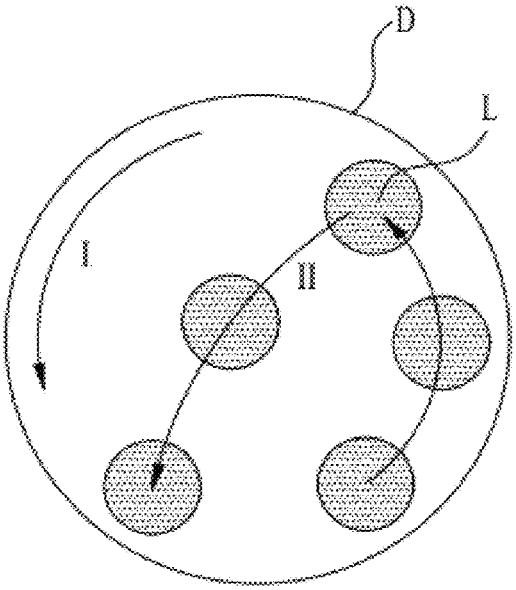

Hereinafter, embodiments disclosed herein will be described in detail with reference to the accompanying drawings. In the present specification, even in different embodiments, the same or similar reference numerals are given to the same or similar configuration, and the description thereof will be replaced by the first description. Singular expression used herein includes plural expression, unless the context clearly indicates otherwise. In the following description of embodiments disclosed herein, when it is determined that the detailed description of the relevant known art may obscure the gist of the embodiments disclosed herein, the detailed description thereof will be omitted. In addition, it should be noted that the accompanying drawings are used to easily understand the embodiments disclosed in the present specification, and the technical ideas disclosed in the present specification should not be construed as being limited by the accompanying drawings.

Figure 2:
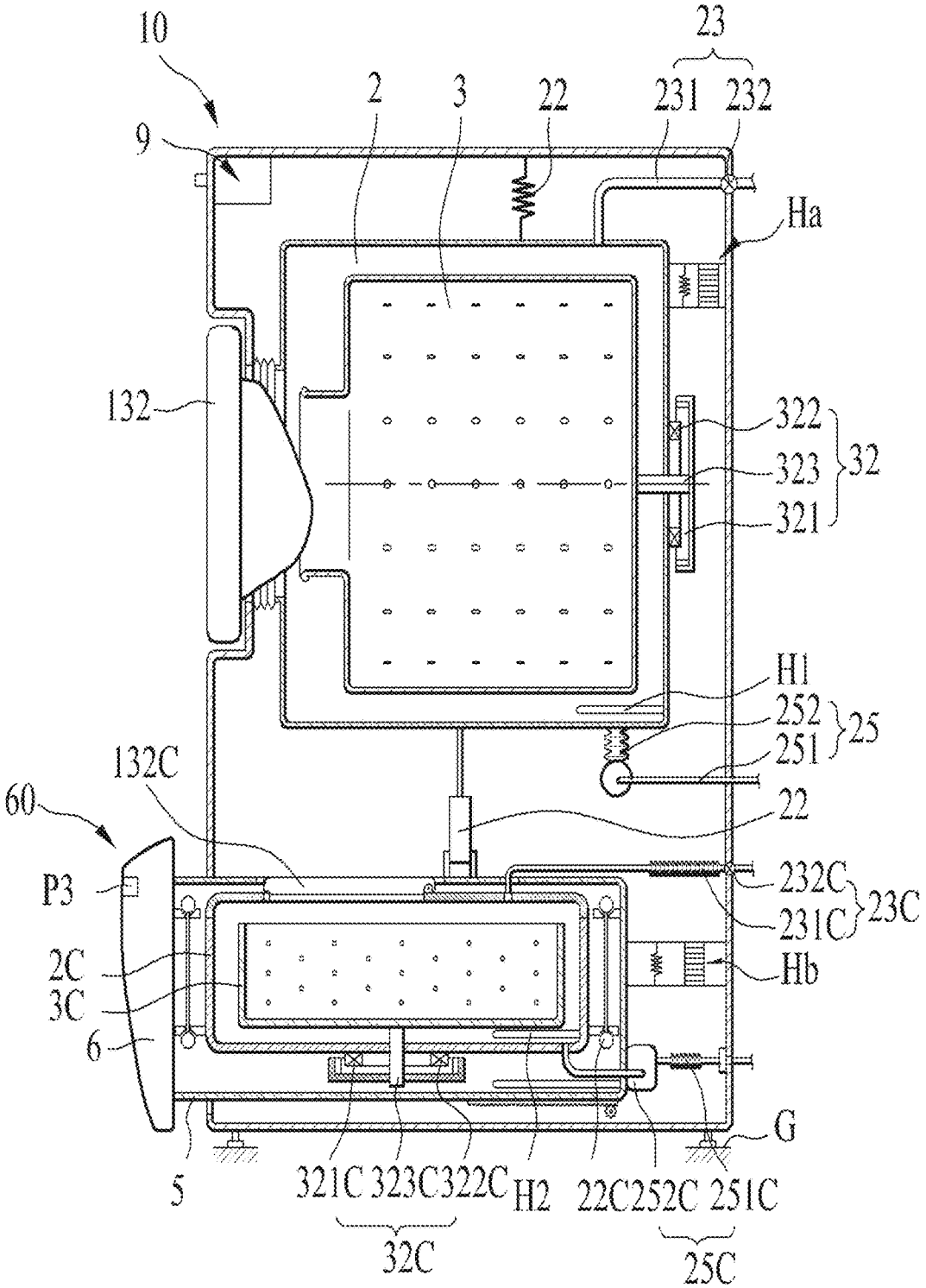
FIG. 2 shows an embodiment of a laundry treating apparatus according to the present disclosure.

FIG. 2 shows an embodiment of a laundry treating apparatus according to the present disclosure.

The laundry treating apparatus according to the present disclosure may be constructed as a washing apparatus that washes laundry or may be constructed as a drying apparatus that dries the laundry.

In addition, the laundry treating apparatus according to the present disclosure may be equipped with a combination of two apparatuses, such as the washing apparatus at the top and a small laundry treating apparatus (hereinafter, referred to as a mini apparatus) at the bottom.

Hereinafter, the laundry treating apparatus according to the present disclosure will be described based on a laundry treating apparatus 10 or a structure in which the washing apparatus 10 and a mini apparatus 20 are stacked, but the case in which the laundry treating apparatus is constructed as the drying apparatus is not excluded.

The laundry treating apparatus according to the present disclosure may be constructed by stacking the laundry apparatus 10 and the mini apparatus 20 on top of each other. In one example, only the washing apparatus 10 may be disposed independently.

The washing device 10 may include a cabinet 1 forming an appearance, a tub 2 accommodated in the cabinet 1 to store water, a drum 3 rotatably provided in the tub 2 to store water, a drive portion 32 coupled to the tub 2 to rotate the drum 3, a water supply portion 23 provided to supply water to the tub 2, and a drainage portion 25 provided to drain water in the tub 2.

Each of the tub 2 and the drum 3 may be provided with an entrance provided in a front side thereof to putt laundry therethrough, and the cabinet 1 may further include a door 132 for opening and closing the entrance.

The drive portion 32 may include a stator 321 coupled to a rear side of the tub 2, a rotor 322 rotated by the stator 321, and a rotating shaft 323 coupled to the rotor 322 to rotate the drum 3.

The water supply portion 23 may include a water supply pipe 231 connecting an external water supply source and the tub 2 to communicate with each other and a water supply valve 232 opening and closing the water supply pipe 231.

Of course, the water supply portion 23 may further include a detergent box provided to be withdrawn forward of the cabinet 1 so as to supply detergent to the tub 2, and the water supply pipe 231 may be provided to communicate with the detergent box.

The drainage portion 25 may include a drain pipe 251 provided below the tub 2 and a drain pump 252 coupled to the drain pipe 252 to provide power for discharging water.

The washing device 10 may further include a support 22 configured to support the tub 2 to the cabinet 1, and may include a heater H1 to heat water in the tub 2.

In addition, the washing device 10 may further include a hot air supply portion Ha provided to supply hot air to the tub 2.

Meanwhile, the washing device 10 may include a control panel P or a washing controller that receives an input of a command for displaying or controlling a state of the washing device 10. The control panel P may be coupled to the cabinet 1.

In addition, the control panel or controller P may operate at least one of the drive portion 32, the water supply valve 232, the drain pump 252, the heater H1, and the hot air supply portion Ha to execute an arbitrary washing course and washing option to remove foreign substances of the laundry. The washing course and the washing option may be composed of a series of control methods that may perform all of a washing cycle, a rinsing cycle, and a dehydration cycle.

The mini device 60 includes a mini cabinet 1C forming an appearance, a mini tub 2C accommodated in the mini cabinet 1C to store water, a mini drum 3C rotatably provided in the mini tub 2C to store water, a mini drive portion 32C coupled to the mini tub 2C to rotate the mini drum 3C, a mini water supply portion provided to supply water to the mini tub 2C, and a mini drainage portion 25C provided to drain water in the mini tub 2C.

The mini cabinet 1C may be provided under the cabinet 1 to support the cabinet 1. Of course, it is not excluded that the mini cabinet is disposed over the cabinet 1.

The mini cabinet may be integrally provided with the cabinet 1.

Each of the mini tub 2C and the mini drum 3C may be provided with an entrance through which laundry is put, and the mini cabinet 1C may further include a mini door 132C configured to open/close the entrance.

The mini drive portion 32C may include a mini stator 321C coupled to a lower portion of the mini tub 2C, a mini rotor 322C rotated by the mini stator 321C, and a mini rotating shaft 323C coupled to the mini rotor 322C to rotate the mini drum 3C.

The mini water supply portion 23C may include a mini water supply pipe 231C connecting an external water supply source and the mini tub 2C to communicate with each other and a mini water supply valve 232C configured to open/close the mini water supply pipe 231C.

Of course, the mini water supply portion 23C may further include a mini detergent box provided to be withdrawn forward of the cabinet 1 and provided to put detergent into the mini tub 2C, and the mini water supply pipe 231C may be provided to communicate with the detergent box.

The mini drainage portion 25C may include a mini drain pipe 251C provided under the mini tub 2C and a mini drain pump 252C coupled to the mini drain pipe 252C to provide power for discharging water.

The mini washing device 60C may further include a mini support 22C to support the mini tub 2C to the mini cabinet 1C, and may include a mini heater H2 to heat water in the mini tub 2C.

In addition, the mini washing device 60 may further include a hot air supply portion provided to supply hot air to the mini tub 2C.

Meanwhile, the mini washing device 60 may include a mini control panel PC or a mini controller for receiving an input of a command for displaying or controlling a state of the mini washing device 60. The mini control panel PC may be provided in a manner of being coupled to the mini cabinet 1C.

In addition, the mini control panel PC may be provided to perform a random washing course and option for removing foreign substances from laundry by operating at least one of the mini drive portion 32C, the mini water supply valve 232C, the mini drain pump 252C, the mini heater H2, and a mini hot air supplier HaC. The washing course and option may be configured with a series of control methods capable of performing all of a washing cycle, a rinsing cycle, and a dewatering cycle.

The mini device 60 may further include a drawer D provided to be withdrawn forward from the mini cabinet 1C and accommodating the mini tub 2C therein. The drawer D may include a front cover DC on a front side thereof to open/close an entrance through which the drawer D is withdrawn from the mini cabinet 1C.

The mini control panel PC may be disposed on the front cover DC.

When the laundry treating apparatus according to the present disclosure is constructed as the drying apparatus, the tub may be omitted and the drive portion 32 may further dispose a reducer between the drum and a motor.

Figure 3:
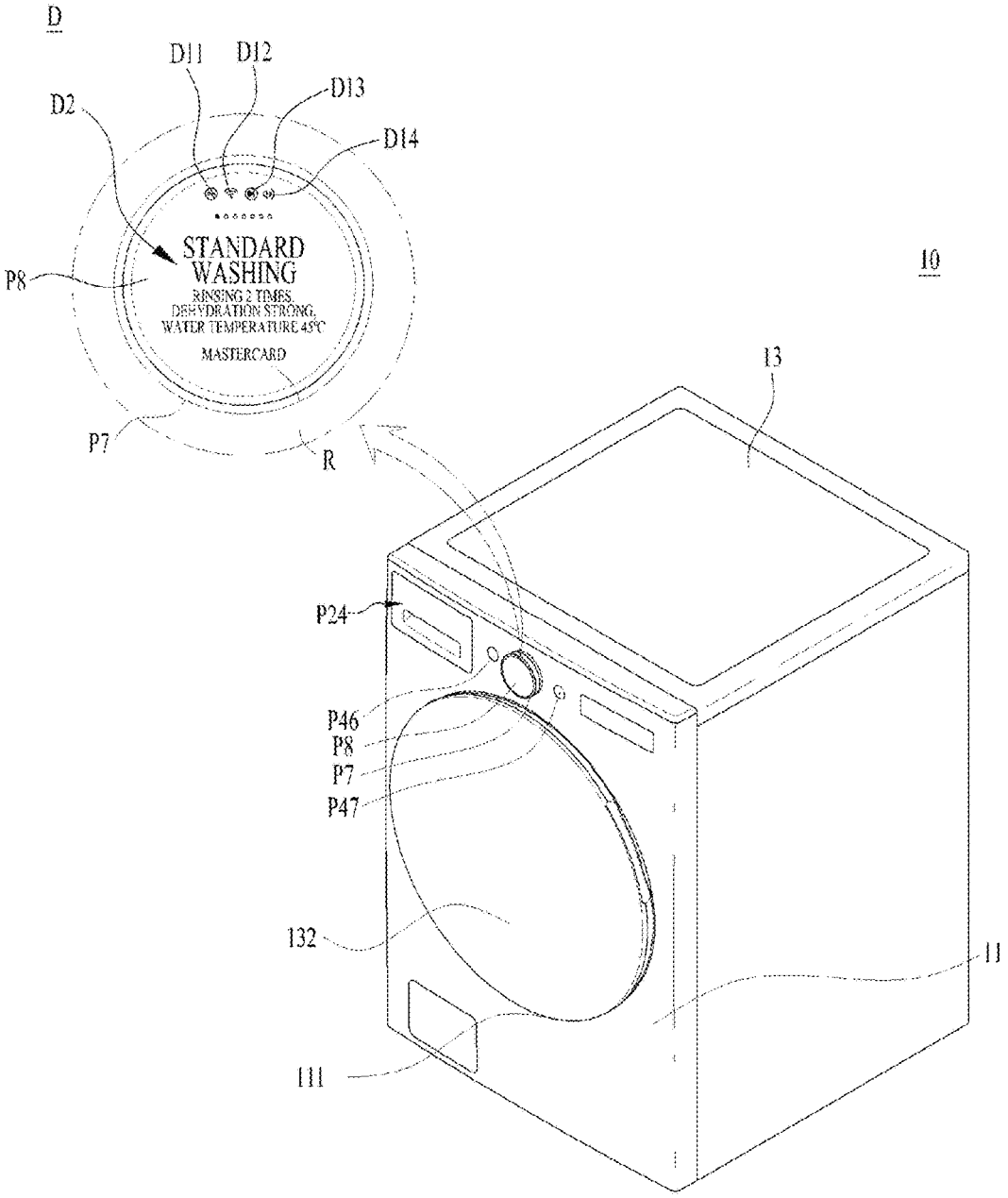
FIG. 3 shows an outer appearance of a laundry treating apparatus according to the present disclosure.

FIG. 3 is a diagram illustrating an embodiment of a control panel P applicable to the laundry treating apparatus of the present disclosure.

Hereinafter, the description will be made based on the control panel P of the washing apparatus 10, but the control panel P may be applied in the same structure to the washing apparatus 10 and the drying apparatus, and may also be applied to a mini apparatus 60.

In other words, the control panel P, the drying control panel PA, and the mini control panel PC may have the same structure.

The washing device 10 includes a cabinet 1 and a control panel P provided to the cabinet 1.

The control panel P refers to a device that enables communication between a user and a laundry treating apparatus (including other electronic equipment as well as the same). The communication between the user and the laundry treating apparatus refers to a process in which a user inputs a control command to the laundry treating apparatus and a process in which the laundry treating apparatus transmits information to the user.

Through the control panel P, the user may input at least one of a power command for supplying or blocking power of the laundry treating apparatus, a selection command for selecting a random course or option for processing laundry, an execution command for performing the selected course or option, and a stop command for stopping the course or option being performed.

The treating of laundry may include a washing cycle for removing foreign substances from the laundry through water and detergent or a drying cycle for drying the water contained in the laundry.

The control panel P may display an operating state of the laundry treating apparatus or information of the course or option to a user.

For example, the control panel P may display a state in which at least one of the power command, the selection command, the execution command, the performance command, and the stop command is input. In addition, the control panel P may display error information indicating a problem situation occurring in the laundry treating apparatus or guide information guiding an action to be taken by the user.

The cabinet 1 may include a front panel 11 forming a front side and an upper panel 13 coupled to an upper portion of the front panel 11. The front panel 11 and the upper panel 13 may be formed of a metal material and may be provided in the shape of a steel sheet.

The control panel P of the laundry treating apparatus according to the present disclosure may be coupled to the front panel 11.

The control panel P may be coupled to a rear surface of the front panel 11 and partially exposed to a front surface of the front panel 11. The front panel 11 may be made of a simple metal plate, and the control panel P may be simply coupled and fixed to the rear surface of the front panel 11.

Accordingly, the front panel 11 may form most of the front surface of the cabinet 1. As a result, the appearance of the front panel 11 may be reinforced to maximize aesthetics. In addition, a process of manufacturing the front panel 11 may be simplified, and a process of assembling or installing the front panel 11 and the control panel P may be simplified. In addition, a configuration such as a separate frame for seating the control panel P on the front panel 11 may be omitted.

The control panel P of the laundry treating apparatus according to the present disclosure may include a manipulation portion P7 rotatably coupled to the cabinet and a display portion P8 provided inside the manipulation portion P7 to display a state of the laundry treating apparatus.

The manipulation portion P7 may be provided in the form of a rotary knob, and the display portion P8 may be provided as a display D including liquid crystal or the like. The display portion P8 and a selection portion R to be described later may be included inside the manipulation portion P7.

The display portion P8 may be entirely provided as a touch panel, or at least a portion of the display portion P8 may be provided as a touch panel.

The manipulation portion P7 may be configured to select a random course or option capable of treating laundry while rotating, and the display portion P8 may be configured to display a corresponding course or option each time the manipulation portion P7 rotates.

Accordingly, the control panel P of the laundry treating apparatus according to the present disclosure may prevent a random course or option capable of rotating the drum, which will be described later, from being displayed as text, guide phrases, and the like in a certain area.

Accordingly, an area occupied by the control panel P on the front panel 11 or an area ratio thereof may be greatly reduced. Since separate text and the like or guide phrase is not attached to the front panel 11, aesthetic sense may be maximized.

A display P84 of the display portion P8 may include a state display area D1 configured to display a state of the laundry treating apparatus and a content display area D2 configured to display a state in which at least one of the power command, the selection command, the execution command, the performance command, and the stop command of the laundry treating apparatus is inputted, error information, and guide information for guiding a user to take a necessary action.

The state display area D1 may display a locking state D11 illustrating whether the door 132 is locked to the cabinet, an activation state D12 of the communication module T, an execution state D13 of the course or the option, and a notification state D14 indicating that there is notification information for the user.

The content display area D2 is the largest area in the display portion P8, and may be configured to display a selection state, an execution state, a stop state, and a completion state of a course or option as well as a state of another home appliance, which will be described later.

In addition, the control panel P may further include a selection portion R for inputting a determination command for the user to determine information displayed on the display portion P8. The selection portion R may be provided inside the manipulation portion to further reduce the area occupied by the control panel P.

The selection portion R may be provided inside the display portion P8 and may be disposed in a manner of being spaced apart from the content display area D2. The selection portion R may be provided as a physical button or a touch panel for sensing a contact of a user's body.

The display P84 of the display portion may include an input area D3 that may require an input of the selection portion R at a point corresponding to the selection portion R.

The input area D3 may be provided to emit light when the selection portion R is activated to receive an input of a command from the user.

Meanwhile, the manipulation portion P7 and the display portion P8 may be configured to operate when power is supplied.

To this end, the control panel P of the laundry treating apparatus of the present disclosure may further include a power portion P46 for inputting a power command to the laundry treating apparatus as well as the manipulation portion P7 and the display portion.

The user may activate the manipulation portion P7 by inputting the power portion P46.

The front panel 11 may include a power mounting part 116 provided to install the power portion P46.

In addition, the control panel P may further include an execution portion P47 to which an execution command for executing or stopping the selected course or option is inputted. The execution portion P47 may be provided separately from the manipulation portion P7 and the display portion P8 to reflect user's certain intention for execution or stop. In addition, the functions of the manipulation portion P7 and the display portion P8 may be prevented from expanding excessively.

The front panel 11 may include a power mounting part 117 provided to install the execution portion P47.

The power portion P46, the execution portion P47, the manipulation portion P7, and the display portion P8 may be provided in a single control box P1.

Meanwhile, the front panel 11 may further include a setting portion P2 capable of adding or changing an option to the course. The user may set options for changing the strength, duration time, and the like for performing the course through the setting portion P2.

The setting portion P2 may be provided separately from the case P1 to be coupled to the front panel 11. The setting portion P2 may include a separate liquid crystal display or may include a touch panel or a physical button capable of writing or entering the option.

The power portion P46, the execution portion P47, the manipulation portion P7, and the setting portion P2 may be collectively defined as an input portion P8.

In one example, the front panel 11 may have the door 132 that opens and closes an inlet into which the laundry is input. The control panel P may be located above the door 132 to enhance user accessibility.

In one example, the front panel 11 may further include a locker L that fixes the door 132 to the front panel 11. When the laundry treating apparatus operates, such as when the drum of the laundry treating apparatus rotates, the controller P may control the locker L to lock the door 132 to the front panel 11. Accordingly, a safety accident may be prevented. The locker L may release the locking of the door 132 when the laundry treating apparatus is finished operating.

The locker L may have any configuration as long as it is able to fix the door 132 to the cabinet 1. The locker L may be formed as a fastener that fastens a hook protruding from the door and may also be formed as a solenoid valve for gripping the hook.

In one example, the cabinet 1 may further include a sensor S that may sense whether the door 132 has opened or closed the opening. The sensor S may be formed integrally with the locker L or may be formed as a separate sensor.

For example, the sensor S may include a magnet disposed in the door 132, and a hall sensor or a reed switch that senses the magnet around the opening.

The laundry treating apparatus according to the present disclosure may have a detergent box 132 that accommodates detergent for washing the laundry, and the front panel 11 may include a detergent hole P24 through which the detergent box 45 is extended.

The cabinet 1 may dispose the door 132 in an open state and may further include an opening portion that prevents the door 132 from being locked to the cabinet 1.

The opening portion may include a limiting portion 10*b* coupled to the door 132 so as to be exposed to an outer circumferential surface of the door 132. The limiting portion 10*b* may prevent the door from being coupled to a locker 10*c* disposed on the cabinet. Accordingly, the user may dry or ventilate the inside of the drum 3 when not using the laundry treating apparatus using the limiting portion 10*b* of the door.

The display portion P8 may include at least one of a display panel that may output text and figures, and a speaker P88 that may output a voice signal and a sound.

Figure 4:
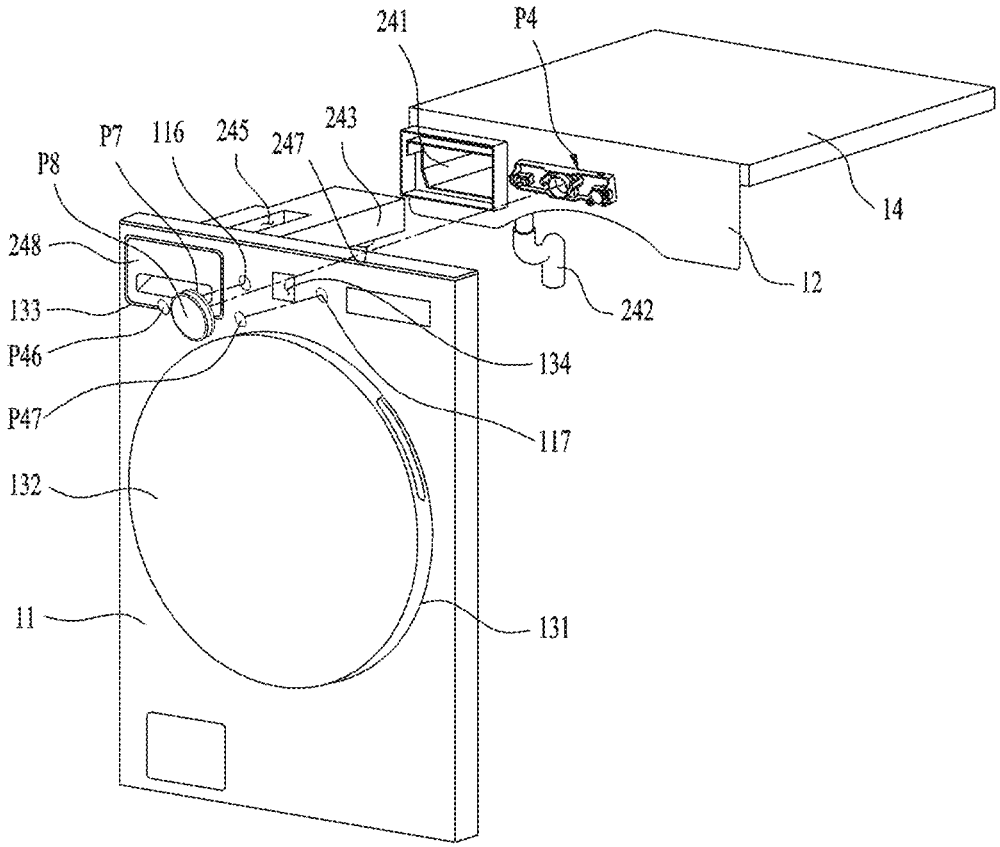
FIG. 4 shows a structure of a front panel of a laundry treating apparatus according to the present disclosure.

FIG. 4 is a diagram illustrating a structure in which a control panel is coupled to a front panel.

As shown in the drawing, the washing device 10 may further include a detergent supply portion P24. The detergent supply portion P24 may include a detergent box housing 241 provided in the cabinet 1, a connection pipe 242 connecting the detergent box housing to the tub body 21, and a detergent box 243 withdrawn from the detergent box housing 241 through a detergent box entrance 133 provided in the front panel 11.

The detergent box 243 may include a chamber 245 for providing a space for storing detergent, and a discharge flow path 247 for discharging the detergent in the chamber to the detergent box housing 241. The discharge flow path 247 may be provided as a water trap (e.g., a siphon flow path for moving the liquid to the detergent box housing 241 when a water level of liquid stored in the chamber 245 exceeds a preset water level.

When the detergent supply portion 24 is provided in the washing device 10, the water supply portion 23 may further include a nozzle 232 for supplying water to the chamber 245. The nozzle 232 may be fixed to the cabinet 1 to form an upper surface of the detergent box housing 241, and the water supply pipe 231 may be provided to connect the nozzle 232 to a water supply source.

A detergent box panel 248 may be provided on a front surface of the detergent box 243. The detergent box panel 248 may be provided in a shape of closing the detergent box entrance 133, and a detergent box handle may be provided to the detergent box panel 248.

The front panel 11 may be fixed to the cabinet body 11 through a panel support 12. That is, the panel support 12 may be fixed to the cabinet body 11, and the front panel 11 may be fixed to the panel support 12. The panel support 12 may be provided with a detergent box through-hole 121 through which the detergent box 243 passes.

The control panel P may be fixed to the cabinet 1 through the panel support 12. The panel support 12 may be provided with an interface mounting slot to which the control panel P is fixed.

The front panel 11 has a first button mounting portion 116 and a second button mounting portion 117. The power portion P46 may be exposed to the outside of the cabinet 1 via the first button mounting portion 116 and the execution portion P47 may be exposed to the outside of the cabinet 1 via the second button mounting portion 117.

The power portion P46 and the execution portion P47 may be disposed separately in spaces on left and right sides of the display portion P8, may be disposed separately in spaces above and below the display portion, or may be arranged in a vertical direction or in a left and right direction in one of the spaces on the left and right sides of the display portion.

The cabinet 1 has a panel through-hole 134 defined to extend through the front panel 11. The shaft 71 may be inserted into the panel through-hole 134.

When the laundry treating apparatus is constructed as the drying apparatus, the rest may be the same except that components related to the detergent box are changed to a water storage tank 7.

Figure 5:
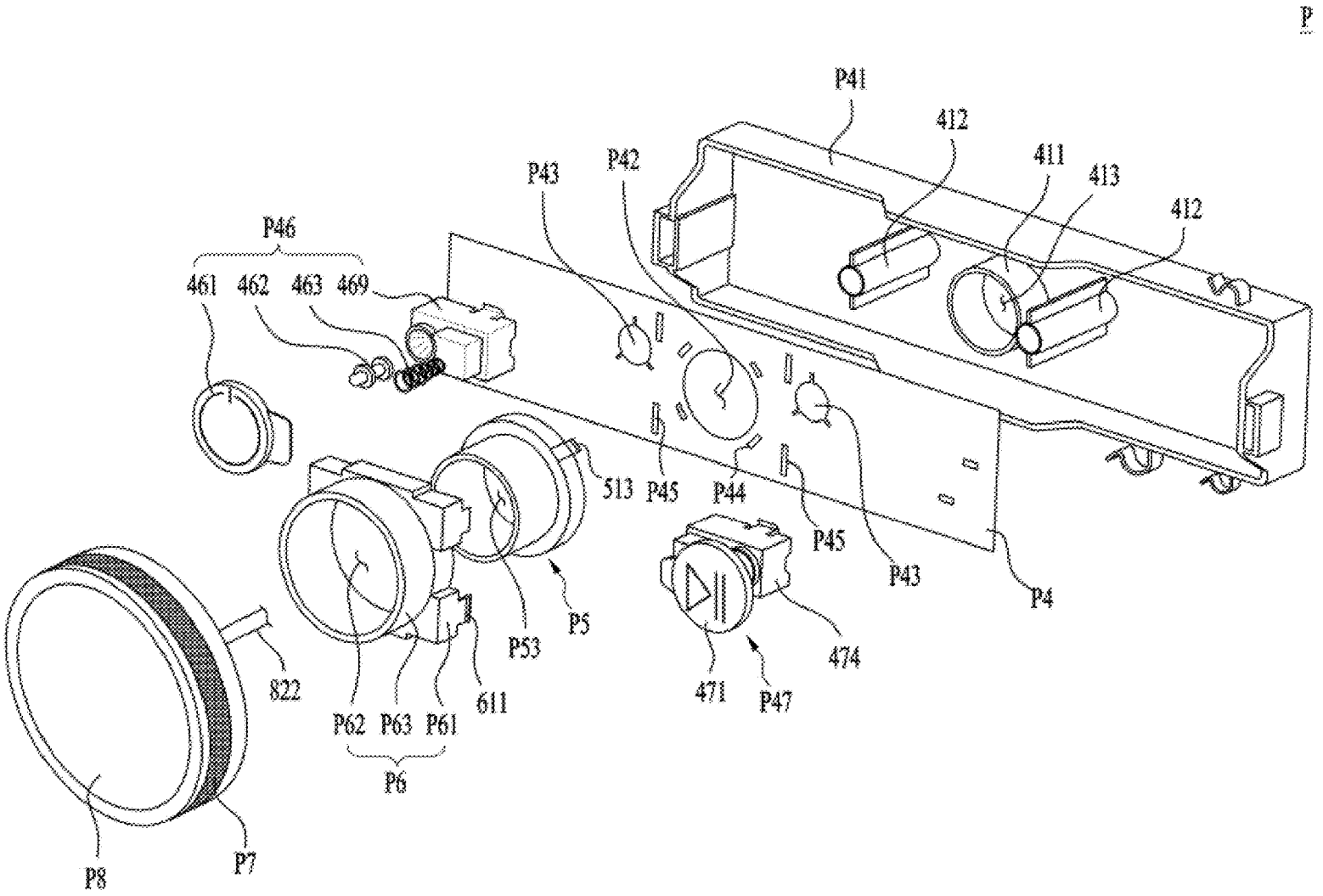
FIG. 5 shows a structure of a control panel of a laundry treating apparatus according to the present disclosure.

FIG. 5 is a diagram illustrating an internal structure of a control panel.

The control panel P may include a circuit board (i.e., a first circuit board) P4 located within the cabinet 1 by being fixed to the panel support 12, an encoder P5 located within the cabinet 1 by being fixed to the circuit board, a manipulation portion P7 connected to the encoder P5 through the front panel 11, and a display portion P8 fixed to the encoder 5 or the first circuit board P4 through the front panel 11.

The first circuit board P4 is a board equipped with a control circuit required for control (power control and operation control) of at least one of the drive portion 32, 27, and 25, the steam supply 200, and the water supply 300, and is able to be fixed to the panel support 12 via the case P41.

The case P41 may have any shape capable of fixing the first circuit board 4 to the panel support 12.

The case P41 may have a hexahedral shape with one surface (e.g., a surface facing the panel support) open.

A boss for setting a position of the first circuit board P4 may be provided to the case P41. The boss may include a first boss 411 and a second boss 412.

In this case, the first circuit board P4 may include a board through-hole P42 through which the first boss 411 passes and a boss insertion hole P43 through which the second boss 412 passes. The second boss 412 may be disposed in each of left and right spaces next to the first boss 411, or may be disposed in each of upper and lower spaces next to the first boss 411.

A wire 822 is connected to the display portion P. The wire 822 may be provided as a power line for supplying power to the display portion, and the display portion P8 may be provided as a communication line that enables communication with devices inside the cabinet including the first circuit board P4.

A first boss through-hole 413 may be provided in the first boss 411, and a wire through-hole 123 (see FIG. 4) may be provided in the panel support 12. In this case, the wire 822 may extend into the cabinet 1 by being inserted into the first boss through-hole 413 and the wire through-hole 123.

The first circuit board P4 may further include a power portion P46 and an execution portion P47. The power portion P46 may be provided as a means for inputting a control command for requesting power supply to the laundry treating apparatus 100, and the execution portion P47 may be provided as a means for inputting a command for requesting execution of a control command displayed on the display portion P8 or a command for requesting temporary interruption of a control command being executed by the laundry treating apparatus 10.

The power portion P46 and the execution portion P47 may be configured to generate control signals by sensing the static electricity of a user's body.

The power portion P46 may include a first button 461 exposed to the outside of the cabinet 1, a first detection sensor 464 fixed to the first circuit board P4, and a conductor (i.e., a first touch spring) 463 connecting the first button and the first detection sensor. Likewise, the execution portion P47 may include a second button 471 exposed to the outside of the cabinet 1, a second detection sensor 474 fixed to the first circuit board P4 and a conductor (i.e., a second touch spring, not shown) connecting the second button and the second detection sensor.

A first touch spring 463 and a second touch spring may be provided in coil shapes to provide restoring forces to the first button 461 and the second button 471, respectively. Further, in order to prevent the first button 461 and the second button 471 from being separated from the button mounting portions 116 and 117, respectively, a first stopper 462 for limiting the range of motion of the first button is provided to the power supply 46 and a second stopper (not shown) for limiting the range of motion of the second button may be provided to the execution portion 47.

The encoder P5 is a means for rotatably fixing the manipulation portion P7 to the first circuit board P4 as well as a means for generating an electrical signal when the manipulation portion P7 rotates (or generating an electrical signal set differently depending on a rotation angle of an actuator).

Figure 6:
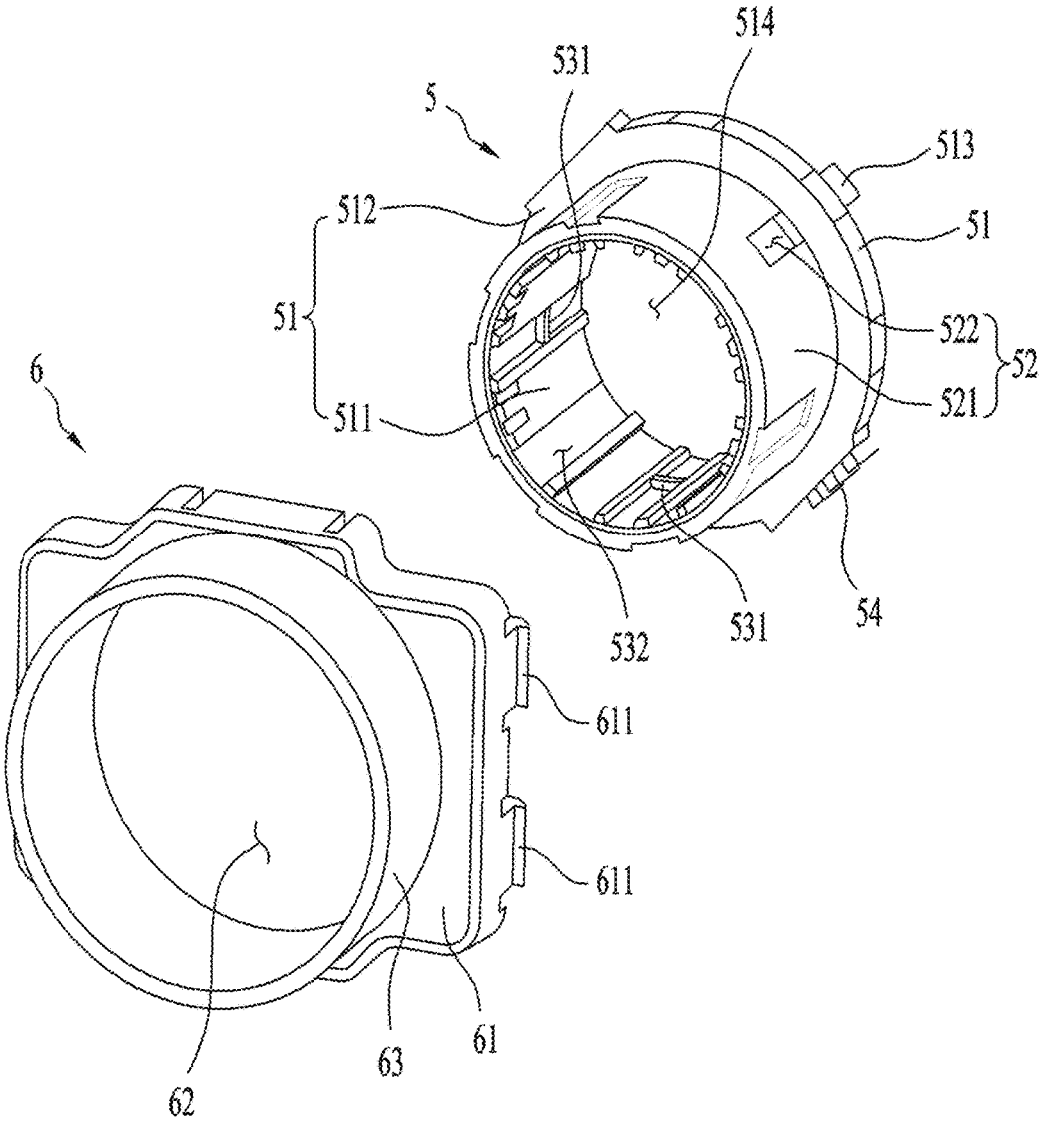
FIG. 6 shows a structure of an encoder of a control panel of a laundry treating apparatus according to the present disclosure.

FIG. 6 illustrates a structure of an encoder.

The encoder P5 may include a fixing part P51 fixed to the first circuit board P4 to have the display portion P8 fixed thereto, a rotating part P52 rotatably provided to the fixing part P51 to have the manipulation portion P7 fixed thereto, and a signal generating part P54 for generating an electrical signal when the rotating part P52 rotates.

The fixing part P51 may include a fixing body P512 fixed to the first circuit board P4, a support body 511 extending from the fixing body 512 and rotatably fixed to the rotating part P52, and a body through-hole 514 connected to the board through-hole P42 (i.e., connected to the first boss through-hole) by passing through the fixing body and the support body.

The fixing body 512 may have a cylindrical shape. A board fastening portion 513 may be provided on a circumferential surface of the fixing body 512 or one surface (e.g., a surface facing the first circuit board) of the fixing body 512. In this case, the first circuit board P4 may be provided with an encoder fixing hole P44 into which the board fastening portion 513 is inserted.

A multitude of the board fastening portions 513 and the encoder fixing holes P44 may be provided, and the encoder fixing holes P44 may be disposed to surround the board through-holes P42.

A fastening body fixing portion 531 for fastening the display portion P8 to the fixing part 51 and a position setting recess 532 for preventing the display portion 8 from rotating on inserting the display portion P8 into the body through-hole 514 may be provided in the body through-hole 514.

The fastening body fixing portion 531 may be provided as a protrusion protruding from at least one of the support body 511 and the fixing body 512 toward the center of the body through-hole 514. The drawing illustrates an example in which the fastening body fixing portion 531 is provided in the support body 511.

The position setting recess 532 may be provided as a recess in which one surface of the fixing part P51 forming the body through-hole 514 is concavely bent. In this case, the position setting recess 532 may be provided along a length direction of the body through-hole 514.

The rotating part P52 may be provided as a rotating body 521 rotatably coupled to the support body 511. A rotating body through-hole through which the support body 511 passes may be provided in the rotating body 521.

The rotating body 521 may be provided with a shaft fastening portion 522 to which the manipulation portion P7 is fastened. The shaft fastening portion 522 may be provided as a fastening hole that passes through a circumferential surface of the rotating body 521, or may be provided as a fastening recess in which the circumferential surface of the rotating body 521 is concavely bent.

The signal generating part P54 may include a magnet fixed to the rotating body 521, a sensor provided to the fixing body 512 or the support body 511 to sense magnetic force, and a terminal for connecting the sensor and the first circuit board 4. The magnets may be arranged such that a multitude of permanent magnets are spaced apart from each other along the circumferential surface of the rotating body 521.

The first circuit board P4 assembled with the encoder P5 may be coated with an insulating material. This is to minimize the possibility that the circuit is short-circuited when water is supplied to the first circuit board P4. In order to prevent the rotating body 521 from being fixed to the support body 511 by the insulating material when the insulating material is coated on one surface (e.g., a surface facing the front panel) of the first circuit board P4, an encoder cover P6 may be further provided to the control panel P.

The encoder cover P6 may be fixed to the first circuit board P4 to have a pipe shape that surrounds the encoder P5. That is, as shown in the drawing, the encoder cover P6 may include a fixing body cover P61 fixed to the first circuit board P4 and surrounding the fixing body 512, and a cover through-hole P62 provided to pass through the fixing body cover P61 to have the encoder 5 inserted therein.

A board fastening portion 611 may be provided to the fixing body cover P61, and an encoder cover fixing hole P45 to which the board fastening portion 611 is fixed may be provided in the first circuit board P4. A multitude of the board fastening portions 611 and a multitude of the encoder cover fixing holes P45 may be provided, and the encoder cover fixing holes P45 may be disposed to surround the board fastening portion 513.

A cover outlet 612 may be further provided to a circumferential surface of the fixing body cover P61 to discharge water introduced into the fixing body cover P61. The cover outlet 612 is preferably disposed at the lowermost end of the circumferential surface of the fixing body cover 61.

Meanwhile, the above-described insulating material is coated on the first circuit board P4 after both the encoder P5 and the encoder cover P6 are coupled to the first circuit board P4. The insulating material sprayed to a partial area of the first circuit board P4 (e.g., an outer space of the encoder cover) is introduced into the encoder cover P6 through the cover outlet 612. In this process, a distance L1 from the first circuit board to the uppermost end of the fixing body 512 is preferably set equal to or greater than a distance L2 from the first circuit board to the uppermost end of the cover outlet 612 so that the insulating material may be blocked from being supplied to the rotating body 521.

The encoder cover P6 may further include a support body cover P63 extending from the fixing body cover P61 and surrounding the rotating body 521 (surrounding the support body). Since the support body cover P63 may restrict the manipulation portion P7 from moving in a diameter direction of the cover through-hole 62, the support body cover 63 may prevent the manipulation portion P7 from being separated from the rotating body 521.

Figure 7:
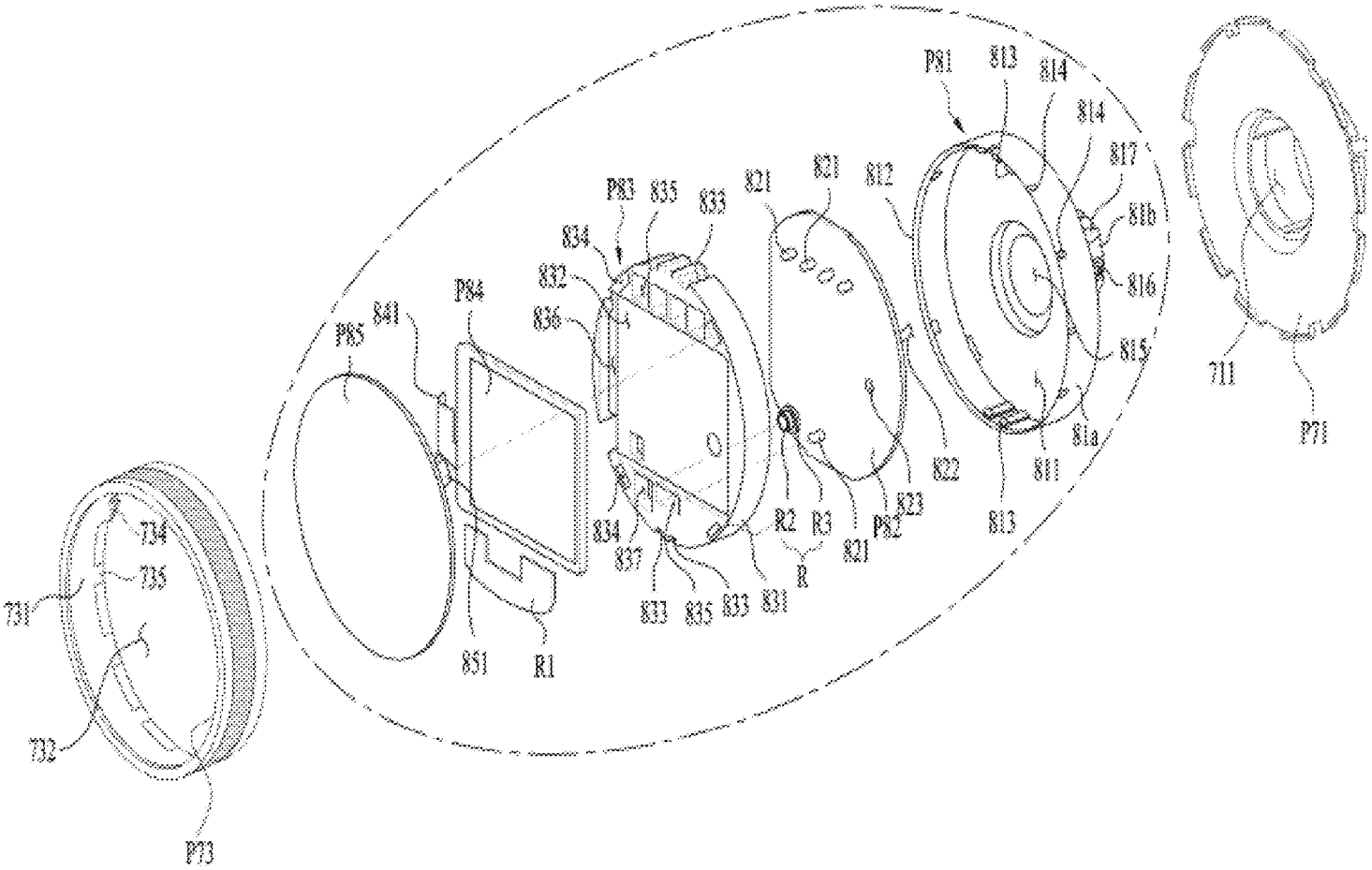
FIG. 7 shows a manipulation structure of a laundry treating apparatus according to the present disclosure.

FIG. 7 is a diagram illustrating a structure of a manipulation portion and a display portion.

The manipulation portion P7 may include a shaft 71 passing through the front panel 11 and fixed to the rotating body 521 and a circular handle 73 fixed to the shaft 71 and positioned outside the cabinet 1.

The cabinet 1 may include a panel through-hole 134 provided to pass through the front panel 11, and the shaft 71 may be inserted into the panel through-hole 134.

The shaft P71 may be provided as a pipe having a shaft through-hole 711 inside. The rotating body 521 provided to the encoder is inserted into the shaft through-hole 711, and a rotating body fastening portion 712 provided on a circumferential surface of the shaft P71 and positioned inside the shaft through-hole 711 is coupled to the shaft fastening portion 522 provided to the rotating body. Accordingly, the shaft P71 is fixed to the rotating body 521 through the rotating body fastening portion 712 and the shaft fastening portion 522.

The handle P73 may be fixed to the shaft P71 to be positioned outside the cabinet 1, and a user may supply a force required for rotation of the rotating body 521 to the shaft P71 through the handle P73.

The handle P73 may include an accommodation space 731 formed in the handle to communicate with the shaft through-hole 711 and a handle through-hole 732 perforating one surface of the handle P73 to communicate the accommodation space 731 with the outside.

When a diameter of the handle P73 is set to be longer than that of the shaft P71, the shaft P71 may further include a base 713 to which the handle P73 is fixed. The base 713 may be provided as a disk fixed to the circumferential surface of the shaft P71.

The handle P73 and the base 713 may be coupled to each other through a base fastening portion 734 provided to the circular handle 73 and a handle fastening portion 714 provided to the base 713.

The base fastening portion 734 may be provided as a multitude of protrusions fixed to the handle to be positioned inside the accommodation space 731, and the handle fastening portion 714 may be provided in the base 713 and may be provided as an indent in which the protrusion is accommodated.

To facilitate the coupling between the handle P73 and the base 713, the handle P73 may be provided with a fastening guide 735 positioned between one base fastening portion 734 and another base fastening portion 734, and the base 713 may be provided with a guide indent 715 into which the fastening guide 735 is inserted. The guide indent 715 may be provided as an indent in which a circumferential surface of the base 713 is bent toward the shaft through-hole 711.

The display portion P8 may include a housing P81 fixed to the fixing body 512 of the encoder and positioned inside the accommodation space 731 of the actuator, a display P84 fixed to the housing and displaying information (e.g., information related to control, operation, and the like of the laundry treating apparatus), and a circuit board (i.e., a second circuit board or a display portion circuit board) P82 provided to the housing and having a circuit for controlling the display P84.

The housing P81 may include a fastening body 81*b* fixed to the fixing body 512 by being inserted into the body through-hole 514 through the shaft through-hole 711 and an accommodation body 81*a* fixed to the fastening body 81*b* and positioned inside the accommodation space 731.

The accommodation body 81*a* may be provided in any shape capable of being inserted into the accommodation space 731, and the accommodation body 81*a* is provided in a cylindrical shape as an example shown in the drawing.

A mounting space 811 is formed within the accommodation body 81*a*, and the mounting space 811 communicates with the accommodation space 731 provided in the handle through an accommodation body through-hole 812 (e.g., the accommodation body through-hole is provided to communicate with the handle through-hole). That is, the accommodation body through-hole 812 is provided on a surface facing a direction in which the handle through-hole 732 is located in the space provided by the accommodation body 81*a*.

The fastening body 81*b* may be provided in any shape capable of being inserted into the shaft through-hole 711 and the body through-hole 514 of the encoder, and the fastening body 81*b* is provided in a cylindrical shape as an example shown in the drawing. The fastening body 81*b* is provided with a fastening body through-hole 815 connected to the mounting space 811.

A fixing body fastening portion 816 may be provided on a circumferential surface of the fastening body 81*b*. The fixing body fastening portion 816 is a means for fixing the housing P81 to the fastening body fixing portion 531 provided in the encoder.

Furthermore, a multitude of position setting protrusions 817 may be further provided on the circumferential surface of the fastening body 81*b*.

The accommodation body 81*a* may have a greater diameter than the fastening body 81*b*. The accommodation body 81*a* may extend from a distal end of the fastening body 81*b* to have the greater diameter than the fastening body 81*b* to define the mounting space 811 therein. The second circuit board P82 may be completely accommodated in the accommodation body 81*a*.

The second circuit board P82 may be protected by sealing front and rear sides of the display portion P8.

The position setting protrusion 817 has a shape that can be inserted into the position setting recess 532 provided in the encoder, and the position of the position setting protrusion 817 is provided at a position corresponding to the position of the position setting recess 532. The position setting protrusion 817 and the position setting recess 532 are a means for minimizing a risk that the fixing body fastening portion 816 cannot be coupled to the fastening body fixing portion 531 (i.e., a means for securing the coupling between the fixing body fastening portion and the fastening body fixing portion) when the fastening body 81*b* is inserted into the body through-hole 514.

The second circuit board P82 may be inserted into the mounting space 811, and the wire 822 connected to the second circuit board P82 may be drawn out of the housing P81 through the fastening body through-hole 815. A multitude of lamps 821 may be provided on the second circuit board P82.

The second circuit board P82 may control the display P84 to display preset information according to an electrical signal generated by the signal generating part 54 when the handle P73 rotates.

In order to maintain a gap between the second circuit board P82 and the display P84 and to prevent damage to the lamp 821, the mounting space 811 may be provided with a mounting part P83 positioned between the display P84 and the second circuit board P82.

The mounting part P83 may be provided as a mounting body 831 fixed to the accommodation body 81*a* and positioned inside the mounting space 811. The mounting body 831 may be provided in any shape capable of being inserted into the mounting space 811.

A seating recess 832 to which the display P84 is fixed is provided on one surface of the mounting body 831. A connector through-hole 836 may be provided in the seating recess 832, and a connector (e.g., a flexible PCB hinge, or the like) 841 provided to the display P84 may be inserted into the connector through-hole 836 to be connected to the second circuit board P82.

A lamp through-hole 835 into which the lamp 821 is inserted may be provided in the mounting body 831. The number of the lamp through-holes 835 is preferably set equal to that of the lamps 821, and the position of the lamp through-hole 835 should be set as a space of the mounting body located above the seating recess 832 or a space of the mounting body located below the seating recess 832. This is to enable the light emitted from the lamp 821 to be transmitted to the outside of the housing P81 through the lamp through-hole 835.

The mounting part P83 is fixed to the housing P81 through the mounting body fastening portion 813 provided to the accommodation body 81 a and the accommodation body fastening portion 833 provided to the mounting body 831. The mounting body fastening portion 813 is provided as a multitude of protrusions located inside the mounting space 811. The accommodation body fastening portion 833 may be provided on a circumferential surface of the mounting body 831 (i.e., one surface of the mounting body coming in contact with the accommodation body) and may be provided as a recess to which the mounting body fastening portion 813 is fixed.

The number of the mounting body fastening portions 813 may be set equal to that of the accommodation body fastening portions 833, and the positions of the mounting body fastening portion 813 and the accommodation body fastening portion 833 should be set to correspond to each other.

In order to increase the fastening force of the mounting body 831, the accommodation body fastening portion 833 may be provided with an upper fastening portion positioned at a higher point than the seating surface 832 and a lower fastening portion positioned at a lower point than the seating surface 832. Unlike the drawings, the accommodation body fastening portion 833 may be provided on each of the left and right sides of the seating surface.

A window P85 may be further provided to the accommodation body 81*a* to prevent water and foreign substances from being introduced into the display P84 and the second circuit board P82.

Preferably, the window P85 is fixed to at least one of the accommodation body 81*a* and the mounting body 831 to close the accommodation body through-hole 812. The window P85 may be formed of a material having a transparency such that the information displayed on the display P84 and the light emitted from the lamp 821 can be checked externally.

When the window P85 is fixed to the mounting body 831, a cover fixing protrusion 851 protruding toward the mounting body 831 may be provided to the window P85, and a fixing protrusion fastening portion 834 to which the cover fixing protrusion 851 is coupled may be provided to the mounting body 831.

The second circuit board P82 may also be fixed to the mounting body 831. That is, the mounting part P83 may include a protrusion 838 protruding from the mounting body 831 toward the second circuit board 82, and the second circuit board 82 may be provided with a protrusion through-hole 823 into which the protrusion 838 is inserted.

Furthermore, the window P85 may further include a cover sheet 853 that reduces transparency of the cover. Transparency of the cover sheet is preferably set to a level at which the inside of the mounting space 811 is difficult to be seen from the outside (the transparency of the cover sheet is set lower than that of the cover). The cover sheet 853 may be fixed to a surface of the cover 85, and a letter or a symbol H may be disposed in an area of the cover sheet where the lamp through-hole 835 is projected.

Meanwhile, in the mounting part P83, the lamp through-hole 835 corresponding to the input area D3 of the lamp through-hole 835 may provide a user with a signal for pressing the input area D3.

The selection portion R may be provided inside the display portion P8. Specifically, the selection portion R may be provided as a configuration of the display portion P8, and may be provided to the display portion P8 to be disposed inside the manipulation portion P7.

Accordingly, it can be seen that the display portion P8 includes the selection portion R for receiving a determination command for determining the state information displayed on the display P84. Since the determination command determined by the selection portion R varies according to the state information, the selection portion R may correspond to a variable input portion.

For example, when selection information of a course and option is displayed on the display P84, the selection portion R may be configured to input a determination command for selecting or determining the course and option. In addition, when a guide text is displayed on the display P84, the selection portion R may be configured to input a determination command for checking the guide text.

As a result, the selection portion R may be configured to receive an input of a determination command for confirming or determining a corresponding control command according to a type of a control command displayed on the display 84.

The selection portion R may be configured to determine whether the control command displayed on the display P84 is selected by detecting whether a user's body is in contact with the window P85.

That is, the selection portion R may include a sensor R3 provided to the second circuit board 82 to sense static electricity of a user's body and a conductor R2 or a physical button RI connecting the sensor R3 and the window P85.

The selection portion R may include a receiving portion RI attached to or coupled to the window P85 and a transmitting portion R2 having one end connected to the receiving portion R1 and the other end connected to the sensor R3. In this case, a conductor through-hole 837 into which the transmitting portion R2 is inserted should be provided in the mounting body 831.

The receiving portion R1 is a means for facilitating an input of a control command by expanding an area in which a user can contact. In the control panel P having the above-described structure, the display area D1 is formed in the upper space of the window P85 and the input area D3 is formed in the lower space of the window P85. Therefore, when the width of the receiving portion R1 is set to be wide, the width of the input area D3 is expanded, and thus a user may more easily input a control command. It is preferable that the width of the receiving portion R1 is ¼ to ½ or less of the width of the window P85.

The transmitting portion R2 and the receiving portion R1 may be formed of a conductor. Accordingly, when the user's body is in contact, a body current of the user may be charged or transferred to transfer the current to the sensor R3.

In addition, the transmitting portion R2 and the receiving portion R1 may be provided as physical buttons. Accordingly, when a body of the user presses the receiving portion R1, a pressure of the body may be transferred to the sensor R3.

The receiving portion RI may be provided as a film printed or attached to a rear surface of the window P85, or may be formed of a carbon-based material.

Figure 8:
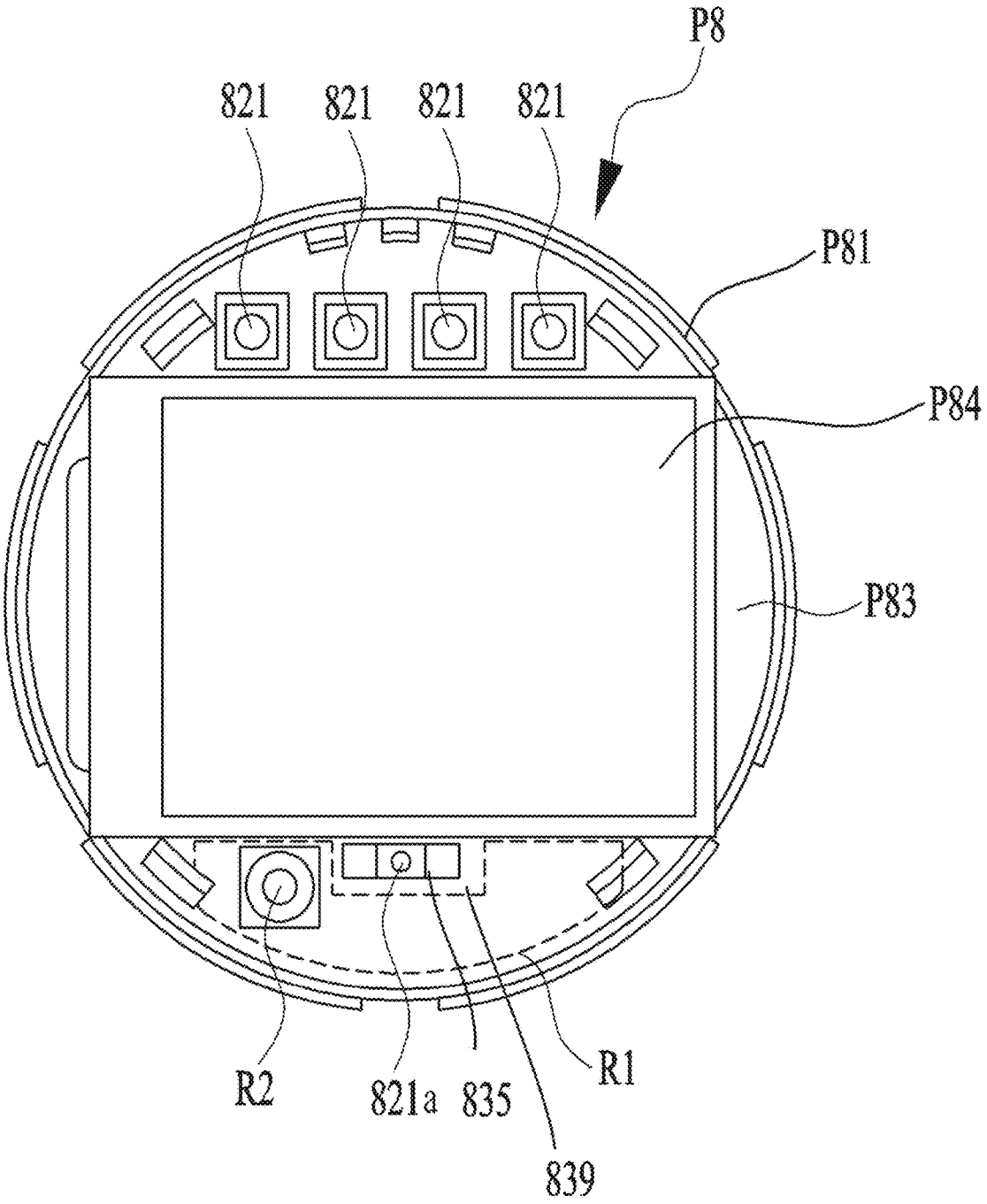
FIG. 8 shows a display portion of a laundry treating apparatus according to the present disclosure.

In one example, the display portion P may include the inducing portion 839 that induces the user to press the selection portion R (see FIG. 8).

The inducing portion 839 may guide the user to a position of the selection portion R to induce the user to input the selection portion R.

The inducing portion 839 may include a lamp 821 corresponding to the position of the receiving portion R1 and the lamp through-hole 835. Specifically, the inducing portion 839 may include the lamp through-hole 835 disposed under the display P84 and the lamp 821 installed in the lamp through-hole 835.

The lamp through-hole 835 and the lamp 821 constituting the inducing portion 839 may be disposed at the center under the display 84 with respect to the mounting part 83.

Accordingly, when the lamp 821 emits light in the inducing portion 839, the selection portion R or an area adjacent to the selection portion R may become bright.

Additionally, the lamps 821 of the inducing portion 839 may be constructed as LED elements or the like to display separate characters or phrases.

The control panel P having the above-described structure enables the display of the control command, the search of the displayed control command, and the selection of the displayed control command, and can minimize the space required for installation. Yet, the control panel P having the above-described structure needs a means for blocking water or foreign substances from being introduced into the display portion P8 and the manipulation portion P7 or a means for discharging the introduced water or foreign substances externally.

The control panel P having the above-described structure may display a preset control command on the display P84 whenever a user turns the handle P73 (e.g., whenever the encoder generates an electrical signal) (search and change of a control command).

When a desired control command is displayed on the display P84, the user may select the displayed control command through the selection portion R. The control command selected through the selection portion R may be initiated when the user inputs an execution command through the execution portion P47.

Meanwhile, although the handle P73 is coupled to the first circuit board P4 so as to be rotatable, since the housing P81 of the display portion is fixed to the first circuit board P4, it is necessary to constantly maintain a gap between the handle P73 and the housing P81. This is because the rotation of the handle P73 may be restricted when the gap between the handle P73 and the housing P81 is not maintained.

FIG. 8 shows a structure of the display portion P8.

The display portion P8 may be fixed to the inside of the manipulation portion P7 and display state information of the course selected via the manipulation portion P7. In addition, the display portion P8 may display state information of the controller P1 and P2, and may also display state information transmitted from an external terminal 40, a server 50, or the like.

In addition, the display portion P8 may also display state information including a notice to be notified to the user, and may also display state information requesting confirmation from the user.

Here, the state information may be defined as a concept that includes all information that is displayed on the display portion P8 and is able to be recognized by the user via the laundry treating apparatus. As a result, the display portion P8 may display all state information related to the laundry treating apparatus.

In one example, the display portion P8 may display the state information via the display P84 and the state area D1.

Because the display P84 may include a liquid crystal, which will be described later, and thus may display plurality of state information. The display portion P8 may suitably display state information required at a corresponding time point among the plurality of state information via the display P84. As a result, the state information displayed on the display P84 may vary depending on an operating time point or a situation of the laundry treating apparatus, and the display P84 may display arbitrary state information among the plurality of state information.

Because the circuit board P82 and the plurality of lamps 821 are located on a rear surface or inside the mounting body 831, light emitted from the plurality of lamps 821 needs to reach the window P85. Accordingly, the mounting part P83 has the lamp through-hole 835 that extends through the mounting body 831 and forms a passage through which the light generated from the lamp 821 reaches the window P85.

The number of lamp through-holes 835 may correspond to the number of plurality of lamps 821, and the lamp through-holes 835 may be defined to extend through the mounting body 831 at locations overlapping the plurality of lamps 821, respectively.

Additionally, the user may continuously check determination information displayed on the display P84 and press the selection portion R.

In one example, the display P84 may be seated on the mounting part P83.

The display portion P8 may display a selection area D3 at a lower portion of the display P84, and the selection area D3 may receive an input from the user. Therefore, the display portion P8 may transmit the input received from the user to the circuit board P82, thereby transmitting an intention of the user to the control panel P.

Generally, an input portion P9 that receives the input of the user includes the manipulation portion P7, the execution portion P47, and the setting portion P2 and all of those are located outside the display portion P8, and the display portion P8 displays information generated from the control panel P. Therefore, in a general situation, there may be no need to receive the input from the user via the selection portion R.

However, a notification may be displayed to the user or information requiring user confirmation may be displayed via the display portion P8. When the user presses the display portion P8 and transmits a command to confirming the information to the control panel P, the user may feel that he or she is communicating more closely with the control panel P.

To this end, the display portion P8 may further include the selection portion R that may receive the intention of the user, such as the confirmation of the displayed information and selection of the displayed information from the user.

In a process in which the control panel P controls the laundry treating apparatus, the confirmation or a determination command of the user may be required, and the control panel P may display contents of the determination command or requests on the display P84 of the display portion P8 via the circuit board P82.

In addition, the circuit board P82 may allow the selection portion R to respond to the input only when it is necessary to receive the intention of the user and may not allow the selection portion R to respond even when the selection portion R is pressed when there is no need to receive the intention of the user. As a result, the control panel P may control the selection portion R such that an input manipulation of the selection portion R is activated only when the confirmation or the determination command of the user is required.

The display portion P8 may include the inducing portion 839 that indicates that the confirmation or request of the determination command is needed to the user by displaying whether the input manipulation of the selection portion R is activated.

The inducing portion 839 may include a lower lamp or light emitting body 821*a* coupled to the circuit board P82 and disposed at the lower portion of the display P84. Additionally, the inducing portion 839 may include an inducing hole 835*a* that extends through the mounting part P83 and exposes the lower lamp 821*a*.

The inducing hole 835*a* is defined such that light emitted from the lower lamp 821*a* extends through the mounting part P83, so that the inducing hole 835*a* may be defined as a transmission hole. The lower lamp 821*a* may be formed as the light emitting body that emits light, and may be spaced apart from the circuit board P82 and irradiate light to guide touch of the selection portion R.

For example, the circuit board P82 may place the lower lamp 821*a* at the lower portion of the display P84 such that the lower lamp 821*a* is turned on when the input manipulation of the selection portion R is activated.

The lower lamp 821*a* may be formed as a panel such as the LED to display the determination command to be input to the selection portion R, and may be turned on while displaying which determination command the input of the selection portion R corresponds to in the lower area of the display P84.

The lower lamp 821*a* may be disposed at a center based on the left and right direction of the mounting part P83. Accordingly, by allowing the inducing portion 839 to be turned on at the lower center of the display P84, aesthetics may be maximized compared to a case in which the inducing portion 839 is biased to one side.

When the inducing portion 839 is turned on, the user may recognize that the determination command is needed and may press the selection portion R.

The selection portion R may be formed integrally with the inducing portion 839, and an input of the inducing portion 839 may be regarded as the input of the selection portion R.

However, because the inducing portion 839 is formed as the lamp 821 to emit light and the selection portion R includes the sensor R3, it may be difficult for the inducing portion 839 and the selection portion R to be designed as a single component. In particular, when the lamp 821 and the sensor R3 are disposed together, there may be a risk that the sensor R3 blocks light emitted from the lamp 821 and there may be a risk that the lamp 821 transmits noise or an incorrect signal to the sensor R3. Accordingly, the selection portion R may be disposed to be spaced apart from the inducing portion 839.

As a result, the sensor hole 837 may be defined to be spaced apart from the inducing hole 835*a*. The inducing hole 835*a* is defined between the seating recess 832 and an inner circumferential surface of the mounting body 831. The sensor hole 837 may be defined between the seating recess 832 and the inner circumferential surface of the mounting body 831. The sensor hole 837 may be defined in an area excluding an area between the inducing hole 835*a* and the inner circumferential surface of the mounting body 831.

The selection portion R may include the sensor R3 coupled to the circuit board P82 and receiving the determination command, the transmitting portion R2 that transmits the determination command to the sensor R3, and the receiving portion R1 that extends from the transmitting portion R2 to the window P85 and is able to be in contact with a user's body.

The receiving portion R1 may be attached to a rear surface of the window P85. Accordingly, the transmitting portion R2 may extend through the mounting body 831 and the mounting body 831 may include the sensor hole 837 that provides a space through which the transmitting portion R2 extends.

The receiving portion R1 and the transmitting portion R2 may be made of a conductor, and when the user's body approaches, may be charged by a current flowing through the user's body or receive the current from the body. Accordingly, the user may input the determination command by touching the receiving portion R1.

The current transmitted to the receiving portion R1 may be transmitted to the sensor R3 via the transmitting portion R2, and the circuit board P2 may sense the contact of the user and receive the determination command.

In general, the user may input the determination command by touching the area where the transmitting portion R2 is installed.

Because the window P85 covers the inducing portion 839 and the selection portion R, the user may not know the location of the selection portion R. Additionally, the inducing portion 839 induces the input to the selection portion R via a scheme of emitting light or the like, so that the user may only recognize the location of the inducing portion 839 with the light emitted from the inducing portion 839.

Accordingly, the user may regard the inducing portion 839 as the selection portion R and touch an area where the inducing portion 839 is installed of the window P85. At this time, when the selection portion R is not pressed, the user may doubt a performance of the control panel P.

Accordingly, even though the transmitting portion R2 of the selection portion R is disposed to be spaced apart from the inducing portion 839 by a certain distance, the receiving portion R1 may extend from the transmitting portion R2 to an area surrounding at least a portion of the inducing portion 839 to sense the user's body pressing the inducing portion 839.

The receiving portion R1 may be disposed to surround both side surfaces and a lower portion of the inducing portion 839 and may completely cover the lower portion of the display P84 and an area from a periphery of the inducing portion 839 to an inner circumferential surface of the mounting part P83.

As a result, an entirety of the user's body touching the lower portion of the display P84 may be sensed, and the current generated by the user's body may be moved to the transmitting portion R2.

As a result, even when the user presses the inducing portion 839, an effect that the transmitting portion R2 is pressed may be achieved because of the shape of the receiving portion R1.

Figure 9:
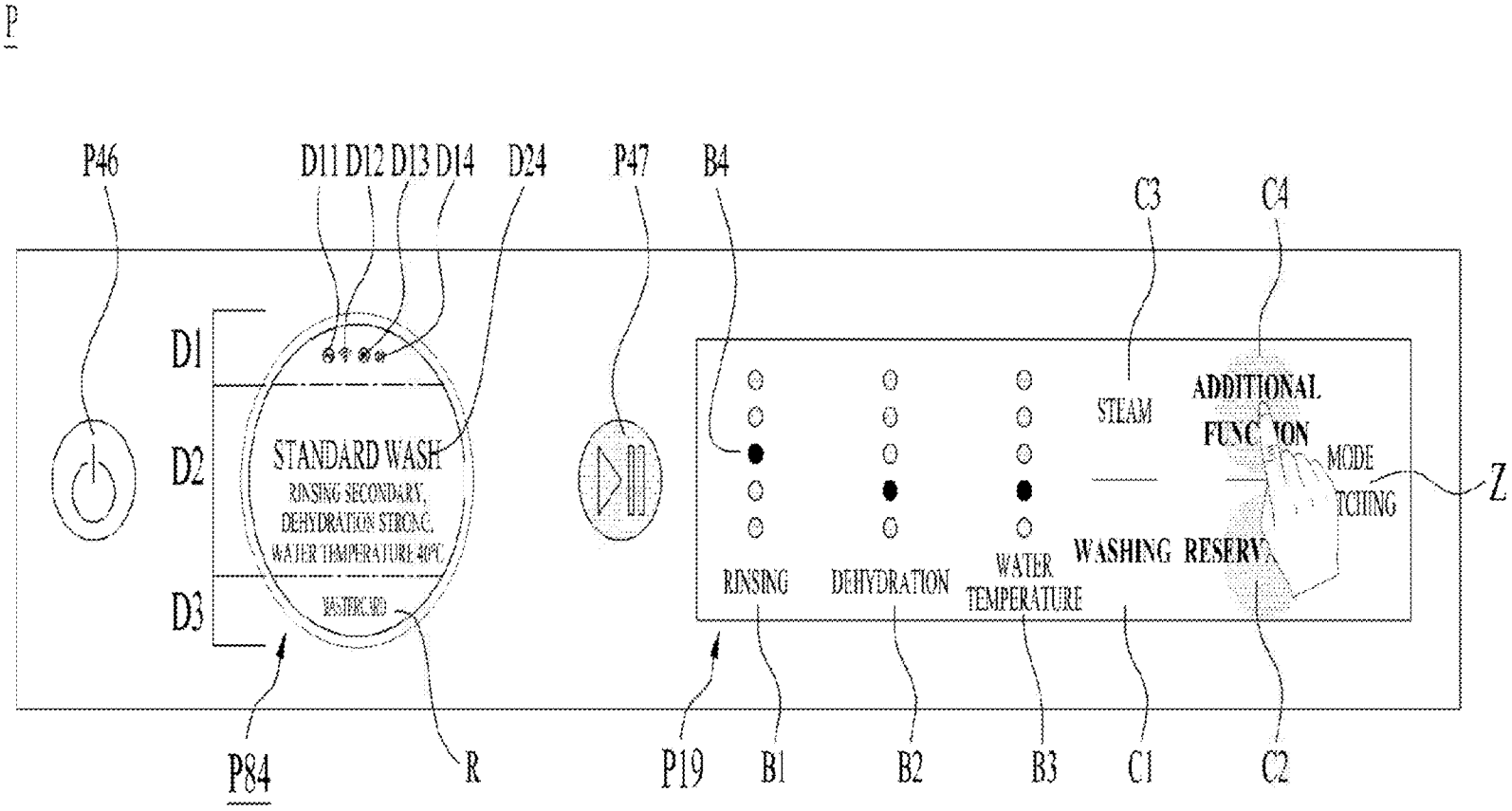
FIG. 9 shows an operational embodiment of a control panel of a laundry treating apparatus according to the present disclosure.

FIG. 9 shows utilization of the control panel.

In the state area or state display area D1 of the display portion P8, whether the door is locked, whether the communication module is activated, whether the course or the option is operating, whether a notice message has been generated, and the like may appear in a form of an icon.

Additionally, the state display area D1 may display the number of display contents that may appear while rotating the manipulation portion P7. For example, a plurality of dots may be arranged to be spaced apart from each other, and one of the plurality of dots may emit light to provide the number of contents displayed in the content display area D2.

The state area D1 is composed of the plurality of lamps 821 described above. Because the plurality of lamps 821 are only able to transmit the signals by being turned on and off, the state information that may be displayed via the plurality of lamps 821 may be more limited than that of the display P84. Accordingly, the state area D1 may display only specific state information among the plurality of state information.

The plurality of lamps 821 constituting the state area D1 may be set to display preset state information, respectively.

The plurality of lamps 821 may be controlled by being coupled to the circuit board P82.

Icons corresponding to the state information may be disposed in the window P85 based on the number of lamps 821. For example, when there are four lamps 821, a lock icon, a Wi-Fi icon, an execution/stop icon, a remote control icon, a speaker notification icon, a button lock icon, and the like may be printed on the window P85. Therefore, when state information corresponding thereto occurs, the circuit board P82 may turn on the corresponding lamp 8211 to 8214.

For example, the plurality of lamps 821 may include a door lamp D11 that indicates locked state information of the door. The door lamp D11 being turned on may correspond to externally displaying state information indicating that the door is locked to the cabinet. To this end, a related icon (e.g., a key icon) may be displayed in an area of the window P85 corresponding to the door lamp D11.

The plurality of lamps 821 may include a communication lamp D12 that indicates state information indicating that a communication module T1 is activated. The communication module T1 being activated may mean a state in which the communication module T1 is connected to an AP 30.

The communication lamp D12 being turned on may correspond to externally displaying state information indicating that the communication module T1 is connected to the AP 30 or the external terminal 40. To this end, an icon (e.g., the Wi-Fi icon) related thereto may be displayed in an area of the window P85 corresponding to the communication lamp D12.

The plurality of lamps 821 may include a remote lamp D13 that indicates state information indicating remote control by the external terminal 40. The remote lamp D13 being turned on may correspond to externally displaying state information indicating that the laundry treating apparatus is operating by the external terminal 40. To this end, an icon (e.g., a start/stop icon) related thereto may be displayed in an area of the window P85 corresponding to the remote lamp D13.

The plurality of lamps 821 may include a lock lamp D14 that indicates state information indicating that an input manipulation of the input portion P9 including the manipulation portion P7 has been deactivated.

The lock lamp D14 being turned on may correspond to externally displaying state information indicating that the input manipulation of the input portion P9 including the manipulation portion P7 has been deactivated. To this end, an icon (e.g., a prohibition icon) related thereto may be displayed in an area of the window P85 corresponding to the lock lamp D14.

In one example, the state area D1 may be disposed upwardly of the display P84.

This is because there is no possibility that the display P84 is shielded by the state area D1 because the state area D1 does not need to be pressed by the user.

In addition, because the state area D1 is for externally displaying the preset state information, the state area D1 may be selectively lit upwardly of the display P84 to intuitively convey the state information to the user.

In one example, the selection portion R is preferably disposed downwardly of the display P84. This is to prevent at least a portion of the display P84 from being shielded by the user's body when the selection portion R is pressed, because the selection portion R is to be in contact with the user's body.

The contents of a course and option, an execution state of the course or option, and a guide phrase necessary for a user may be displayed in the content display area D2.

The content display area D2 may be provided larger than the state display area D1.

An input area D3 may emit light to request a user's input, and a guide phrase indicating what kind of content the user should input may be displayed in the input area D3.

A power portion P46 may be provided on the left side of the display portion P8, and an execution portion P47 may be provided on the right side of the display portion P8.

The manipulation portion P7 may be rotatably provided on an outer circumferential surface of the display portion P8 and may be provided to rotate the drum 3.

The random course may be a series of control methods for performing a washing cycle of washing laundry.

When the manipulation portion P7 is rotated, a name of the corresponding course and a simple option name may be displayed in the content display area D2 of the display portion P8 according to a configured order, and a description of the course or option may be displayed.

The option may be selected by the setting portion P2. The setting portion P2 may be configured to receive an input of a selection command for selecting one or more of random options.

The random option may include setting an additional condition of the course.

For example, the random option may include a configured algorithm or control method for adjusting at least one of the number of iterations for performing the course, the strength on performing each cycle, RPM of a drum on performing each cycle, a temperature of water, an amount of water, and a duration time of each cycle.

The setting portion P2 may be provided as a touch display capable of selecting the random option or may include a plurality of lamps and a plurality of conductor switches capable of sensing a user's body.

For example, the setting portion P2 may include an option selection portion B for receiving an input of a setting command for setting a condition for the course and an option display portion B4 for displaying option information corresponding to the option selection portion B.

For example, the option selection portion B may include a rinsing portion B1 for adjusting an RPM and duration time of the drum, an amount of water, and a rinsing power related to the number of rinsing times on performing a rinsing cycle in the course, a dewatering portion B2 for adjusting a dewatering force related to an RPM and duration time of a drum on performing a dewatering cycle in the course, and a temperature portion B3 for adjusting the temperature of the water on performing a washing cycle in the course.

The option display portion B4 may be configured to display the rinsing power, the dewatering force, and the temperature by objectifying and portionizing them.

Meanwhile, the setting portion P2 may be provided with a utilization portion C for receiving an input of a utilization command for utilizing the function of the laundry treating apparatus.

For example, the utilization portion C may include a washing portion C1 capable of inputting a special washing cycle for functional laundry, soft laundry, and tub cleaning, and the like, a reservation portion C2 for inputting a reservation command for performing a washing course at a specific time, a sterilization portion C capable of adding steam to laundry during the course cycle to promote sterilization, and an additional function portion C4 for utilizing additional functions such as pairing with other devices, etc.

Additionally, the setting portion P2 may include a switching portion E that receives a connection command for communication with the drying apparatus or mini apparatus 60.

Meanwhile, the setting portion P2 may turn on a light of a function that can be utilized at the present time or a function selected by a user, or turn off a light of a function that cannot be executed or a function that is not selected by the user.

The setting portion P2 may display all of the contents through an auxiliary display P19.

Hereinafter, an embodiment and a control method for controlling the drying apparatus or the mini apparatus 60 and displaying information thereof using the control panel P of the washing apparatus 10 will be described. However, this is only to eliminate repetitive descriptions, and is able to be applied in the same manner when controlling the washing apparatus 10 or the mini apparatus 60 using a drying apparatus control panel PA.

In addition, this may be applied in the same manner when controlling the washing apparatus 10 or the drying apparatus using a mini apparatus control panel PC.

Figure 10:
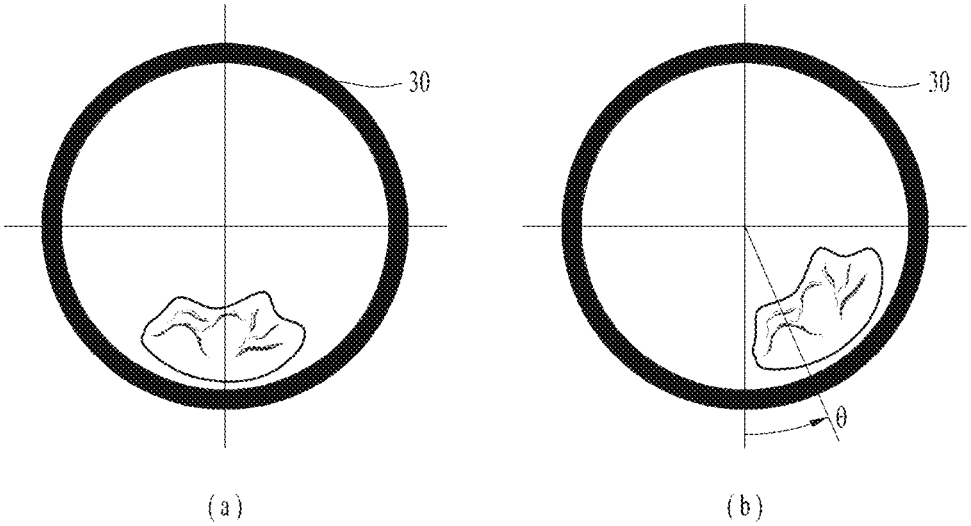
FIG. 10 shows a drum rotation state during laundry amount sensing of a laundry treating apparatus according to the present disclosure.

FIG. 10 shows a laundry treating apparatus according to the present disclosure sensing a laundry amount based on the above-described configuration.

Referring to (a) in FIG. 10, the laundry may be disposed on a bottom surface of the drum 3 by a self-load thereof.

Referring to (b) in FIG. 10, when sensing the laundry amount, the laundry treating apparatus according to the present disclosure may rotate the drum 3 less than once.

That is, the laundry treating apparatus according to the present disclosure may rotate the drum 3 up to an angle at which the laundry is separated from an inner wall of the drum or an arrangement thereof varies. As a result, an unnecessary load or impact may be prevented from being transmitted to the drive portion 32 as the location of the laundry varies inside the drum 3.

As a result, the laundry treating apparatus according to the present disclosure may accurately transmit a current value applied to or output from the drive portion 32 to the controller P, and the amount of the laundry may be accurately calculated.

For example, the laundry treating apparatus according to the present disclosure may rotate the drum in a range from 0 degrees to 90 degrees when sensing the laundry amount.

In one example, as the angle at which the drum 3 rotates becomes smaller, the time it takes for the controller P to sense the amount of the laundry may be shortened and an error in sensing a weight of the laundry may be reduced.

Accordingly, the laundry treating apparatus according to the present disclosure may rotate the drum 3 in a range from 10 degrees to 45 degrees when sensing the laundry amount.

As a result, the laundry treating apparatus according to the present disclosure may quickly and accurately sense the laundry amount.

Therefore, the laundry treating apparatus according to the present disclosure may sense the laundry amount immediately upon sensing the input of the power portion P46 or the opening and closing of the door 111 before the input of the execution portion P47, and display information on the laundry amount on the display portion P8 or the auxiliary display P19.

Figure 11:
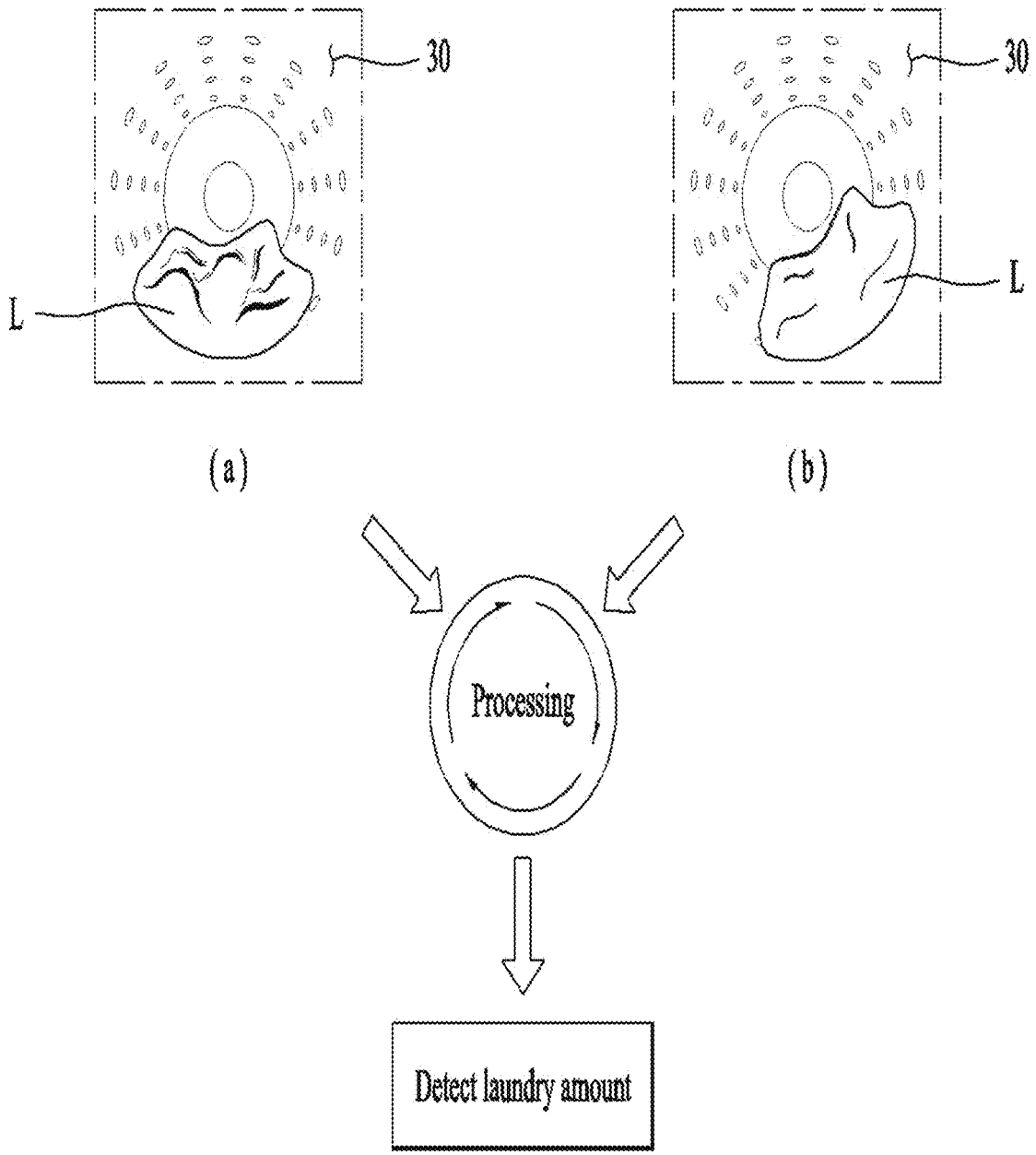
FIG. 11 shows a calculation scheme of a laundry treating apparatus according to the present disclosure.

FIG. 11 shows a laundry amount sensing calculation scheme of a laundry treating apparatus according to the present disclosure.

Referring to (a) and (b) in FIG. 11, the controller P may rotate the drum 3 less than once, and may measure a current value applied to or output from the drive portion 32 in such process.

The controller P may calculate (process) the amount of the laundry based on the current value.

Specifically, the controller P may use a formula $Te=Jdw/dt+Bw+mgr\sin\theta$ to sense the laundry amount.

Te is a torque value applied to the drive portion 32 and corresponds to I (current value) X K(drive portion constant value).

In other words, because the drive portion constant value (k) is a unique value of the drive portion 32 itself, the controller P may calculate the torque value applied to the drive portion 32 by sensing the current value (I).

In this regard, in a case of $\sin\theta$ in $mgr\sin\theta$, the value decreases exponentially as the rotation angle of the drum decreases, so that when the rotation angle is between 15 degrees and 90 degrees or between 10 degrees and 45 degrees, $\sin\theta$ may be sufficiently ignored.

In addition, Bw, as a friction torque, may be ignored because B becomes very small when the drum 3 rotates.

As a result, only a formula $Te=Jdw/dt$ may remain.

In this regard, because dw/dt is an angular acceleration of rotating the drum, the controller P may sense the angular acceleration in the process of rotating the drum when sensing the laundry amount. The angular acceleration may be directly calculated via the current value applied to the drive portion 32. A method of calculating the angular acceleration with the current value will be described later.

Therefore, because both the torque value Te applied to the drive portion 32 and the angular acceleration (dw/dt) may be calculated when measuring the current value, the moment of inertia (J) may be calculated.

As a result, the laundry treating apparatus according to the present disclosure may identify the moment of inertia (J) and immediately sense the amount of the laundry with the moment of inertia (J).

Figure 12:
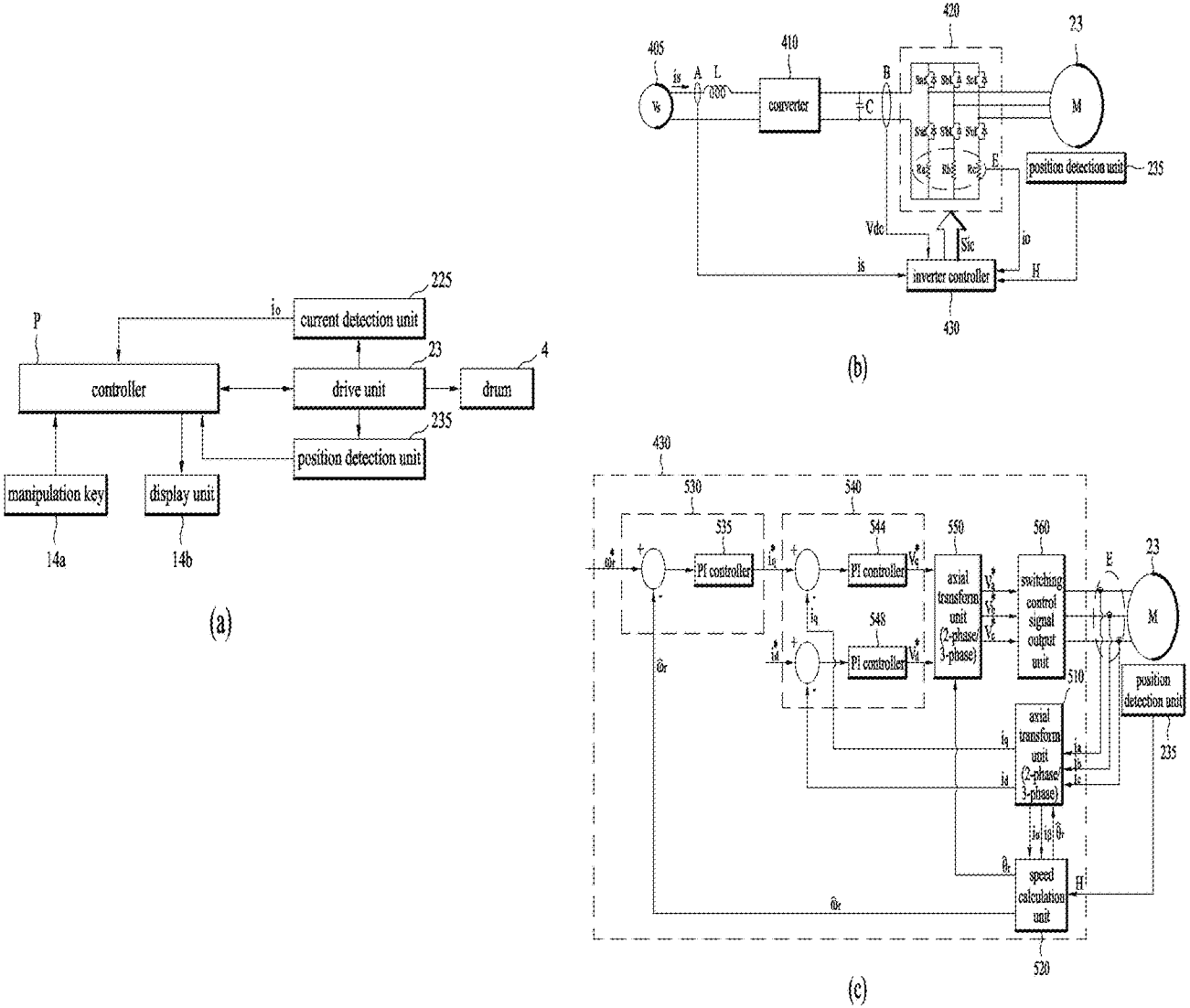
FIG. 12 shows an embodiment of laundry amount sensing of a laundry treating apparatus according to the present disclosure.

FIG. 12 shows a table showing that a laundry treating apparatus according to the present disclosure senses a laundry amount with a calculated moment of inertia.

Data describing a correlation between the moment of inertia and the laundry amount may be stored in the controller P.

In other words, the controller P may sense the weight of the laundry when identifying the moment of inertia using the data.

For example, when sensing that the moment of inertia is 55000, based on the data, the controller P may determine that the amount of the laundry is 2 kg when the drum 3 is rotated counterclockwise, and may determine that the amount of the laundry is 3 kg when the drum 3 is rotated clockwise.

As such, the controller P may immediately sense the amount of the laundry via the data.

As a result, the controller P may immediately sense the amount of the laundry by only sensing the current value applied or output when the drum rotates.

Such laundry amount sensing process may be completely performed before the drum returns to an original location thereof after rotating. As a result, the laundry amount sensing step itself may be performed within 0.3 to 1 second.

Therefore, the controller P may sense the laundry amount in an instant such that the user hardly notices the time it takes to calculate the laundry amount, and provide information related to the laundry amount.

For example, the controller P may provide one or more of the weight of the laundry, an execution time of the selected course or option corresponding to the sensed laundry amount value, and a required amount of detergent.

Figure 13:
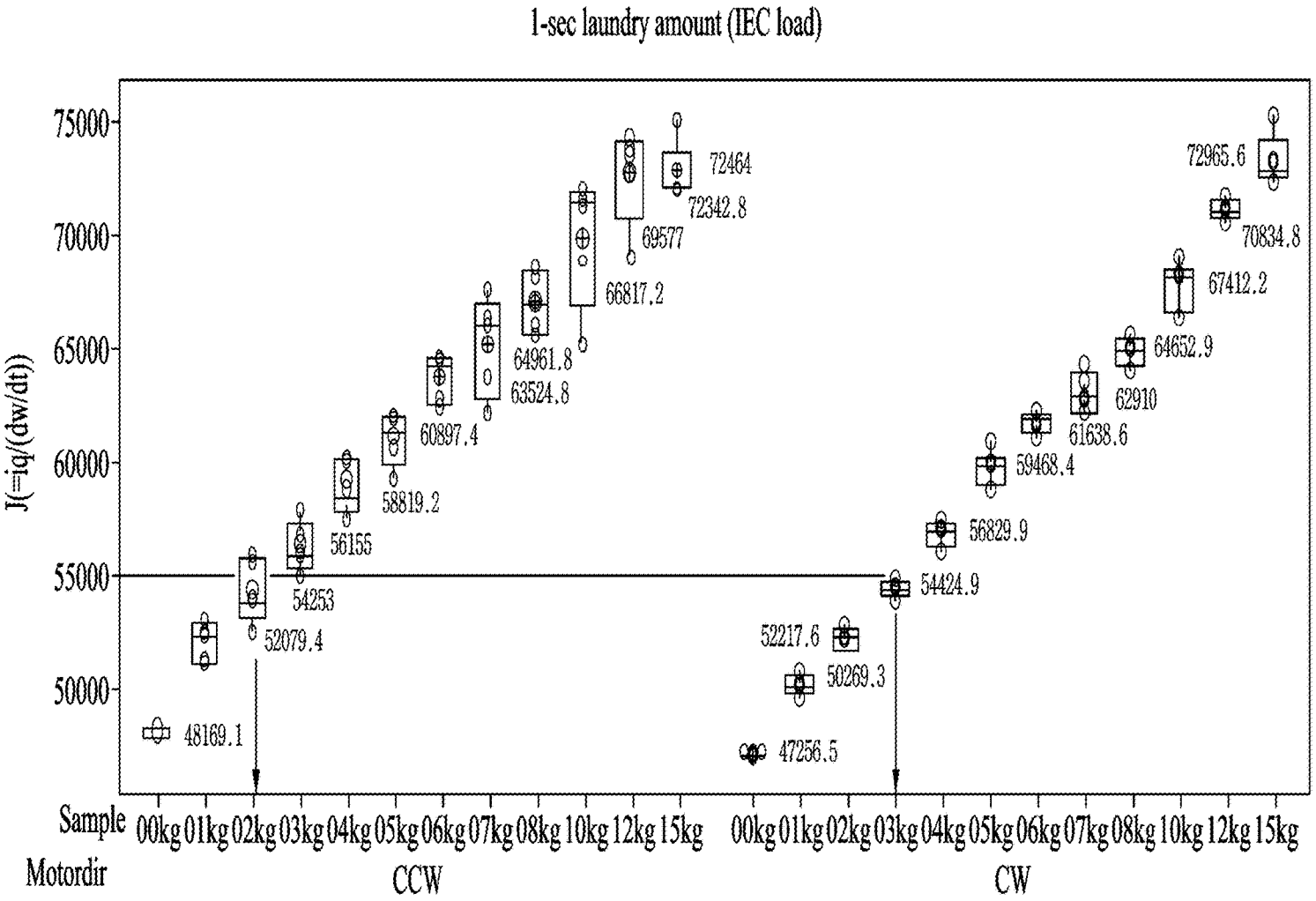
FIG. 13 shows a control table required for laundry amount sensing of a laundry treating apparatus according to the present disclosure.

FIG. 13 shows a basic structure with which the controller P may measure the current value of the drive portion 32 in the laundry treating apparatus according to the present disclosure.

Referring to (a) in FIG. 13, the controller P may control the drive portion 32 by applying the current to the drive portion 32, and may even sense the current discharged from the drive portion 32.

The controller P controls the drive portion 32 based on a preset course or option, and the drive portion 32 rotates the drum 3 based on a command of the controller P.

The controller P operates by receiving an operation signal or a control command from the manipulation portion P7, the execution portion P47, or the setting portion P2. The washing course and option to perform a washing, rinsing, and dehydration cycles may be selected via the manipulation portion P7 or the setting portion P2.

Accordingly, the washing, rinsing, and dehydration cycles may be performed. Additionally, the controller P may control the display portion P8 to display the washing course, a washing time, a dehydration time, a rinsing time, and the like, or a current operation state or the like.

The controller P may not only rotate the drum 3 by controlling the drive portion 32, but also may vary a rotation speed of the drum 3. Specifically, the controller P may control the drive portion 32 based on at least one of a current detector 225 that detects the output current flowing through the drive portion 32 and a location sensor 235 that senses a location of the drive portion 32. For example, one of the current detected from the drive portion 32 and the sensed location signal may be fed back to the controller P, and the controller P may generate a current signal that may suitably control the drive portion 32 based on the feedback signal.

In one example, the laundry treating apparatus according to the present disclosure may omit the location sensor 235 and sense the location of the drive portion 32 via implementation of a separate algorithm. (known as a sensorless drive portion). The sensorless drive portion 32 may be constructed such that the controller P may identify locations of a rotor or a stator in the drive portion 32 by measuring the current or a voltage output from the drive portion 32.

Hereinafter, an embodiment in which the controller P controls the drive portion 32 will be described.

The drive portion 32 may be formed as a three-phase motor such that the rotation speed may be controlled, and may be formed as a BLDC motor, for example.

Referring to (b) in FIG. 12, the controller P may include an inverter 420 and an inverter controller 430 to control the rotor and the stator described above. Additionally, the controller P may further include a converter 410 that supplies direct current power input to the inverter 420 or the like.

That is, the controller P may simultaneously serve as the inverter controller 430. Of course, the inverter controller 430 may be provided separately from the controller P. When the inverter controller 430 outputs a switching control signal Sic of a Pulse Width Modulation (PWM) type to the inverter 420, the inverter 420 may perform a high-speed switching operation and supply AC power at a predetermined frequency to the rotor 913 and the stator 911.

The laundry treating apparatus of the present disclosure may further include a DC stage voltage detection portion B, a smoothing capacitor C, and an output current detection portion E as well as the converter 410, the inverter 420, and the inverter controller 430. In addition, the laundry treating apparatus of the present disclosure may further include an input current detection portion A, a reactor L, and the like.

The reactor L is disposed between a commercial AC power source (vs) 405 and the converter 410 to perform a power factor correction or boosting operation. In addition, the reactor L may perform a function of limiting a harmonic current due to high-speed switching of the converter 410.

The input current detection portion A may detect an input current (is) inputted from the commercial AC power source 405. To this end, a Current Transformer (CT), a shunt resistor, or the like may be used as the input current detection portion A. The detected input current (is) is a pulse-type discrete signal and may be inputted to the inverter controller 430.

The converter 410 converts the commercial AC power source 405 that has passed through the reactor L into a DC power source and outputs it. Although the commercial AC power source 405 is illustrated as a single-phase AC power source in the drawing, it may also be a three-phase AC power source. The internal structure of the converter 410 is also changed according to the type of the commercial AC power source 405.

Meanwhile, the converter 410 may consist of a diode and the like without a switching element, and may perform a rectifying operation without a separate switching operation. For example, in the case of a single-phase AC power source, four diodes may be used in a bridge form, and in the case of a three-phase AC power source, six diodes may be used in a bridge form.

The converter 410 may use a half-bridge type converter in which two switching elements and four diodes are connected. In the case of a three-phase AC power source, six switching elements and six diodes may be used. When the converter 410 includes a switching element, a boosting operation, a power factor improvement, and a DC power conversion may be performed by a switching operation of the corresponding switching element.

The smoothing capacitor C smooths an inputted power and stores the smoothed power. In the drawings, one device is illustrated as the smoothing capacitor C, but a plurality of devices may be provided to ensure device stability.

The converter 410 may be connected to an output terminal, but DC power may be directly inputted. For example, DC power from a solar cell may be directly inputted to the smoothing capacitor C or may be inputted by DC/DC conversion. As DC power is stored, both ends of the smooth capacitor C may be referred to as a dc stage or a dc link stage.

The dc stage voltage detection portion B may detect a voltage Vdc of the dc stage corresponding to both ends of the smoothing capacitor C. To this end, the DC stage voltage detection portion B may include a resistance element, an amplifier, and the like. The detected dc stage voltage Vdc is a pulse-type discrete signal and may be inputted to the inverter controller 430.

The inverter 420 may have a plurality of inverter switching elements, and convert smoothed direct current power (Vdc) into three-phase alternating current power (va, vb, and vc) of a predetermined frequency by on/off operations of the switching element and output the three-phase alternating current power. In the inverter 420, each of upper arm switching elements Sa, Sb, and Sc and each of lower arm switching elements S'a, S'b, and S'c may become a pair and a total of three pairs of upper and lower arm switching elements may be connected in parallel with each other (Sa&S'a, Sb&S'b, and Sc&S'c).

A diode is connected to each switching element Sa, S'a, Sb, S'b, Sc, and S'c in an anti-parallel manner.

Each of the switching elements in the inverter 420 performs on/off operations based on an inverter switching control signal Sic from the inverter controller 430. As a result, the three-phase AC power having the predetermined frequency is output from the drive portion 32.

The inverter controller 430 may control a switching operation of the inverter 420. To this end, the inverter controller 430 may receive an output current io detected by an output current detector E.

The inverter controller 430 outputs the inverter switching control signal Sic to the inverter 420 to control the switching operation of the inverter 420. The inverter switching control signal Sic is a pulse width modulation (PWM)-scheme switching control signal and is generated and output based on the output current value io detected by the output current detector E.

The controller P may sense an internal state of the drum by sensing the output current value io detected by the current detector E. Additionally, the controller P may sense the internal state of the drum based on a location signal H sensed by the location sensor 235. For example, while the drum 40 rotates, the laundry amount, a dehydration rate, a moisture content, and the like may be sensed based on the output current value io of the drive portion 32. Additionally, the controller P may sense an amount of eccentricity of the drum 4, that is, unbalance (UB) of the drum 4. Such amount of eccentricity sensing may be performed based on a ripple component of the current io detected by the current detector E or an amount of change in the rotation speed of the drum 4.

Additionally, the controller P may sense the internal state of the drum by sensing an input current value is input to the inverter controller. A process and a calculation method for sensing the internal state of the drum via the current value will be described later.

The output current detector E may detect the output current io flowing between the inverter 420 and the three-phase drive portion 32. The output current detector E detects the current flowing through the drive portion 32. The output current detector E may detect all output currents ia, ib, and iα of respective phases, and may also detect output currents of two phases using three-phase balance.

The output current detector E may be located between the inverter 420 and the drive portion 32, and a current transformer (CT), a shunt resistor, and the like may be used to detect the current. When the shunt resistor is used, three shunt resistors may be located between the inverter 420 and the drive portion 32 or one end of each of the three shunt resistors may be connected to each of the three lower arm switching elements S'a, S'b, and S'c of the inverter 420.

In one example, two shunt resistors may be used using the three-phase balance. Additionally, when one shunt resistor is used, the corresponding shunt resistor may be disposed between the capacitor C described above and the inverter 420.

The detected output current io, as a discrete signal in a form of a pulse, may be applied to the inverter controller 430, and the inverter switching control signal Sic may be generated based on the detected output current io. Hereinafter, a description will be made that the detected output current io is three-phase output currents ia, ib, and ic.

In one example, the three-phase drive portion 32 is equipped with the stator and the rotor, and as each phase AC power of a predetermined frequency is applied to a coil of the stator of each phase (phase a, b, and c), the rotor rotates.

Such drive portion 32 may include a surface-mounted permanent-magnet (synchronous motor; SMPMSM), an interior permanent magnet synchronous motor (IPMSM), a synchronous reluctance motor (Synrm), and the like. Among these, the SMPMSM and the IPMSM are synchronous motors using permanent magnets (permanent magnet synchronous motors; PMSMs), while the Synrm has no permanent magnet.

In one example, when the converter 410 includes the switching element, the inverter controller 430 may control the switching operation of the switching element within the converter 410. To this end, the inverter controller 430 may receive the input current is detected by an input current detector A. Further, the inverter controller 430 may output a converter switching control signal Scc to the converter 410 to control the switching operation of the converter 410. Such converter switching control signal Scc, as a pulse width modulation (PWM)-scheme switching control signal, may be generated based on the input current is detected by the input current detector A and output.

In one example, the location sensor 235 may sense a location of the rotor of the drive portion 32. To this end, the location sensor 235 may include a Hall sensor. The sensed rotor location H is input to the inverter controller 430 and used as a basis for speed calculation or the like.

(c) in FIG. 12 shows an embodiment of a specific circuit structure in which the inverter controller 430 controls the drive portion 32. The inverter controller 430 may include an axis converter 510, a speed calculator 520, a current command generator 530, a voltage command generator 540, an axis converter 550, and a switching control signal outputter 560.

The axis converter 510 receives the three-phase output currents ia, ib, and ic detected by the output current detector E and converts the currents into two-phase currents ic and iβ in a stationary coordinate system. The axis converter 510 may convert the two-phase currents iα and iβ in the stationary coordinate system into two-phase currents id and iq in a rotating coordinate system.

The speed calculator 520 may calculate the speed based on the location signal H of the rotor input from the location sensor 235. In other words, the speed may be calculated by dividing the location signal by time. The speed calculator 520 may output the calculated location and the calculated speed based on the input location signal H of the rotor.

The current command generator 530 generates a current command value (i*q) based on the calculated speed ($\omega_r$) and a speed command value (ω*r). For example, the current command generator 530 may perform PI control in a PI controller 535 and generate the current command value (iq) based on a difference between the calculated speed ($\omega_r$) and the speed command value (ω*r). In the drawing, an q-axis current command value (i*q) is exemplified as the current command value, but unlike the drawing, a d-axis current command value (i*d) may also be generated together. In one example, a value of the d-axis current command value (i*d) may be set to 0.

Meanwhile, the current command generation portion 530 may further include a limiter (not illustrated) that limits the level of the current command value i*q so that it does not exceed an allowable range. Next, the voltage command generation portion 540 generates d-axis and q-axis voltage command values v*d and v*q based on the d-axis and q-axis currents id and iq axially transformed into a two-phase rotary coordinate system in the axial transform portion and the current command values i*d and i*q in the current command generation portion 530 and the like. For example, the voltage command generation portion 540 may perform PI control in the PI controller 544 based on the difference between the q-axis current iq and the q-axis current command value i*q, and may generate a q-axis voltage command value v*q. In addition, the voltage command generation portion 540 may perform PI control in the PI controller 548 based on the difference between the d-axis current id and the d-axis current command value i*d, and may generate a d-axis voltage command value v*d. Meanwhile, the value of the d-axis voltage command value v*d may be set to 0 so as to correspond to the case where the value of the d-axis current command value i*d is set to 0.

Meanwhile, the voltage command generation portion 540 may further include a limiter (not illustrated) that limits the level of the d-axis and q-axis voltage command values v*d and v*q) so that they do not exceed the allowable range.

Meanwhile, the generated d-axis and q-axis voltage command values v*d and v*q are inputted to the axial transform portion 550.

The axis converter 550 receives the location ($\theta_r$) calculated by the speed calculator 520 and the d-axis and q-axis voltage command values (v*d and v*q) and performs axis conversion. First, the axis converter 550 performs conversion from a two-phase rotating coordinate system to a two-phase stationary coordinate system. In this regard, the location ($\theta_r$) calculated by the speed calculator 520 may be used.

In addition, the axial transform portion 550 performs transform from the two-phase stationary coordinate system to the three-phase stationary coordinate system. Through such transform, the axial transform portion 1050 outputs three-phase output voltage command values v*a, v*b, and v*c.

The switching control signal output portion 560 generates and outputs a switching control signal Sic for an inverter according to Pulse Width Modulation (PWM) based on the three-phase output voltage command values v*a, v*b, and v*c.

The outputted inverter switching control signal Sic may be converted into a gate drive signal by a gate drive portion (not illustrated) and inputted to a gate of each switching element in the inverter 420. Accordingly, each of the switching elements Sa, S'a, Sb, S'b, Sc, and S'c in the inverter 420 performs a switching operation.

Meanwhile, the switching control signal output portion 560 may generate and output an inverter switching control signal Sic obtained by mixing two-phase pulse width modulation and three-phase pulse width modulation together according to an embodiment of the present disclosure.

For example, in an accelerated rotation interval described later, an inverter switching control signal Sic by three-phase pulse width modulation may be generated and outputted. In order to detect counter electromotive force in a constant speed rotation interval, an inverter switching control signal Sic by two-phase pulse width modulation may be generated and outputted.

Figure 14:
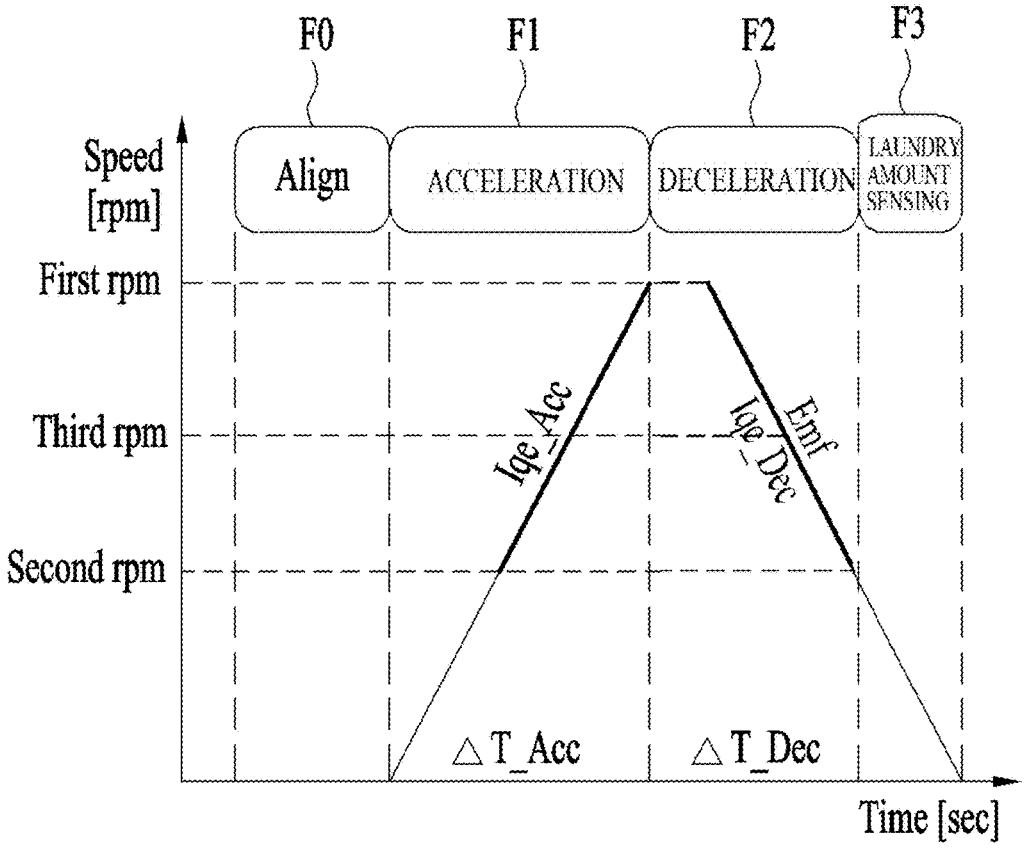
FIG. 14 shows an embodiment of using a current value when sensing a laundry amount in a laundry treating apparatus according to the present disclosure.

FIG. 14 shows an embodiment in which the controller P senses the laundry amount via acceleration and deceleration of the drum.

The laundry treating apparatus disclosure according to the present may perform a sensing step (F) of sensing the amount of the laundry inside the drum 3 before performing the washing cycle, before performing the rinsing cycle, and before performing the dehydration cycle.

To this end, the controller P may include an acceleration step (F1) of accelerating the drum 3, a deceleration step (F2) of decelerating the drum 3, and a laundry amount sensing step (F3) of sensing the amount of the laundry stored in the drum via an acceleration measured value of the drive portion 32 during the acceleration step and a deceleration measured value of the drive portion during the deceleration step.

The laundry treating apparatus according to the present disclosure senses the acceleration measured value measured from the drive portion 32 or applied to the drive portion 32 while accelerating the drive portion 32, and senses the deceleration measured value measured from the drive portion 32 or applied to the drive portion 32 while decelerating the drive portion 32. Thereafter, the acceleration measured value and the deceleration measured value are calculated to sense the amount of the laundry accommodated in the drum 3.

The acceleration measured value and the deceleration measured value may be command values applied to the drive portion 32 while operating the drive portion 32 or may be measured values measured from the drive portion 32 while operating the drive portion 32.

For example, the command value may be the current command value or the voltage command value derived from the PI controller 535 applied to operate the drive portion 32, and the measured value may be the current value or the voltage value itself of the drive portion 32 measured by the location sensor 235 or the current detector 225.

Accordingly, the laundry treating apparatus according to the present disclosure may greatly shorten the time required to sense the laundry amount by omitting a step of maintaining operating of the drive portion 32 at a constant speed.

In addition, the laundry treating apparatus according to the present disclosure may save not only the process of maintaining the drive portion 32 at the constant speed, but also energy and time required to maintain the constant speed. In addition, the laundry treating apparatus according to the present disclosure may completely ignore a frictional force of the drive portion 32 itself, which must be overcome when maintaining the drive portion 32 at the constant speed, in the calculation process.

When using the command value when sensing the laundry amount, the controller P does not need to feed back an actual situation to the drive portion 32 or consider an actual operating situation of the drive portion 32. Therefore, it may become simple and easy for the controller P to calculate the laundry amount value. Additionally, because a calculation formula for calculating the laundry amount becomes simplified, the laundry amount value may be obtained quickly.

Specifically, the acceleration measured value may include an acceleration current value (Iq_Acc) measured from the drive portion 32, and the deceleration measured value may include a deceleration current value (Iq_Dec) measured from the drive portion 32.

The acceleration current value may include a current command value (Iq*_Acc) for rotating the drive portion 32 during the acceleration step, and the deceleration current value may include a current command value (Iq*_Dec) for rotating the drive portion 32 during the deceleration step.

In one example, when the controller P uses the measured value when sensing the laundry amount, the actual situation is applied to the drive portion 32 as it is, so that the laundry amount value may be accurately obtained.

Further, the command value is generated only when the drive portion 32 is operating or receives power and is actively controlled. Therefore, when using the measured value, data for sensing the laundry amount may be obtained even when the power to the drive portion 32 is cut off or the drive portion 32 is not actively controlled.

The laundry treating apparatus according to the present disclosure may decelerate the drive portion 32 by cutting off the power in the deceleration step (F2) and using a power generation braking scheme or the like. Therefore, an algorithm for controlling the deceleration step (F2) may be omitted and energy for the deceleration step (F2) may be saved.

Furthermore, because the power is cut off in the deceleration step (F2), the voltage command value may be O. Therefore, in the present disclosure, the laundry amount may be sensed by calculating only the current excluding the voltage.

In other words, the control method of the laundry treating apparatus according to the present disclosure may ignore or not use the voltage command value or the voltage value itself and only use the current value, so that the calculation formula for the laundry amount sensing may be very simple. Because the calculation formula is simplified, the calculation may be done quickly and accurately, allowing the laundry amount to be sensed accurately.

Specifically, data and algorithms (hereinafter, referred to as calculation formulas) for calculating the acceleration measured value and the deceleration measured value may be stored in the controller P. The above calculation formulas may be prepared so as not to use the voltage value from the beginning. Accordingly, because there is no need to calculate the counter electromotive force, the constant speed rotation step of the drive portion 32 may be omitted in the present disclosure.

For example, the calculation formula of the present disclosure may be provided as follows.

The laundry amount value (inertia, Jm, Load_data) of the present disclosure $$= \frac{3}{2}\frac{P}{2}K_e\frac{i_q^{Acc} - i_q^{Dec}}{\Delta\omega_m^{Acc}/\Delta t_{Acc} - \Delta\omega_m^{Dec}/\Delta t_{Dec}}$$

may be calculated in a following formula. The P and the Ke, as constant values of the drive portion 32 itself, may be measured by the controller P, and a denominator may correspond to a difference between a speed change amount in the acceleration step and a speed change amount in the deceleration step.

The speed variation may be measured by the controller P owing to the position detection portion 235, calculated by measuring a time reached until the acceleration or deceleration, or immediately detected by measuring a current or the like.

Therefore, in the present disclosure, a laundry amount may be immediately calculated only by measuring an acceleration output current value Iq_Acc at the acceleration and an acceleration output current value Iq_Dec at the deceleration. In other words, the acceleration current value may be regarded as including an acceleration output current value Iq_Acc outputted from the drive portion during the acceleration step, and the deceleration current value may be regarded as including a deceleration output current value Iq_Dec outputted from the drive portion during the deceleration step.

Furthermore, an average value Iqe_Acc of the current value measured by the drive portion during the acceleration step may be applied to the acceleration output current value, and an average value Iqe_Dec of the current value measured by the drive portion during the deceleration step may be applied to the deceleration output current value.

In any case, the laundry amount may be calculated with only one factor of a current value, and a factor of a voltage value may be omitted, thereby simplifying a laundry amount calculation and improving the promptness and accuracy of the capacity value.

Therefore, even if the time of the acceleration step is very short or the time of the acceleration step is very short, the laundry amount can be accurately detected, whereby the time taken for laundry amount detection may be further reduced.

In one example, during the laundry amount sensing of the laundry treating apparatus according to the present disclosure, the laundry amount is measured by performing the acceleration and then immediately performing the deceleration. Therefore, the time itself it takes to measure the laundry amount is very short, and the laundry inside the drum 3 is not able to move during such time. Therefore, because the laundry amount may be sensed in a short period of time while the state of the laundry does not change, the accuracy of calculating the laundry amount may be further increased.

In one example, the calculation formula applied to the laundry amount sensing of the present disclosure uses a difference between the current value in the acceleration step and the current value in the deceleration step. Therefore, a frictional force of the drive portion in the acceleration step and a frictional force of the drive portion in the deceleration step are equal to each other, so that current compensation formulas considering the frictional force cancel each other. Therefore, the laundry amount sensing control method of the laundry treating apparatus according to the present disclosure does not need to consider the frictional force of the drive portion 32, so that a process of correcting or tuning the frictional force may be omitted. In addition, because the laundry amount sensing of the present disclosure does not use the voltage value, a process of compensating for or tuning a voltage value error may be omitted, and because the constant speed process is omitted, the movement of the laundry and a process of compensating for or tuning the frictional force of the drive portion 32 may be omitted. As a result, according to the laundry amount sensing control method of the laundry treating apparatus according to the present disclosure, the laundry amount may be very quickly and accurately sensed because the laundry amount is derived immediately after inputting the current value and there is no procedure to compensate for or tune the laundry amount.

Therefore, the amount of load required for the controller P may be reduced, the controller P may be replaced with a relatively simple configuration, or the performance of the controller P may be utilized in other directions.

Meanwhile, as can be seen in the above calculation equation, the acceleration measured value may further include a speed variation of the acceleration step F1, and the deceleration measured value may further include a speed variation of the deceleration step F2.

The speed variation of the acceleration step F1 and the speed variation of the deceleration step F2 are only required to obtain a difference between the inertia of the acceleration step F1 and the inertia of the deceleration step F2, and may not require a separate voltage value measurement and the like, and furthermore, no compensation or tuning process is required.

In more detail, the calculation equation is derived by the following calculation equations.

$$cceleration\ \text{inertia} = \frac{T_e^{Acc}}{D_m^{Acc} - D_m^{Dec}} \quad \text{deceleration inertia} = \frac{T_e^{Dec}}{D_m^{Acc} - D_m^{Dec}}$$

$$D_{m=} \frac{d\omega_t}{dt} = \frac{\Delta\omega_t}{\Delta t}$$

In this regard, because the laundry amount is calculated via a difference between an acceleration inertia and a deceleration inertia, the amount of change in the speed is necessary.

Therefore, when the acceleration measured value and the deceleration measured value are measured in the same RPM section of the drum, because a range of the speed change is the same, the calculation may become further simpler. That is, it is preferable that the acceleration step (F1) and the deceleration step (F2) share the same speed band.

In one example, the control method of the laundry treating apparatus according to the present disclosure may perform the acceleration step (F1) and the deceleration step (F2) and use the current command value or the current value measured in the drive portion 32 to sense the laundry amount.

In this regard, because the calculation formula uses the current value, the deceleration step (F2) may be performed first and then the acceleration step (Bb) may be performed to measure the current value, thereby sensing the laundry amount via the same calculation formula.

In one example, the sensing step (F3) may perform a preparation step (F0) of checking the location of the drive portion 32 to set a reference value for performing the acceleration step (F1) and the deceleration step (F2). In the preparation step (F0), the drum 4 may be in a stop state.

The acceleration step (F1) may additionally accelerate the drum stopped in the preparation step (F0) to a first rpm, and the deceleration step (F2) may decelerate the drum from the first rpm. That is, the acceleration step (F1) and the deceleration step (F2) may be performed continuously. In the deceleration step (F2), the current command value toward the drive portion 32 is lowered or the voltage applied to the drive portion 32 is cut off in the acceleration step (F1), so that there is no risk of damage to the controller P or the circuit.

In this case, the acceleration measured value and the deceleration measured value may be measured between the first rpm and a second rpm lower than the first rpm. That is, a current value may be measured in an interval band including a vertex in the speed graph to detect a laundry amount. This has an advantage in that a situation in which an error may occur may be minimized since a current value is measured in a continuous situation to detect the laundry amount.

Meanwhile, the acceleration measured value and the deceleration measured value may be measured between the second rpm lower than the first rpm and a third rpm higher than the second rpm and lower than the first rpm. That is, although it is not the interval including the vertex, a current value may be measured in the same speed interval band to detect a laundry amount. This has an advantage of improving the accuracy of the laundry amount calculation by measuring a stabilized current value as the speed change is the largest at the vertex.

Meanwhile, the first rpm may be set to a lower rpm than a fixed rpm at which clothes received in the drum 4 is attached to the inner wall of the drum 4. That is, the first rpm may be relatively lower than the rpm applied in a washing, rinsing, or dewatering cycle.

In this case, a process in which the controller P directly calculates the moment of inertia or a process of comparing the moment of inertia with laundry amount data stored in the storage P2 and extracting the moment of inertia may be omitted.

An amount of current applied in the acceleration step (F1) may be defined as a first current amount and an amount of current applied in the deceleration step (F2) may be defined as a second current amount. The controller P may sense the laundry amount via the first current amount and the second current amount.

Figure 15A:
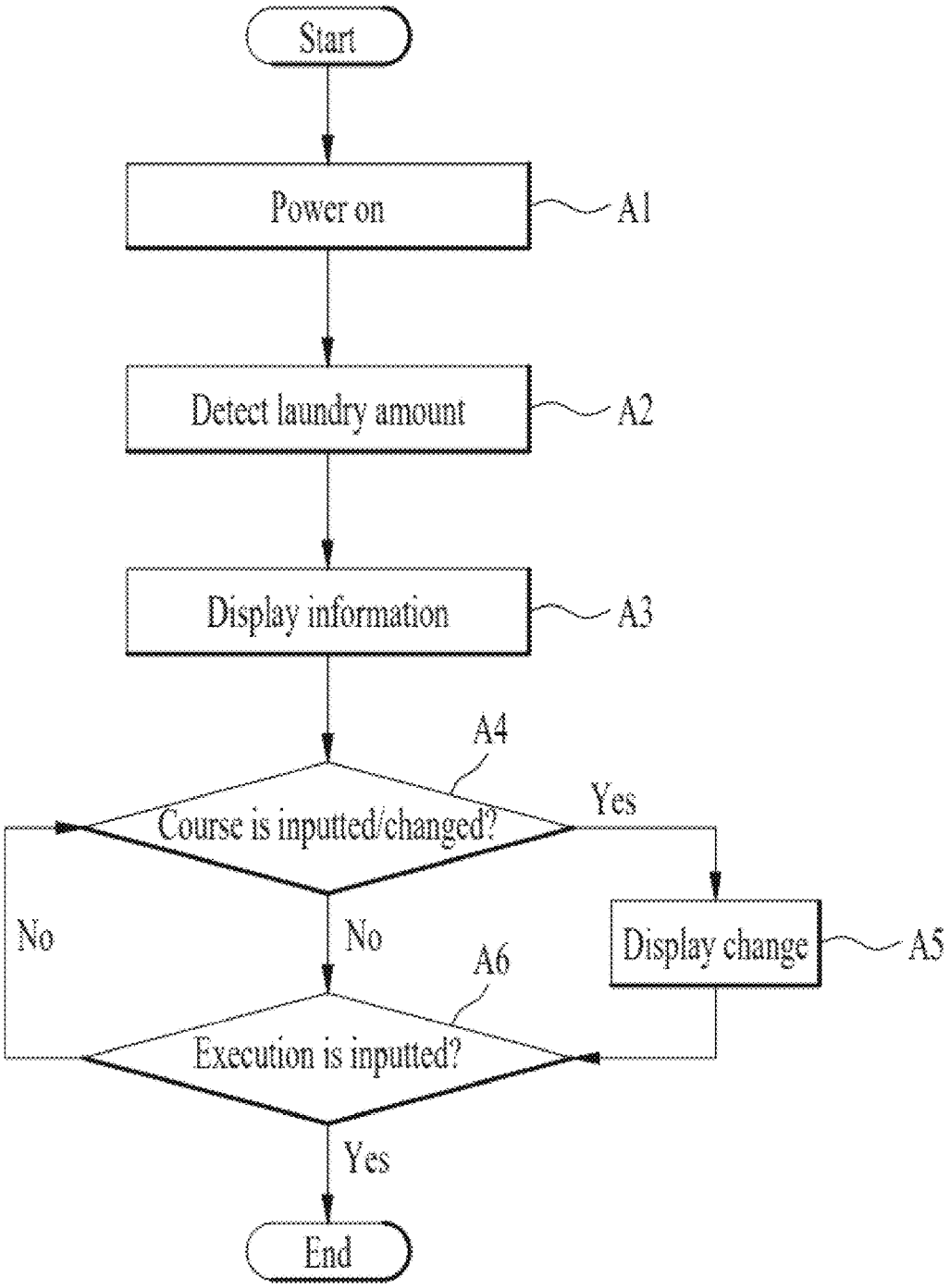
FIGS. 15A and 15B show a control method of laundry amount sensing of a laundry treating apparatus according to the present disclosure.
Figure 15B:
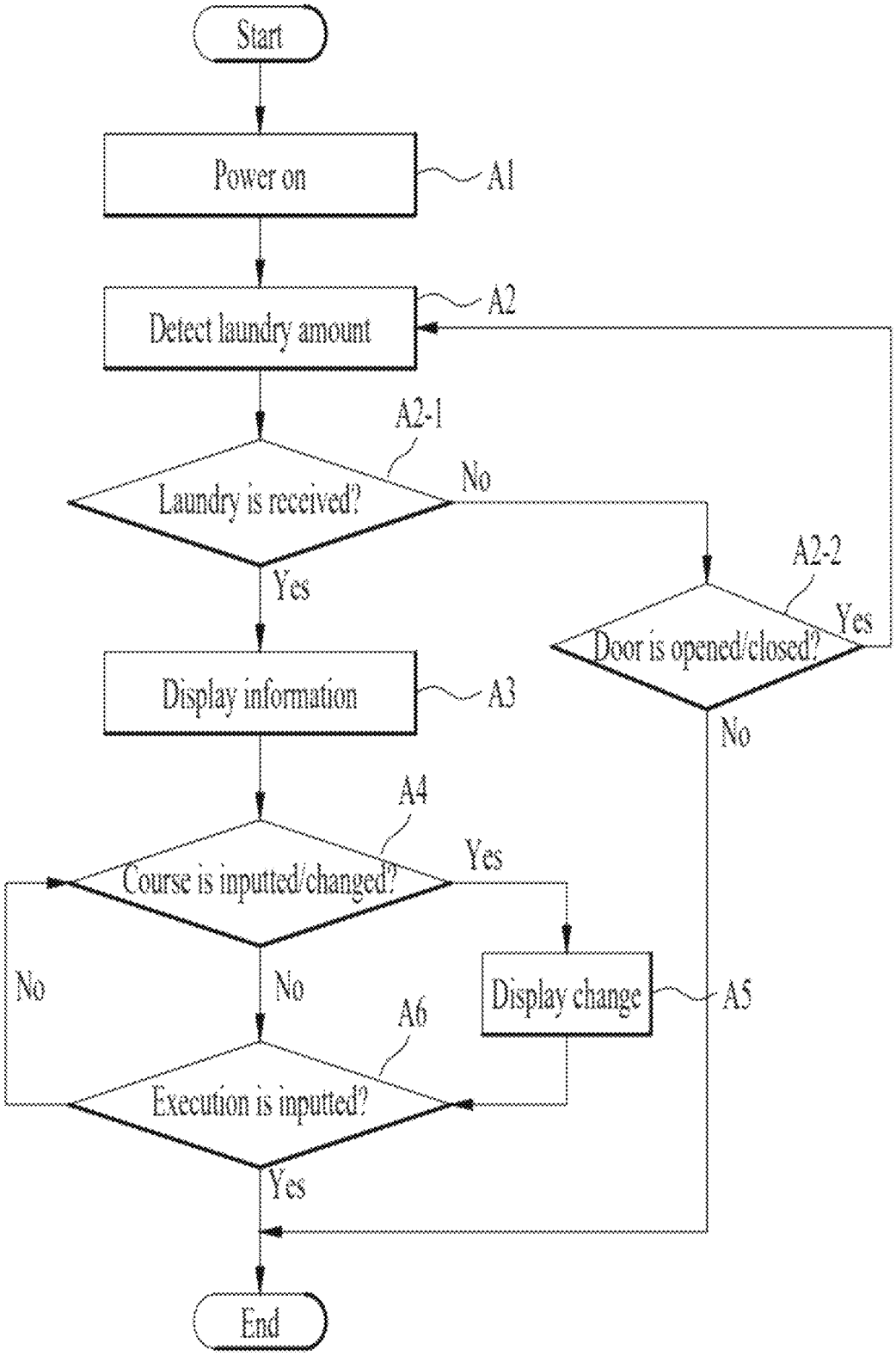

FIGS. 15A and 15B show an embodiment in which a laundry treating apparatus according to the present disclosure utilizes a laundry amount sensing scheme based on the structure and the method described above.

FIG. 15A shows an embodiment that basically utilizes the laundry amount sensing scheme described above.

When the power portion P46 of the laundry treating apparatus according to the present disclosure is pressed, the power may be supplied to the water supply portion 23, the drive portion 32, the drainage portion 25, and the like, and the power may also be supplied to the controller P.

The controller P may be set to sense the amount of the laundry when the power portion P46 is pressed and the power is supplied.

In other words, in the laundry treating apparatus according to the present disclosure, a necessary condition for sensing the amount of the laundry may be the pressing of the power portion P46.

Therefore, even when the user opens the door 132, then puts the laundry into the drum 3, and closes the door 132 before pressing the power portion P46, the controller P may immediately sense the amount of the laundry.

The controller P may calculate an expected time to perform a specific course or option based on the amount of the laundry.

To this end, the controller P may recognize the expected time corresponding to the amount of the laundry.

Additionally, the controller P may also organize an amount of detergent required when performing an arbitrary course or option for the amount of laundry into data. The controller P may calculate the amount of detergent required when washing the laundry using the course or option.

For example, the laundry treating apparatus according to the present disclosure may perform a power supply step (A1) of supplying the power by pressing the power portion P46 of the laundry treating apparatus, and a laundry amount sensing step (A2) of sensing the amount of the laundry accommodated in the drum 3 when the power supply step (A1) is performed.

In other words, the laundry treating apparatus according to the present disclosure does not sense the laundry amount only when the execution portion P47 is pressed, but is able to sense the laundry amount before the execution portion P47 is pressed.

When the amount of the laundry is sensed in the laundry amount sensing step (A2), an information display step (A3) of displaying at least one of the amount of the laundry, an expected execution time of the course or the option for washing the laundry, and the amount of detergent required for the course or the option on the display portion P8 may be performed.

In the information display step (A3), an execution time corresponding to a preset standard course or standard option corresponding to the amount of the laundry may be displayed.

The user may check the laundry amount and the execution time of the preset course or option displayed in the information display step (A3) and compare them with a schedule thereof, and check the amount of detergent.

In other words, the laundry treating apparatus according to the present disclosure may check information related to the laundry amount before the execution portion P47 is pressed, select desired course and option, and press the execution portion P47. That is, when the user is satisfied with the information displayed in the information display step (A3), the user may press the execution portion P47. The controller P may perform an execution input step (A6) of sensing that the execution portion P47 is pressed.

When the execution input step (A6) is performed, the controller P may control the locker to lock the door 132 to the cabinet 10 to prevent the door 132 from being opened arbitrarily.

When the execution input step (A6) is performed, the controller P may perform at least one of the washing cycle, the rinsing cycle, and the dehydration cycle based on course or option settings.

However, after the user checks at least one of the laundry amount, the execution time of the preset course or option, and the detergent amount in the information display step (A3), a course setting step (A4) of selecting the course and the option via the manipulation portion P7 and the selection portion P2 may be further performed.

In other words, the user may select the arbitrary course or option, rather than the standard course that is performed by default.

For example, the user may check the amount of the laundry via the course setting step (A4) and then press one or more of the manipulation portion P7 and the setting portion P2, or may check the execution time associated with the laundry amount and then press one or more of the manipulation portion P7 and the setting portion P2 to change the course or the option.

When the course setting step (A4) is performed, the controller P may perform a change display step (A5) of recalculating an expected execution time of the changed course or option corresponding to the amount of the laundry or the detergent amount and transmitting the recalculated expected execution time or detergent amount to the display portion P8.

In the change display step (A5), the display portion P8 may display one or more of the expected execution time of the changed course or option and the changed detergent amount.

When determining that the expected execution time or the detergent amount is suitable, the user may press the execution portion P47, and when the expected execution time or the detergent amount is not suitable, the user may re-press one or more of the manipulation portion P7 and the setting portion P2.

The controller P may perform the execution input step (A6) of sensing the pressing of the execution portion P47.

However, when the re-pressing of one or more of the manipulation portion P7 and the setting portion P2 is sensed, the course setting step (A4) and the change display step (A5) may be performed again.

As a result, the laundry treating apparatus according to the present disclosure may complete the laundry amount sensing before the user selects and performs final course and option. Moreover, by calculating the laundry amount within 3 seconds by rotating the drum less than once, the information on the laundry amount may already be provided before pressing one or more of the manipulation portion P7 and the setting portion P2.

For example, at a time point at which the power portion P46 is pressed and the display portion P8 boots, the laundry amount sensing has already been completed and the information corresponding to the laundry amount is able to be provided to the user.

Accordingly, the user may check an expected time or the like of a course and an option the most suitable at a current time point while checking the information on the laundry amount, thereby setting optimal course and option or inputting the detergent of an optimal amount.

FIG. 15B shows an expanded embodiment of the control method in FIG. 15A.

The laundry treating apparatus according to the present disclosure may perform the power input step (A1) of supplying the power to at least one of the controller P, the drive portion 32, the water supply portion 23, the drainage portion 25, and the control panel 16 when a command from the power portion P46 is input.

When the power input step (A1) is performed, the laundry treating apparatus may perform the laundry amount sensing step (A2) of sensing the amount of the laundry.

A scheme of sensing the laundry amount in the laundry amount sensing step (A2) is the scheme of rotating the drum less than once as described above.

In this regard, the controller P may also perform a laundry sensing step (A2-1) of sensing whether the laundry is accommodated in the drum 3. When there is the laundry in the drum 3 in the laundry sensing step (A2-1), the control method in FIG. 15A may be performed.

However, when the laundry is not accommodated in the drum 3, the controller P may perform a door opening/closing sensing step (A2-2) of waiting until the door 132 opens and closes.

That is, when not sensing the amount of the laundry, the controller P may wait until the opening and closing of the door is sensed.

In this regard, when the door opening/closing sensing step (A2-2) is performed, the controller P may additionally sense the amount of the laundry by performing the laundry amount sensing step (A2) again.

Accordingly, the laundry treating apparatus according to the present disclosure may immediately sense the laundry amount when the laundry is accommodated in the drum 3 before the power portion P46 is pressed. However, when the laundry is not accommodated in the drum 3 before the power portion P46 is pressed, the controller P may wait for a time when the laundry is put into the drum 3 and sense the amount of the laundry.

In other words, the laundry treating apparatus according to the present disclosure may, in principle, immediately perform the laundry amount sensing when the power portion P46 is pressed and the power is supplied to the controller P.

Therefore, when the user first puts the laundry into the drum 3 before pressing the power portion P46 and then presses the power portion P46, the controller P may perform the laundry amount sensing.

However, when there is no laundry inside the drum 3 before the power portion P46 is pressed, the controller P may wait for the door to open and close and perform the laundry amount sensing. In one example, whether there is the laundry or not may be sensed using the laundry amount sensing scheme. In this regard, when there is no sensed laundry amount, the laundry amount may not be displayed on the display portion P8.

In one example, when the opening and closing of the door 132 is sensed after the power portion P46 is pressed, the controller P may determine that the laundry is input and perform the laundry amount sensing. In one example, when there is no sensed laundry amount, the laundry amount may not be displayed on the display portion P8 or information indicating that the laundry is not inside may be displayed.

When there is the sensed laundry amount, the laundry treating apparatus disclosure according to the present may display at least one of laundry weight information, the execution time of the course and the option corresponding to the laundry amount, and the required amount of detergent on the display portion P8.

As a result, the laundry treating apparatus according to the present disclosure may sense the amount of the laundry before the execution portion P47 is pressed and deliver the information such as the execution time of the course or the option and the required amount of detergent to the user.

Figure 16A:
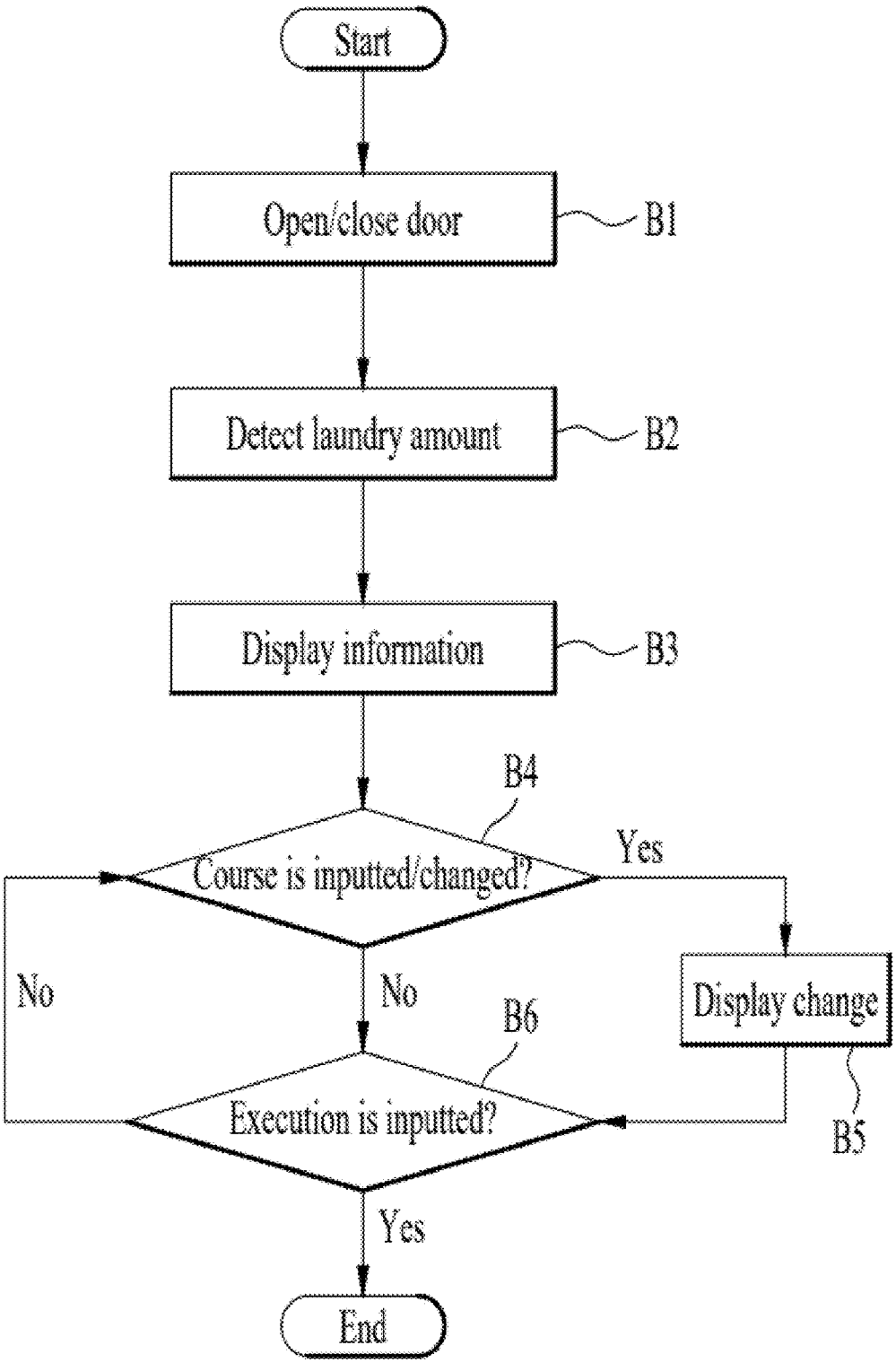
FIGS. 16A and 16C shows another embodiment of a control method of laundry amount sensing of a laundry treating apparatus according to the present disclosure.
Figure 16B:
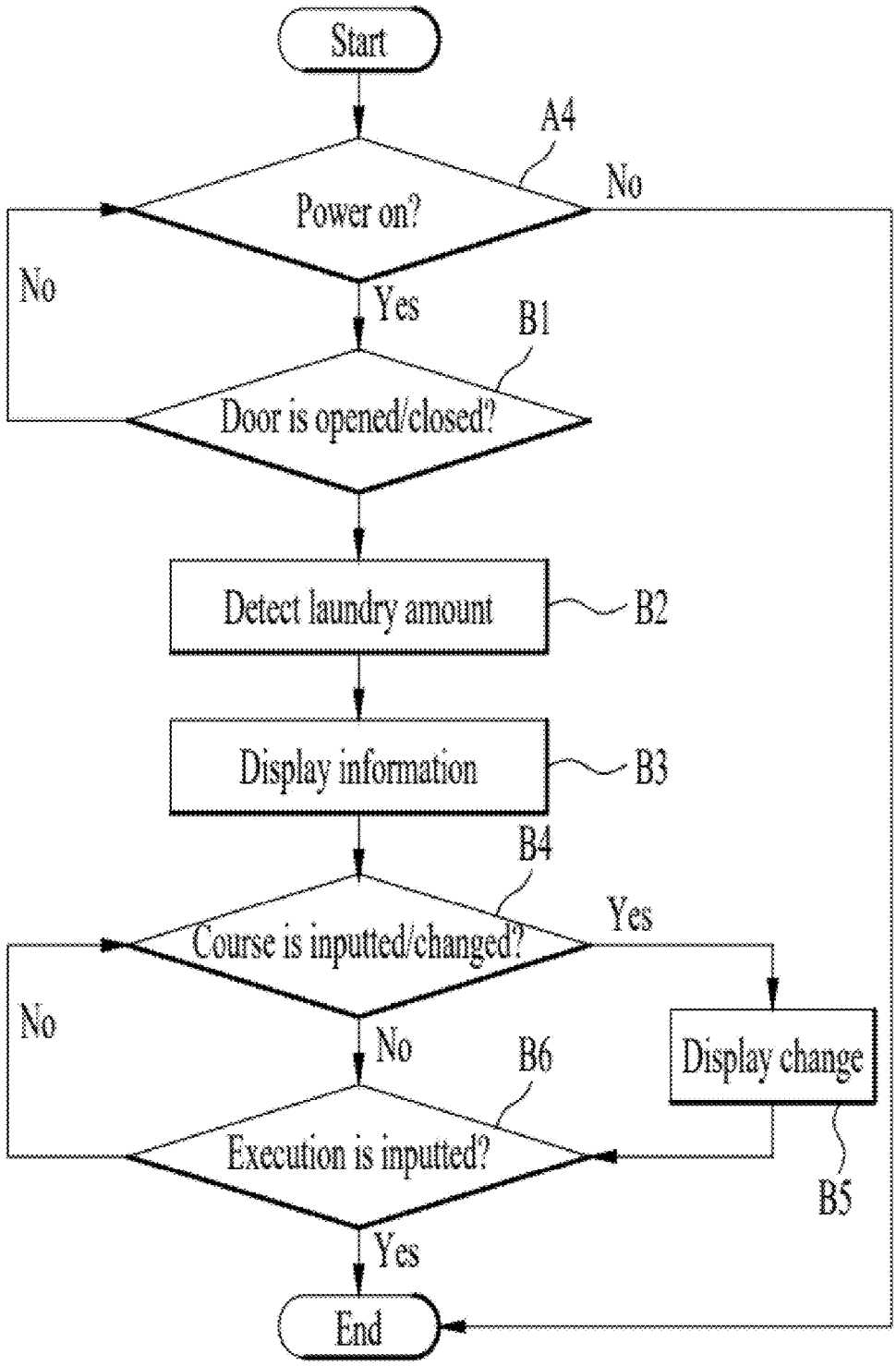
Figure 16C:
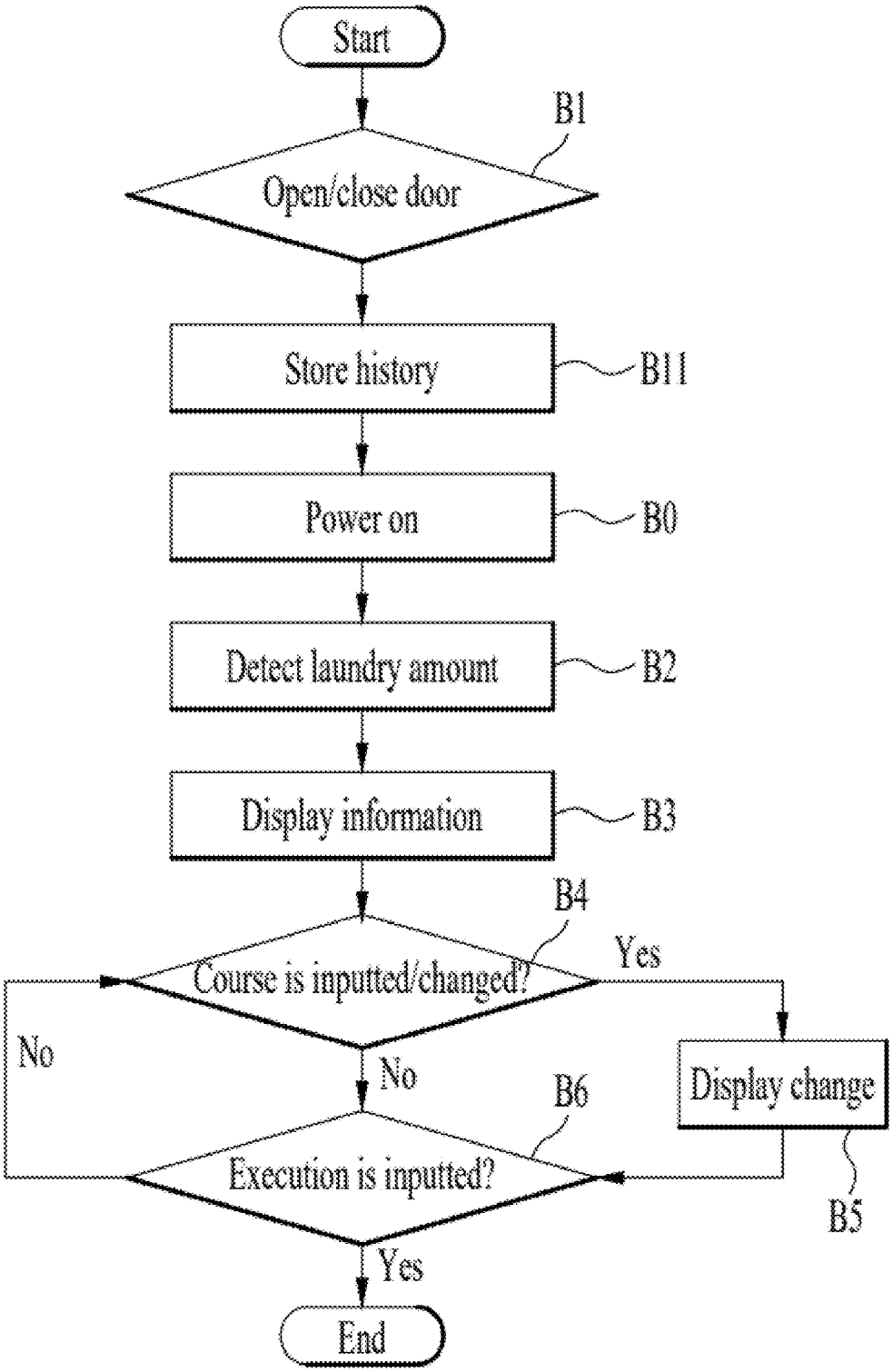

FIGS. 16A to 16C shows an embodiment of performing laundry amount sensing depending on whether a door is opened or closed.

Referring to FIG. 16A, the controller P may sense the amount of the laundry when sensing the opening and closing of the door 132. That is, a condition for sensing the amount of the laundry may be the opening and closing of the door 132.

The fact that the door 132 is opened or closed may mean that there is a high probability that the laundry is put into the drum 3. Additionally, the fact that the door 132 is opened or closed may mean that the amount of laundry in the drum 3 is increased or decreased.

Accordingly, when sensing that the door 132 is opened and closed, the laundry treating apparatus according to the present disclosure may immediately sense the amount of the laundry and provide the user with the laundry amount itself, the expected execution time or the changed execution time of the course or the option, and the required amount of detergent or the changed amount of detergent.

The laundry treating apparatus according to the present disclosure may perform an opening and closing step (B1) of sensing the opening and closing of the door 132. When the opening and closing of the door 132 is sensed in the opening and closing step (B1), the controller P may perform a laundry amount sensing step (B2) of sensing the amount of the laundry, and may perform an information display step (B3) of displaying one of more of the laundry amount, the execution time of the preset course or option, and the required amount of detergent based on the sensed laundry amount.

In other words, even before the manipulation portion P7 and the execution portion P47 are pressed, the laundry treating apparatus according to the present disclosure may sense the amount of the laundry within 3 seconds in the above-described manner and display the laundry amount when the opening and closing of the door 132 is sensed.

After the information display step (B3), the controller P may perform an execution input step (B6) by sensing whether the user presses the execution portion P47, and may perform a course setting step (B4) and a change display step (B5) by sensing whether the user changes the course or the option.

The information display step (B3), the course setting step (B4), the change display step (B5), and the execution input step (B6) may be the same as those in the above-described embodiment.

FIG. 16B shows an expanded embodiment of FIG. 16A.

The laundry treating apparatus according to the present disclosure may further perform a power input step (B0) of sensing whether the power is input before the opening and closing step (B1).

This is because only when the power input step (B0) is performed, the power is supplied to the controller P and the controller P is able to sense whether the door 132 is opened or closed.

Accordingly, after the power input step (B0) is performed, the controller P may perform the laundry amount sensing step (B2) upon sensing that the door 132 is opened and closed.

When the opening and closing of the door 132 is sensed in the opening and closing step (B1), the controller P may perform the laundry amount sensing step (B2) of sensing the amount of the laundry, and may perform the information display step (B3) of displaying one or more of the amount of laundry, the execution time of the preset course or option, and the required amount of detergent depending on the sensed laundry amount.

After the information display step (B3), the controller P may perform the execution input step (B6) by sensing whether the user presses the execution portion P47, and may perform the course setting step (B4) and the change display step (B5) by sensing whether the user changes the course or the option.

The information display step (B3), the course setting step (B4), the change display step (B5), and the execution input step (B6) may be the same as those in the above-described embodiment.

Accordingly, when sensing that the door 132 is opened or closed in the state in which the power is supplied to the laundry treating apparatus, the laundry treating apparatus disclosure according to the present may immediately sense the amount of the laundry and provide the user with the laundry amount itself, the expected execution time or the changed execution time of the course or the option, and the required amount of detergent or the changed amount of detergent.

FIG. 16C shows another expanded embodiment of FIG. 16A.

The laundry treating apparatus according to the present disclosure may be constructed such that a history of the opening and closing of the door 132 is stored in the storage (P2). That is, even when the power portion P46 is not pressed, the power may be supplied to the control panel P via standby power and the history of the opening and closing of the door 132 may be stored.

Therefore, the laundry treating apparatus according to the present disclosure may perform a history storage step (B11) of storing the opening and closing history of the door 132 in the controller P when the door 132 is opened and closed even before the power portion P46 is pressed.

Thereafter, the laundry treating apparatus according to the present disclosure may perform the laundry amount sensing step (B2) when the power input step (B0) of supplying the power to the controller P or the like is performed as the power portion P46 is pressed.

When the opening and closing of the door 132 is sensed in the opening and closing step (B1), the controller P may perform the laundry amount sensing step (B2) of sensing the amount of the laundry, and may perform the information display step (B3) of displaying one or more of the laundry amount, the execution time of the preset course or option, and the required amount of detergent depending on the sensed laundry amount.

After the information display step (B3), the controller P may perform the execution input step (B6) by sensing whether the user presses the execution portion P47, and may perform the course setting step (B4) and the change display step (B5) by sensing whether the user changes the course or the option.

The information display step (B3), the course setting step (B4), the change display step (B5), and the execution input step (B6) may be the same as those in the above-described embodiment.

Accordingly, even when the user opens the door 132 and puts the laundry into the drum 3 in advance before the power portion P46 is pressed, when the power portion P46 is pressed, the laundry treating apparatus disclosure according to the present disclosure may check whether the door 132 is opened or closed to sense the amount of the laundry.

Therefore, the laundry treating apparatus according to the present disclosure may help the user select optimal course and option or detergent amount before pressing the execution portion P47.

As a result, the controller P may be set to sense the amount of the laundry when the sensor S senses that the power portion P47 is pressed or the door closes the opening.

The controller P may sense the laundry amount only when both the pressing of the power portion P47 and the opening and closing of the door 132 are sensed, or may sense the laundry amount when one of the pressing of the power portion P47 and the opening and closing of the door 132 is performed.

In one example, in the laundry treating apparatus according to the present disclosure, only when the execution portion P47 is pressed and the course and the option are started, the locker L may fix the door 132 to the cabinet 1. Accordingly, when the laundry amount sensing is performed before the execution portion P47 is pressed, the door 132 may be in a state of not being locked by the locker L.

Accordingly, the user may additionally input the laundry or withdraw the laundry by opening the door 132 while performing the laundry amount sensing or even after the laundry amount sensing is completed.

When the opening and closing of the door 132 is additionally sensed, the laundry treating apparatus according to the present disclosure may sense whether the laundry amount of the laundry is changed by re-performing the laundry amount sensing, and display information related to the changed laundry amount on the display portion P8.

In other words, sensing the laundry amount by sensing the opening and closing of the door described above may include primarily sensing the laundry amount and then re-sensing the laundry amount when additionally sensing the opening and closing of the door.

Figure 17:
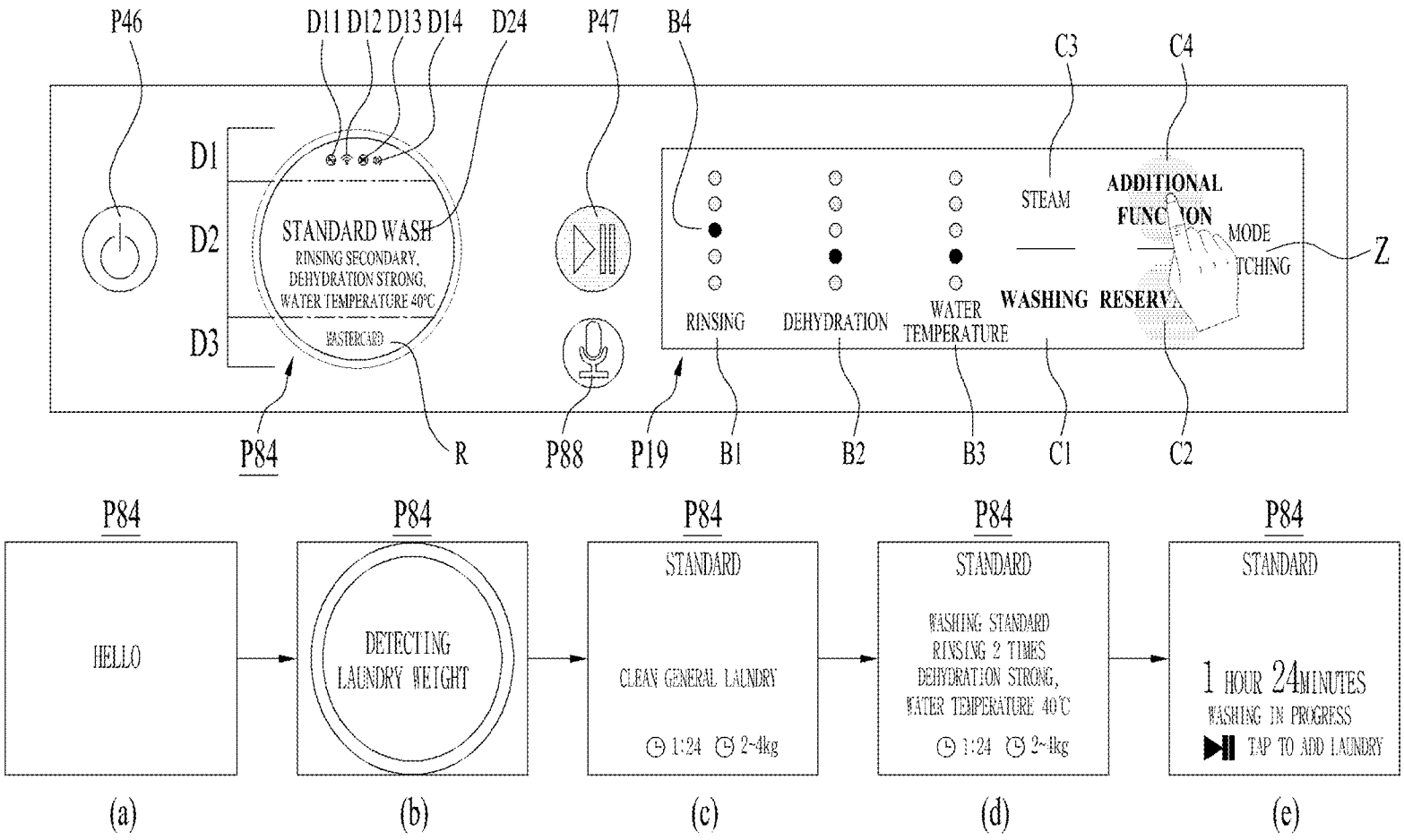
FIG. 17 shows a state of a display portion P8 when sensing a laundry amount.

FIG. 17 shows a state of the display portion P8 when sensing the laundry amount.

Referring to (a) in FIG. 17, when the power portion P46 is pressed, the display portion P8 may display a content indicating that the controller P is booting at the same time when the power is supplied to the display portion P8.

For example, the laundry treating apparatus may display information of responding to the user's pressing of the power portion P46, such as "Hello".

Referring to (b) in FIG. 17, the laundry treating apparatus according to the present disclosure may immediately sense the laundry amount when the power portion P46 is pressed and the power is supplied to the controller P. That is, the controller P may sense the laundry amount while rotating the drum less than once. The display portion P8 may externally display that the controller P is in the state of sensing the laundry amount. For example, information indicating that the laundry amount is being sensed, such as "sensing laundry weight", may be displayed. Accordingly, the user may recognize that the laundry treating apparatus automatically senses the laundry amount before manipulating the control panel P.

Referring to (c) in FIG. 17, when completing the laundry amount sensing within 3 seconds, the controller P may externally display information related to the laundry amount. The information related to the laundry amount may include the laundry weight information and the expected execution time for the selected course.

In one example, when there is no course selected by the user with the manipulation portion P7 or the like, the execution time for the standard course may be automatically displayed.

For example, the display portion P8 may display a weight range of the laundry, such as 2~4 KG, and 1 hour and 24 minutes, which is a course execution time corresponding to the weight.

Referring to (d) in FIG. 17, the user may press the selection portion P2 to input additional options. The controller P may calculate up to an execution time of the option corresponding to the laundry amount, and change the expected execution time displayed on the display portion P8 to the execution time corresponding to the option.

For example, when the user changes a dehydration intensity to 'strong' and adds an option to set a water temperature to '40 degrees' and rinsing to 'twice', the expected execution time displayed on the display portion P8 may be changed from 1 hour and 24 minutes to 1 hour and 40 minutes.

As a result, because the laundry amount was already sensed before the execution portion P47 is pressed, the laundry treating apparatus according to the present disclosure may display the execution time corresponding to the laundry amount in the preset standard course or the course and the option input by the user to the control panel P via the manipulation portion P7 and the setting portion P2.

Accordingly, the user may check the expected execution time and select the optimal course and option suitable for the current state.

In addition, by adding only a suitable amount of detergent before the execution portion P47 is pressed based on the laundry weight information or the like displayed on the display portion P8, waste of the detergent or insufficient injection of the detergent may be prevented.

Referring to (e) in FIG. 17, when the user presses the execution portion P47, the display portion P8 may display state information indicating that the controller P or the laundry treating apparatus is performing the course and the option.

That is, the controller P is to sense the laundry amount before the manipulation portion or the execution portion is pressed. The display portion P8 is controlled to display one or more of the weight, the detergent amount, and the execution time of the course corresponding to the sensed laundry amount. Likewise, one or more of the weight, the detergent amount, and the execution time of the course corresponding to the sensed laundry amount may be displayed before the execution portion is pressed.

Figure 18:
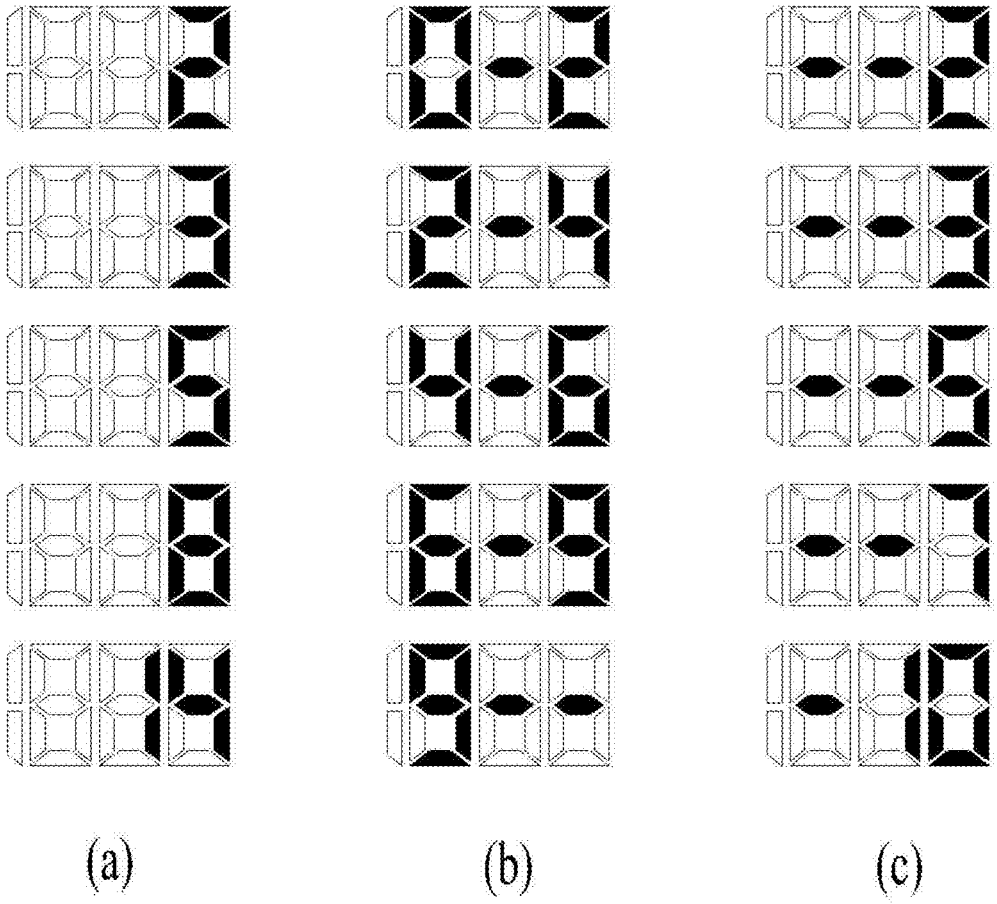
FIG. 18 shows a method for displaying, by a laundry treating apparatus, an amount of laundry.

FIG. 18 shows a method of displaying, by a laundry treating apparatus, an amount of laundry.

The laundry treating apparatus according to the present disclosure may display the information related to the sensed laundry amount on the display P84 or the auxiliary display P19.

When the display P84 and the auxiliary display P19 may be collectively referred to as the display portion P8, the information related to the sensed laundry amount may be displayed on the display portion P8.

Referring to (a) in FIG. 18, the display portion P8 may display the weight for the sensed laundry amount.

For example, when the sensed laundry amount is one of 2 kg, 3 kg, 5 kg, 8 kg, or 14 kg, the sensed weight itself such as one of 2 kg, 3 kg, 5 kg, 8 kg, and 14 kg may be externally displayed.

As a result, the user may accurately recognize the weight of the laundry and prepare the required amount of detergent or the like or select a suitable course.

Referring to (b) in FIG. 18, the display portion P8 may display the weight range for the sensed laundry amount.

The weight range may be an approximate range of the sensed weight. The approximate range may correspond to a critical range that changes one or more of the detergent amount corresponding to the weight and the execution time of the course corresponding to the weight.

For example, in a weight range from 0 to 2 kg, an amount of detergent injected and an execution time of the course may be constant, and in a weight range from 2 to 4 kg, an amount of detergent injected and an execution time of the course may be greater than those in the weight range from 0 to 2 kg, but may be constant.

In addition, in a weight range from 4 to 6 kg, an amount of detergent injected and an execution time of the course may be greater than those in the weight range from 2 to 4 kg, but may be constant.

In addition, in a weight range from 6 to 9 kg, an amount of detergent injected and an execution time of the course may be greater than those in the weight range from 4 to 6 kg, but may be constant.

In addition, in a weight range equal to or greater than 9 kg, an amount of detergent injected and an execution time of the course may be greater than those in the weight range from 6 to 9 kg, but the amount of detergent injected as a maximum amount and the execution time of the course may be constant.

Accordingly, when the sensed laundry amount is 2 kg, the range from 0 to 2 kg may be displayed, when the sensed laundry amount is 3 kg, the range from 2 to 4 kg may be displayed, when the sensed laundry amount is 5 kg, the range from 4 to 6 kg may be displayed, when the sensed laundry amount is 8 kg, the range from 6 and 9 kg may be displayed, and when the sensed laundry amount is 14 kg, the range equal to or greater than 9 kg may be displayed.

As a result, by displaying the weight range of the laundry, the laundry treating apparatus may consider an occurrence of an error in the weight of the laundry.

Additionally, the weight range may be a weight range corresponding to the amount of detergent injected.

When a company that produces and supplies the detergent determines a section of the detergent amount to be injected based on the weight range, the weight range may be a weight portion or weight range corresponding to an amount of detergent written on the detergent provided by the company.

The weight range provided by the company supplying the detergent, as a standard range, may be a weight portion or weight range commonly used by other companies.

Accordingly, the user may identify the weight portion or weight range of the laundry and input the detergent of an amount corresponding thereto.

Referring to (c) in FIG. 18, the display portion P8 may display the sensed weight so as to be movable. For example, the display portion P8 may display the sensed weight to move from left to right, and may display a symbol unrelated to numbers on at least one of both sides of the displayed weight.

As a result, the user may recognize that the number displayed on the display portion P8 is weight information related to the sensed laundry amount.

As described above, the laundry treating apparatus according to the present disclosure may not only quickly sense the laundry amount, but also sense the laundry amount before the manipulation portion P7, the setting portion P2, and the execution portion P47 are pressed. Hereinafter, several unique embodiments in which the laundry treating apparatus according to the present disclosure may be implemented or executed differently from the existing laundry treating apparatus because of such characteristics will be described.

The laundry treating apparatus according to the present disclosure may recommend the course and the option suitable for or corresponding to the laundry amount sensed before the user manipulates the control panel P.

In other words, the controller P may sense the laundry amount in advance before the user selects the course and the option, determine the course and the option suitable therefor, and recommend the course and the option by displaying those on the display portion P8.

As a result, the user may check the recommended course and option via the display portion P8 and perform the suitable course and option by simply pressing the execution portion P47.

Additionally, when the course selected via the manipulation portion or the like does not correspond to the sensed laundry amount, the controller P may recommend the course corresponding to the sensed laundry amount via the display portion P8.

In addition, the laundry treating apparatus according to the present disclosure may determine a necessary notice based on the sensed laundry amount.

For example, when the course and the option that are suitable for the sensed laundry amount are selected, the controller P may display a notice that induces the user to select different course and option or take necessary action on the display portion P8.

The controller P may display the recommended course and option or the notice on the display portion P8.

As a result, the user may be guided to select the suitable course and option or take the suitable action based on the content displayed on the display portion P8. As a result, incorrect use of the laundry treating apparatus may be prevented.

The display portion P8 of the laundry treating apparatus according to the present disclosure may further include the speaker P88.

The laundry treating apparatus according to the present disclosure may transmit the content or the information displayed on the display portion P8 to the user in audio or voice via the speaker P88.

As a result, even when the user does not look directly at the display portion P8, the user may take the necessary action by receiving the recommended information or the necessary information displayed on the display portion P8 in the audio or the voice.

In particular, because such process is entirely performed before the power portion P46 is pressed and the user presses the execution portion P47, the user does not have to wait indefinitely to receive the recommendations for the course and the option or to receive necessary matters.

Moreover, because the user stays near the display portion P8 until pressing the execution portion P47, the user may immediately check the recommendations or the necessary information displayed on the display portion P8.

Figure 19:
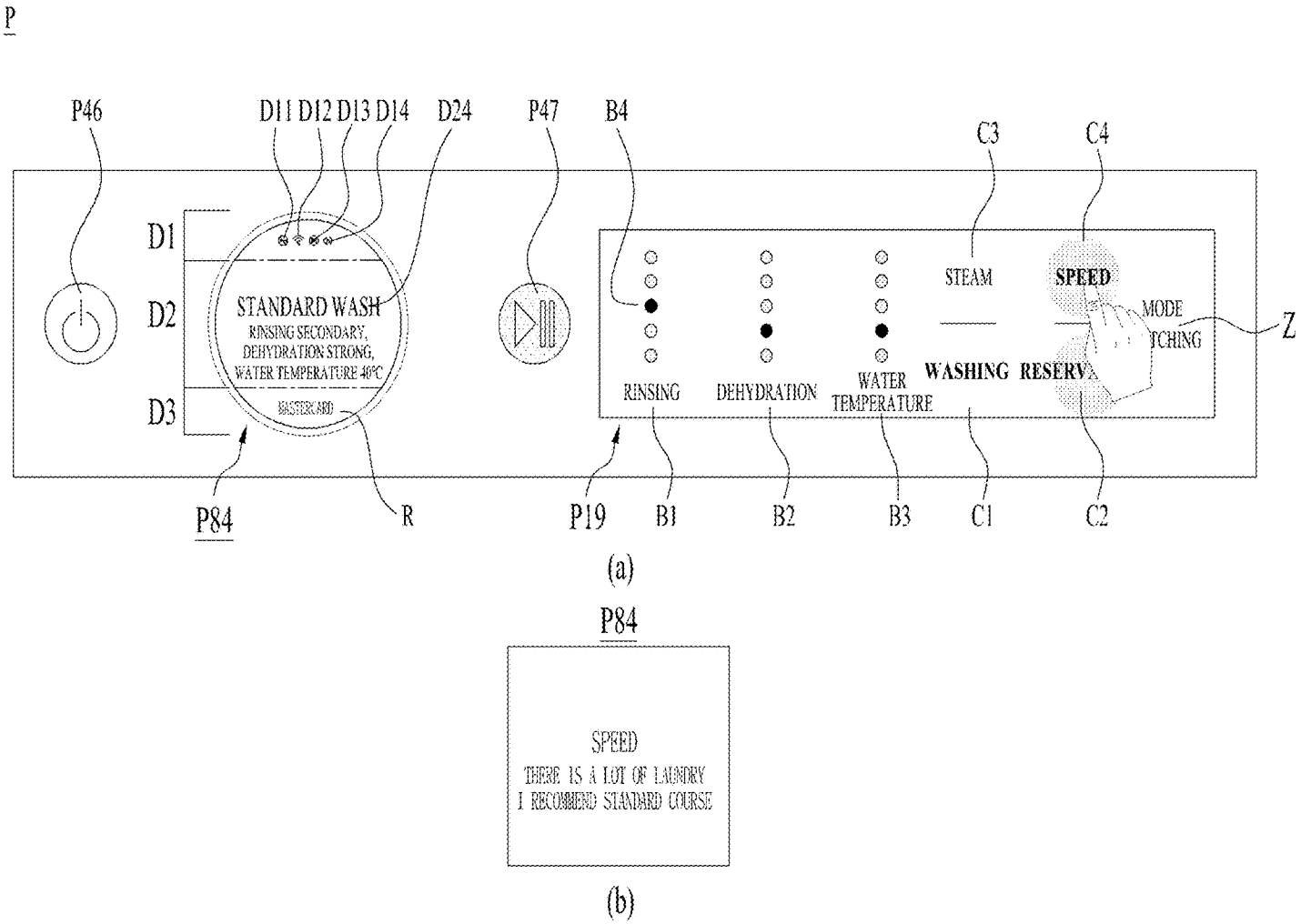
FIG. 19 shows an embodiment in which a laundry treating apparatus according to the present disclosure recommends a course to a user based on a sensed laundry amount.

FIG. 19 shows an embodiment in which a laundry treating apparatus according to the present disclosure recommends a course to a user based on a sensed laundry amount.

Referring to (a) in FIG. 19, the user may press the additional function portion C4 or the like in the setting portion P2 or manipulate the manipulation portion P7 to select a speed course.

The speed course, as a course that quickly washes a small amount of laundry, may be seen as a course that completes the washing cycle faster with a high energy efficiency because a water usage, a drum rotation speed, and a rotation duration are smaller than those in the standard course.

Referring to (b) in FIG. 19, when the user selects the speed course, the display P84 of the display portion P8 may display the state in which the speed course is selected and also display a notice on the speed course.

When the amount of the laundry is sensed to be a weight suitable for the standard course, and when the speed course with the shorter execution time than the standard course is selected via the manipulation portion P7 or the like, the controller P may recommend the standard course via the display portion P8.

Specifically, when the user selects the speed course even though the laundry amount sensed by the controller P is great, which is not suitable for the speed course, the controller P may display a notice indicating that the speed course is not suitable on the display portion P8.

The display portion P8 may display that the sensed laundry amount is a weight unsuitable for the speed course or is great, and may recommend another course suitable for the corresponding weight or the great amount.

For example, the display portion P8 may provide the information related to the sensed laundry amount, such as "There is a great amount of laundry", and recommend the course suitable for the sensed laundry amount, such as "I recommend a standard course".

The displayed content may be emitted in the audio or the voice via the speaker P88.

As a result, the user may realize that the speed course is not suitable and be induced to select the standard course or the like. As a result, the course suitable for the laundry amount may be performed and a performance of the laundry treating apparatus may be guaranteed.

Figure 20:
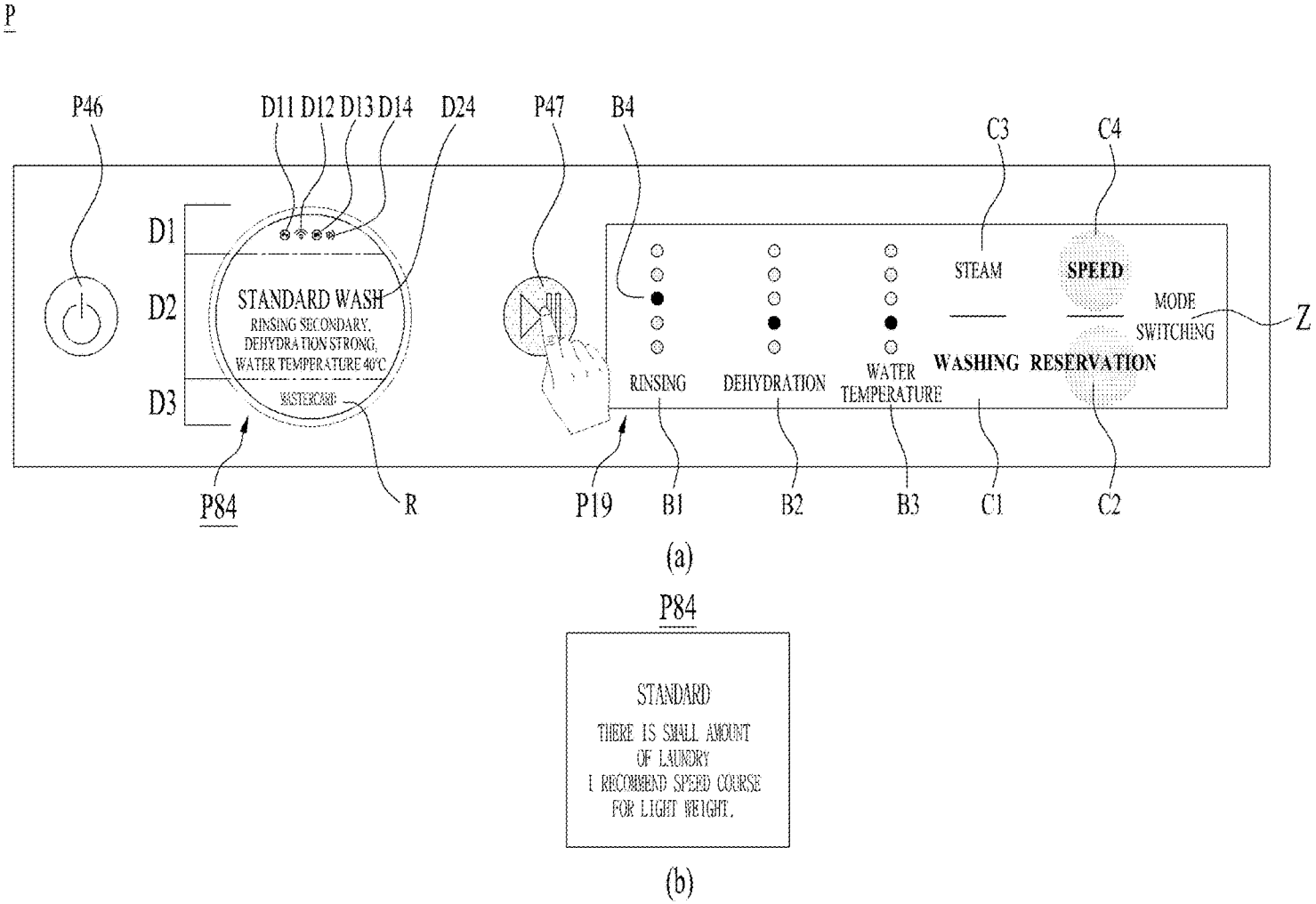
FIG. 20 shows another embodiment in which a laundry treating apparatus according to the present disclosure recommends a course to a user based on a sensed laundry amount.

FIG. 20 shows another embodiment in which a laundry treating apparatus according to the present disclosure recommends a course to a user based on a sensed laundry amount.

Referring to (a) in FIG. 20, the user may press the power portion P46 and may select the course and the option via the manipulation portion P7, or the standard course may be selected automatically. At this time, the user may wish to perform the standard course or the like by directly pressing the execution portion P47.

However, when the sensed laundry amount is small, the controller P may recommend the speed course with the shorter execution time than the standard course via the display portion P8.

However, even when the user selects something else, such as the standard course, the currently selected course may be displayed on the display portion P8 to indicate that the user's command has been input.

For example, a word "standard" may be displayed on the display portion P8 to display the course selected by the user.

At the same time, the controller P may display the information related to the sensed laundry amount and a recommendation phrase suitable therefor on the display portion P8.

For example, the information indicating that the sensed laundry amount is small, such as "There is a small amount of laundry", may be displayed and another course and option suitable for the sensed laundry amount may be recommended, such as "I recommend the speed course for a low weight".

As a result, the user may recognize the course suitable for the sensed laundry amount and perform the recommended course by pressing the execution portion P47. Additionally, the user may check the existence of other courses and options and learn which course and option are suitable for the sensed laundry amount.

Such process may be performed before the user presses the execution portion P47. Additionally, even when the user presses the execution portion P47, content recommending another course may be displayed via the display portion P8. As a result, the user may check such content, stop the course, and reselect the recommended course.

All notices may be output in the audio or the voice via the speaker P88.

Figure 21:
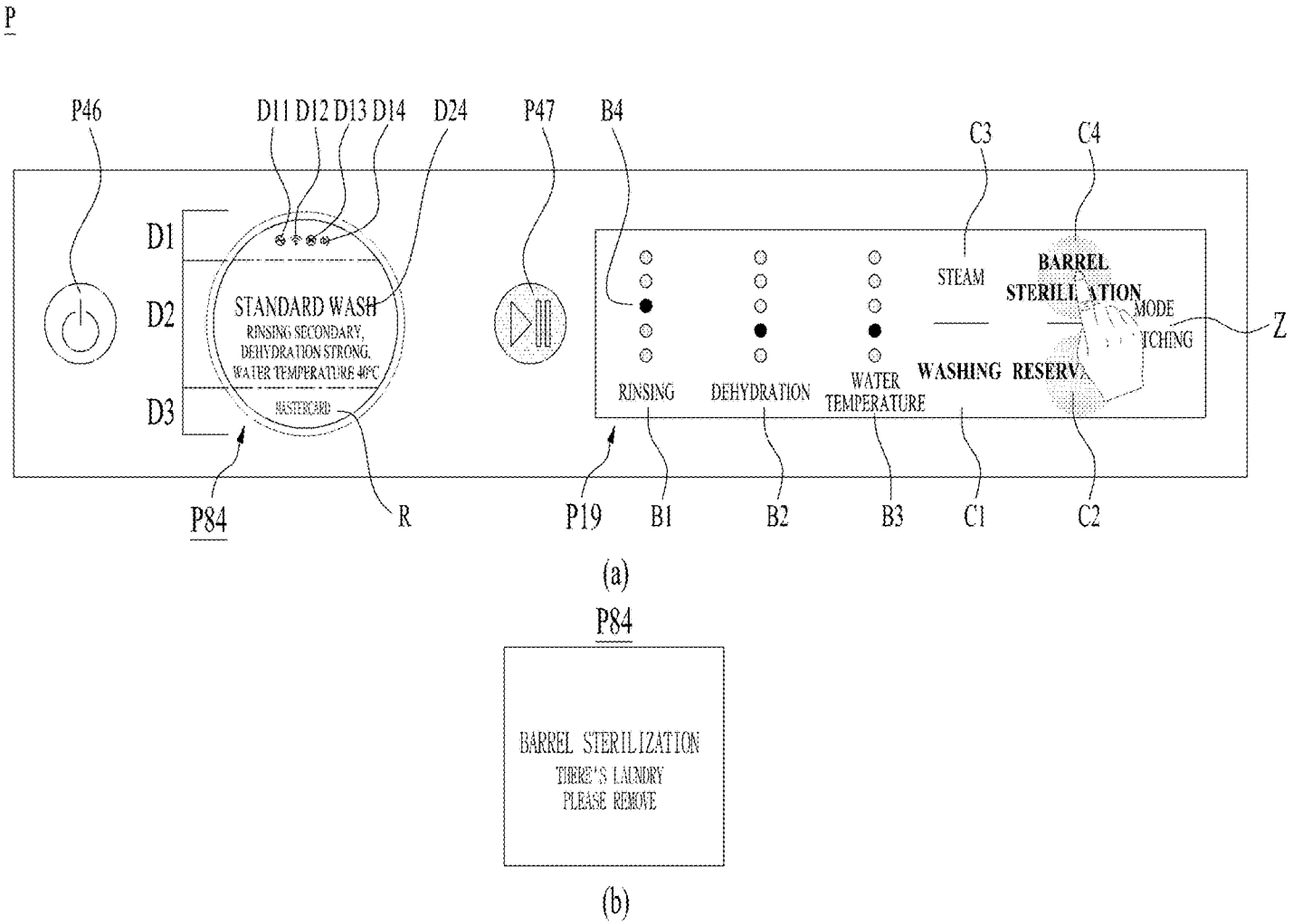
FIG. 21 shows another embodiment in which a laundry treating apparatus according to the present disclosure recommends a course to a user based on a sensed laundry amount.

FIG. 21 shows another embodiment in which a laundry treating apparatus according to the present disclosure recommends a course to a user based on a sensed laundry amount.

Referring to (a) in FIG. 21, the laundry treating apparatus according to the present disclosure may provide a barrel washing or barrel sterilization course in which the tub 2 and the drum 3 are washed with high temperature water or steam.

The barrel sterilization course may be selected via the manipulation portion P7 or may be selected by inputting a barrel sterilization course C42 via the additional function portion C4.

Because the barrel sterilization course is a course to remove bacteria or contaminants from the tub 2 and the drum 3, an environment inside the drum 3 may be more fatal to the laundry than in a general washing course.

Furthermore, when the barrel sterilization course is performed in the state in which there is the laundry inside the drum 3, the laundry may be exposed to the bacteria or foreign substances.

In one example, the user may select the barrel sterilization course while putting the laundry into the drum 3 or in the state in which the laundry has been put. However, the laundry treating apparatus according to the present disclosure may also have already recognized whether there is the laundry inside the drum 3 by performing the laundry amount sensing before the user selects the barrel sterilization course.

Referring to (b) in FIG. 21, the user may select the barrel sterilization course in the state in which there is the laundry inside the drum 3.

At this time, the controller P may inform the user via the display portion P8 that the barrel sterilization course is not suitable when the laundry exists inside the drum 3.

For example, the controller P may sense the laundry amount to recognize not only the laundry amount but also the existence of the laundry inside the drum 3 in advance. When the barrel sterilization course is selected in such state, the user may be guided via the display portion P8 to withdraw the laundry from the drum 3.

The display portion P8 may display contents of the course selected by the user, such as "barrel sterilization," may also display the state information obtained by sensing the existence of the laundry, such as "There is laundry inside", and may display a notice inducing the withdrawal of the laundry, such as "Please, remove laundry".

As a result, the controller P may guide the withdrawal of the laundry via the display portion P8 when the barrel sterilization course is selected via the manipulation portion P7 or the like in the state in which the laundry has been sensed inside the drum.

In addition, the controller P may recommend performing a course other than the barrel sterilization course when the barrel sterilization course is selected via the manipulation portion P7 or the like in the state in which the controller P has sensed the laundry inside the drum.

All notice contents may be output in the audio or the voice via the speaker P88.

Figure 22:
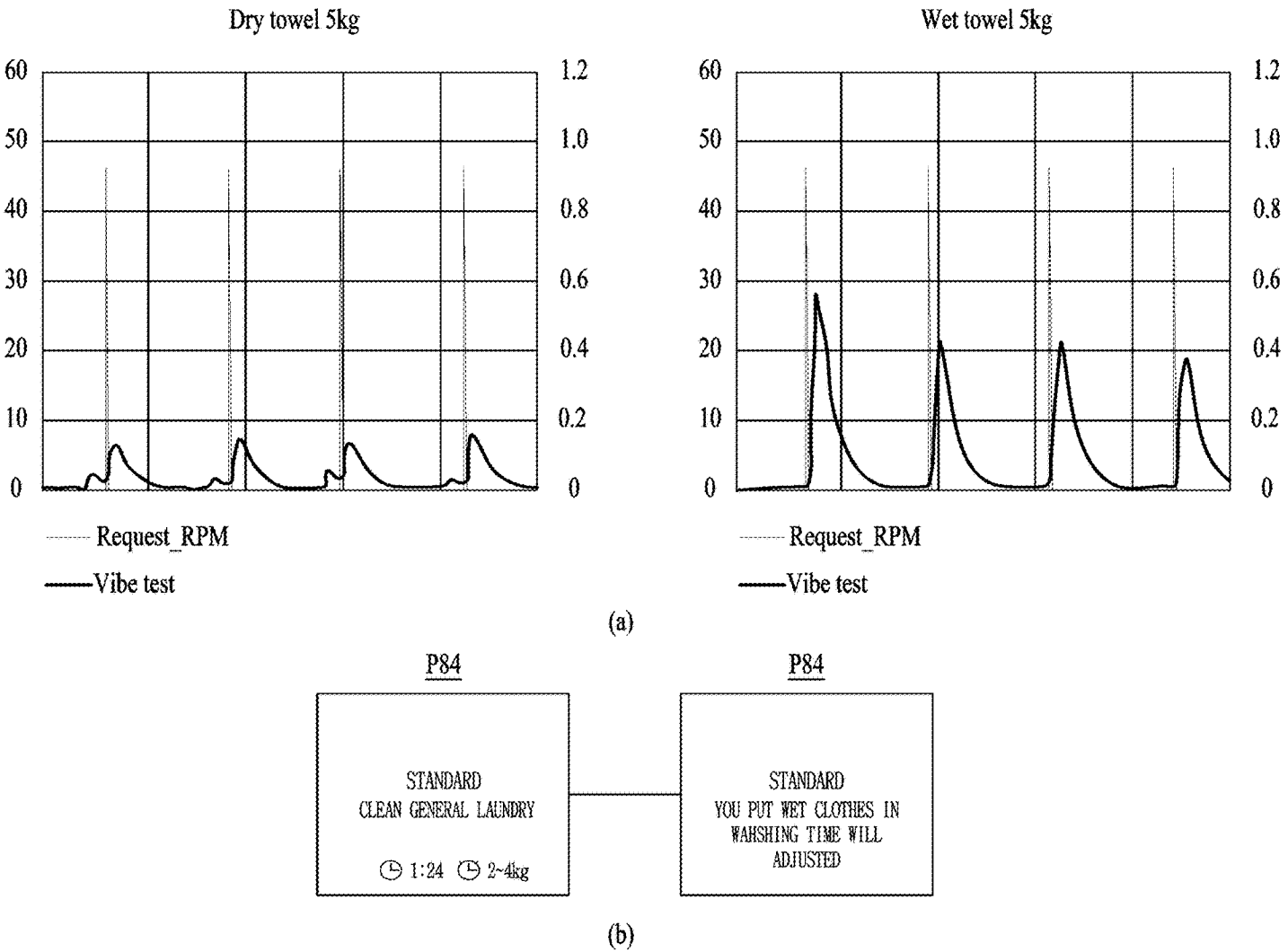
FIG. 22 shows an embodiment in which a laundry treating apparatus according to the present disclosure also senses a state of laundry based on a sensed laundry amount.

FIG. 22 shows an embodiment in which a laundry treating apparatus according to the present disclosure also senses a state of laundry based on a sensed laundry amount.

Referring to (a) in FIG. 22, when sensing the laundry amount, the controller P may also sense whether the laundry is wet.

The controller P may sense whether the laundry is wet using the current value applied to or output from the drive portion 9.

A drawing on the left shows a case in which the laundry is dry, such as a dry towel, and a drawing on the right shows a case in which the laundry is a wet cloth, such as a wet towel.

When the wet laundry and the dry laundry have the same weight (e.g., 5 kg), current values of the drive portion 9 for rotating the drum 30 may not be significantly different from each other. However, in the case of the wet laundry, because a contact force is better than that of the dry laundry, the wet laundry items may agglomerate well, so that a large amount of laundry may fall onto an inner wall of the drum at the same time each time the drum rotates once. As a result, a vibration value of the wet laundry may be sensed to be greater than that of the dry laundry.

Accordingly, the controller P may sense that the laundry is wet when the vibration value generated from the drum 30 is equal to or greater than a reference value or when a one-time vibration waveform occurs during the one rotation.

When the laundry is wet, an actual weight of the laundry may be smaller than the weight of the laundry sensed in the laundry amount sensing step by an amount of water absorbed by the laundry.

Accordingly, the controller P may calculate a weight obtained by subtracting the amount of water from the weight of the laundry or may calculate a weight of the laundry when a water level is a wash level at which the washing may be performed.

Accordingly, the controller P may estimate or predict a weight of the laundry when it is dry, change the execution time of the course or the option or the amount of detergent, and display the changed execution time or amount of detergent.

As a result, the controller may recognize the laundry as wet when a maximum vibration value is great compared to the laundry amount when rotating the drum.

Referring to (b) in FIG. 22, the display portion P8 may sense that the laundry is set and transmit a necessary notice.

In addition, the display portion P8 may also guide the user to perform the dehydration first or notify that the execution time of the selected course may be adjusted to be reduced when the laundry is wet.

For example, the fact that the input laundry is wet, such as "You have put wet laundry", and the fact that, because the laundry is wet, the execution time is adjusted to be suitable therefor, such as "A washing time is adjusted.", may be displayed.

As a result, the user may have more faith in the performance of the laundry treating apparatus. Additionally, the laundry treating apparatus may prevent a situation of consuming more water, energy, and time by incorrectly sensing the laundry amount.

Such notice may be output in the audio or the voice via the speaker P88.

Figure 23:
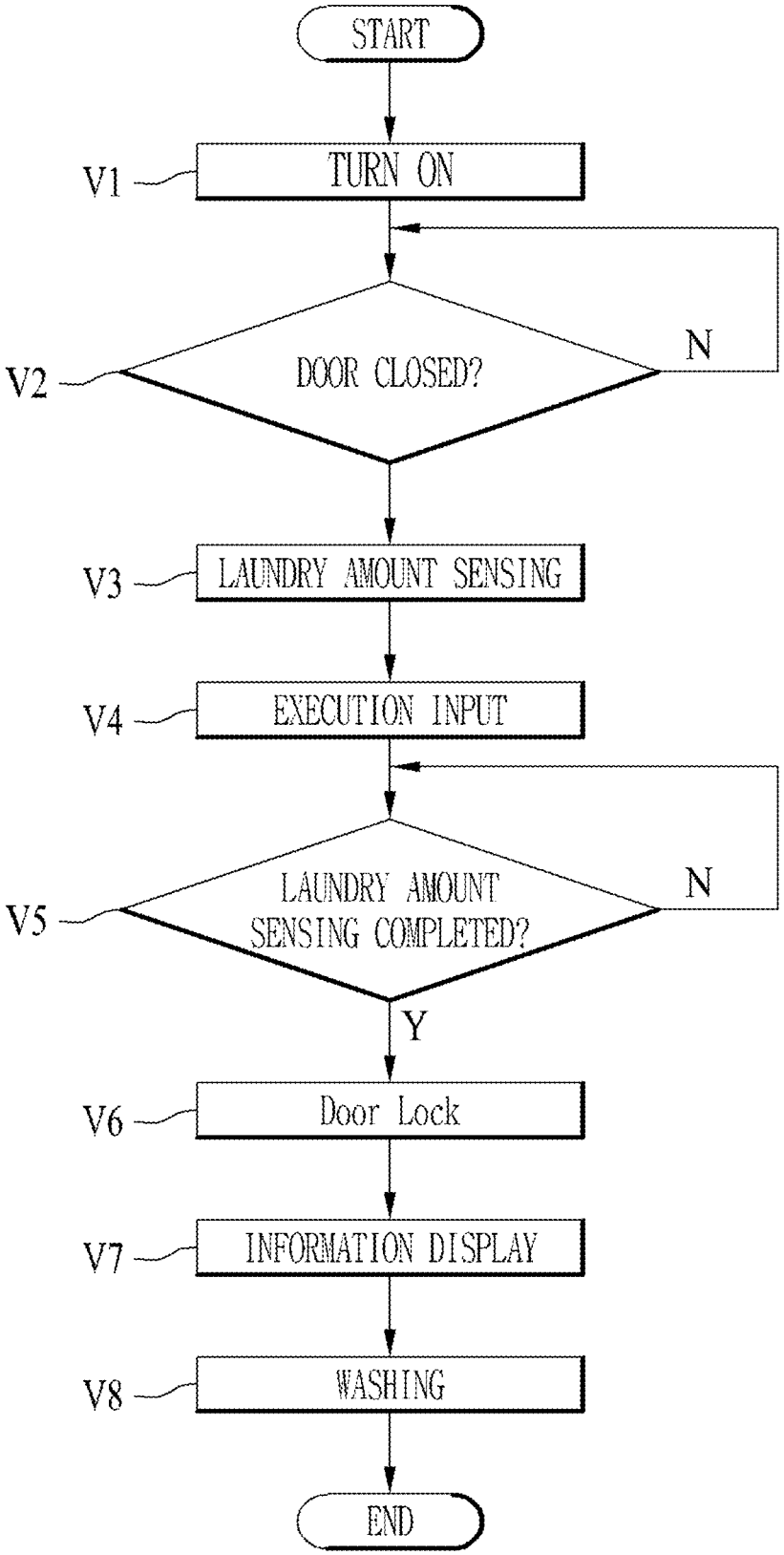
FIG. 23 shows an embodiment when an execution portion P47 is pressed during laundry amount sensing.

FIG. 23 shows an embodiment when an execution portion P47 is pressed during laundry amount sensing.

The laundry treating apparatus according to the present disclosure may sense the laundry amount when sensing at least one of the pressing of the power portion P46 and the door 132 opening and closing the opening. As a result, the laundry treating apparatus according to the present disclosure may perform the laundry amount sensing before the manipulation portion P7 and the execution portion P47 are pressed.

However, the user may press the execution portion P47 during the process in which the laundry treating apparatus senses the laundry amount.

For example, in the laundry treating apparatus, when the power portion P46 is pressed, the standard course may be automatically selected even before the manipulation portion P7 is pressed. In such process, the execution portion P47 may be pressed.

Even though the laundry treating apparatus according to the present disclosure quickly senses the laundry amount upon the pressing of the power portion P46, the execution portion P47 may be pressed when the laundry amount sensing has not been completed.

When the course and the option are executed because the execution portion P47 is pressed even though the laundry amount sensing has not been completed, not only is the laundry treating apparatus according to the present disclosure unable to recommend the course and the option based on the laundry amount, but also unable to provide the amount of laundry based on the laundry amount or the expected execution time of the course.

Furthermore, when the course is performed, because the locker L performs the locking of the door 132, a problem in which the user is not able to add or withdraw the laundry during the process may occur.

Accordingly, the laundry treating apparatus according to the present disclosure may perform the course and the option after the controller P completes the laundry amount sensing, regardless of the pressing of the execution portion P47.

Accordingly, the controller P may control the locker L to lock the door 132 after completing the laundry amount sensing. Additionally, until the laundry amount sensing is completed, even when the execution portion P47 is pressed, the locker L may not lock the door 132 and the course and the option may wait without being performed immediately.

As a result, after the laundry amount sensing is completed and the information related to the laundry amount, the expected execution time of the course, and the required amount of detergent are displayed on the display portion P8, the locker L may lock the door 132 to the cabinet and the course and option may be performed.

In one example, when the execution portion P47 is pressed during the process of sensing the laundry amount, the controller P may pause the process of sensing the laundry amount and then re-sense the laundry amount.

This is to, although the laundry treating apparatus according to the present disclosure measures the laundry amount quickly while rotating the drum less than once, block variables and provide accurate laundry amount sensing because even noise and small vibrations may affect the laundry amount sensing.

As a result, even when the execution portion P47 is pressed, the laundry treating apparatus according to the present disclosure may preferentially transmit the information based on the accurate laundry amount sensing to the user, thereby guaranteeing the user an option to change the course and the option or to add additional laundry or remove the laundry.

Specifically, when performing a power input step (V1) of sensing that a power command for supplying the power to the controller is input to the power portion P47, the laundry treating apparatus according to the present disclosure may perform a door sensing step (V2) of sensing whether the door has closed the opening 132.

When the door 132 is opening the opening 111 in the door sensing step (V2), the laundry treating apparatus may wail until the door 132 closes the opening 111.

When the door 132 closes the opening 111, a laundry amount sensing step (V3) of sensing the laundry amount by rotating the drum less than once may be performed.

The laundry amount sensing step (V3) is for sensing the laundry amount via the current value applied or output when the drum is rotated less than once. A rotation angle of the drum may be determined to be equal to or smaller than an angle at which the laundry is separated from the inner wall of the drum or the arrangement of the laundry varies.

In the laundry amount sensing step (V3), the controller P may calculate the laundry amount within 2 seconds after the drum is rotated, and an information display step (V7) of displaying the information related to the sensed laundry amount on the display portion P8 may be within 3 seconds.

The information display step (V7) may include displaying the expected execution time corresponding to the changed course and option when the course and option are changed because of the manipulation portion P7.

After the laundry amount sensing step (V3) is performed, when the opening and closing of the door is additionally sensed, the laundry amount sensing step (V3) may be re-performed, and a newly sensed laundry amount and information related thereto may be displayed in the information display step (V7).

Additionally, when the power portion P47 is re-pressed and the power input step (V1) is re-performed, the laundry amount sensing step (V3) may be re-performed, and the information corresponding to the newly sensed laundry amount may also be displayed in the information display step (V7). This is because the laundry may be added or withdrawn or the state of the laundry treating apparatus may vary while the power portion P47 is re-pressed.

In one example, an execution input step (V4) in which the execution portion P47, which receives an execution command for the controller P to execute one of the arbitrary courses, is pressed may be performed.

When the execution input step (V4) is performed, a locking step (V6) in which the locker L fixes the door 132 to the cabinet 1 may be performed, and one of the course and the option being performed based on the laundry amount sensed in the information display step (V7) and the expected execution time or a remaining time may be displayed.

Additionally, a washing step (V8) in which the course and the option pressed in the execution input step (V4) are performed may be performed.

In one example, the execution input step (V4) may be performed during the laundry amount sensing step (V3). Accordingly, the laundry treating apparatus according to the present disclosure may additionally perform a sensing checking step (V5) of checking whether the laundry amount sensing has been completed when the execution input step (V3) is performed.

When the laundry amount sensing is not completed in the sensing checking step (V5), the laundry treating apparatus may wait until the laundry amount sensing step (V4) is completed. Additionally, when the laundry amount sensing is not completed in the sensing checking step (V5), the laundry amount sensing step (V4) may be stopped and re-performed.

Therefore, the locking step (V6) may wait without being performed until the sensing checking step (V5) is completed.

Figure 24:
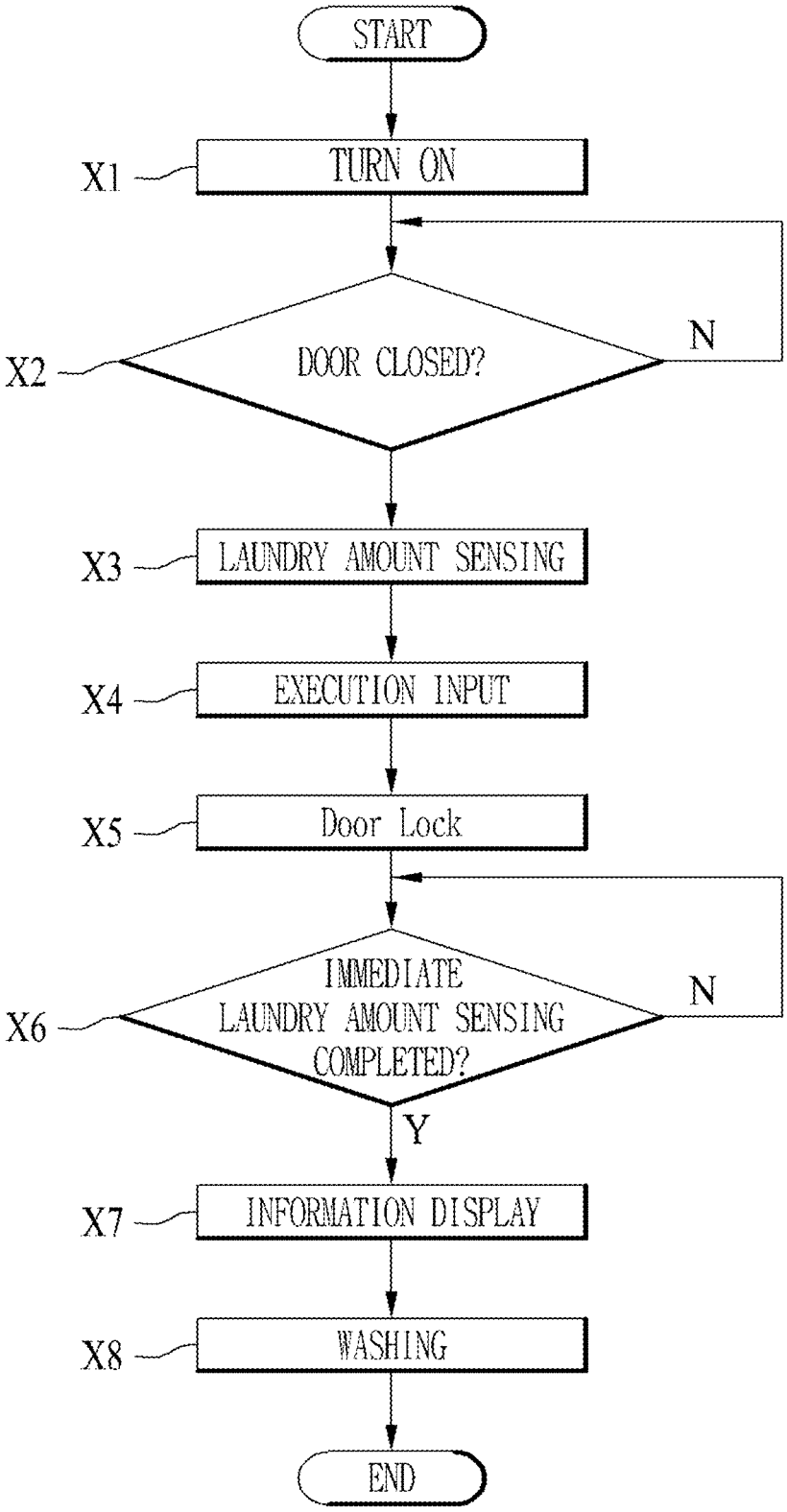
FIG. 24 shows another embodiment when an execution portion P47 is pressed during laundry amount sensing.

FIG. 24 shows another embodiment when an execution portion P47 is pressed during laundry amount sensing.

The laundry treating apparatus according to the present disclosure may be constructed such that when the execution portion P47 is pressed, the locker L is controlled to lock the door 132 to the cabinet 1.

At this time, when the execution portion P47 is pressed, the locker L may lock the door 132 to the cabinet 1 even before the controller P completes the laundry amount sensing.

As a result, after the execution portion P47 is pressed, the state inside the drum 3 may be blocked from varying, so that the optimal course and option may be induced to be performed with the sensed laundry amount.

The laundry treating apparatus according to the present disclosure performs the laundry amount sensing when the power portion P47 is pressed or the door 132 opens and closes the opening even before the execution portion P47 is pressed.

In the laundry treating apparatus according to the present disclosure, even when the execution portion P47 is pressed while the laundry amount sensing is performed or before the laundry amount sensing is completed, the locker L may lock the door 132 to the cabinet 1.

In one example, after the laundry amount sensing is completed, a course commanded to be executed by the execution portion P47 may be executed. Accordingly, the execution time of the course and the option corresponding to the sensed laundry amount may be determined, and the remaining execution time or the expected execution time of the course may be immediately displayed to the user. Even the user has pressed the execution portion P47, the user may check the expected execution time, the remaining execution time, and the like and move to another location.

As a result, the laundry treating apparatus according to the present disclosure may respect the will of the user who pressed the execution portion P47 by first locking the door 132 to block the additional input or the withdrawal of the laundry when execution portion P47 is pressed.

In one example, when the execution portion P47 is pressed during the laundry amount sensing, the existing laundry amount sensing may be stopped and the laundry amount sensing may be re-performed.

Specifically, when performing a power input step (X1) of sensing that the power command to supply the power to the controller is input to the power portion (P47), the laundry treating apparatus according to the present disclosure may perform a door sensing step (X2) of sensing whether the door has closed the opening 132.

When the the door 132 is opening the opening 111 in the door sensing step (X2), the laundry treating apparatus may wail until the door 132 closes the opening 111.

When the door 132 closes the opening 111, a laundry amount sensing step (X3) of sensing the laundry amount by rotating the drum less than once may be performed.

The laundry amount sensing step (X3) is for sensing the laundry amount via the current value applied or output when the drum is rotated less than once. The rotation angle of the drum may be set to be equal to or smaller than the angle at which the laundry is separated from the inner wall of the drum or the arrangement of the laundry varies.

The controller P may calculate the laundry amount within 2 seconds after the drum is rotated in the laundry amount sensing step (X3), and an information display step (X7) of displaying the information related to the sensed laundry amount on the the display portion P8 may be performed within 3 seconds.

The information display step (X7) may include displaying the expected execution time corresponding to the changed course and option when the course and the option are changed because of the manipulation portion P7.

After the laundry amount sensing step (X3) is performed, when the opening and closing of the door is additionally sensed, the laundry amount sensing step (X3) may be re-performed, and the information related to the newly sensed laundry amount may be displayed in the information display step (X7).

Additionally, when the power portion P47 is re-pressed and the power input step (X1) is re-performed, the laundry amount sensing step (X3) may be re-performed, and the information corresponding to the re-sensed laundry amount may also be displayed in the information display step (X7)._This is because the laundry may be added or withdrawn or the state of the laundry treating apparatus may vary while the power portion P47 is re-pressed.

In one example, an execution input step (X4) in which the execution portion P47, which receives the execution command for the controller P to execute one of the arbitrary courses, is pressed may be performed.

When the execution input step (X4) is performed, a locking step (X5) in which the locker L fixes the door 132 to the cabinet 1 may be performed.

In this regard, one of the course and the option being performed based on the laundry amount sensed in the information display step (X7) and the expected execution time or the remaining time may be displayed.

Additionally, a washing step (V8) in which the course and the option input in the execution input step (X4) are performed may be performed.

In one example, the execution input step (X4) may be performed during the laundry amount sensing step (X3).

In this regard, when the execution input step (X4) is performed, the locking step (X5) may be performed preferentially even before the laundry amount sensing step (X3) is completed.

Thereafter, a sensing checking step (X6) of checking whether the laundry amount sensing has been completed may be performed.

When the laundry amount sensing has not been completed in the sensing checking step (X6), the laundry treating apparatus may wait until the laundry amount sensing step (X4) is completed. Additionally, when the laundry amount sensing has not been completed in the sensing checking step (X6), the laundry amount sensing step (X4) may be stopped and re-performed.

The information display step (X7) may be performed only when the sensing checking step (X6) is completed. Accordingly, the information display step (X7) may accurately display the information based on the sensed laundry amount to the user.

Figure 25:
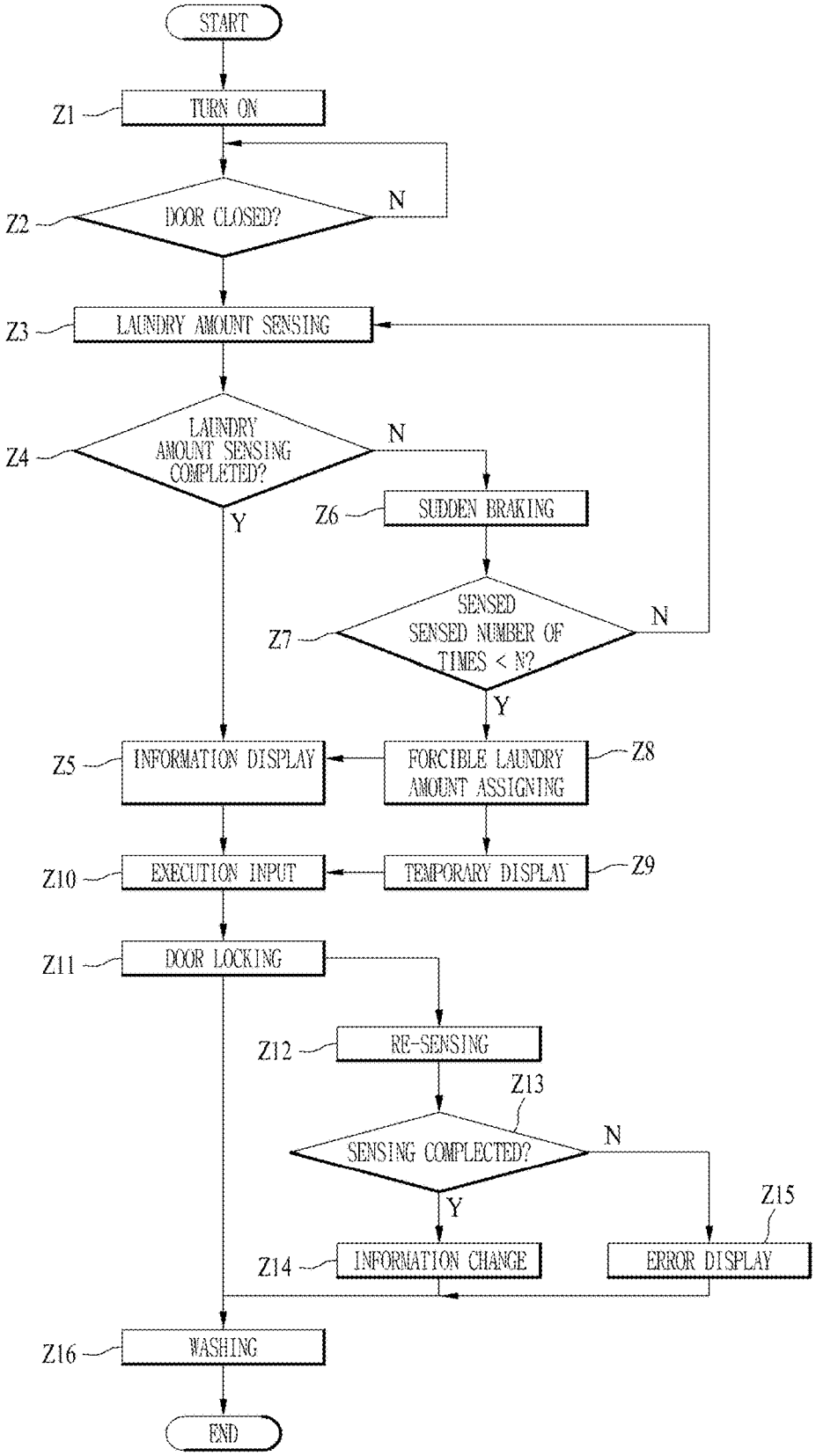
FIG. 25 shows a control method when laundry amount sensing fails.

FIG. 25 shows a control method when laundry amount sensing fails.

The laundry treating apparatus according to the present disclosure controls the drive portion 32 and senses the amount of the laundry before the execution portion P47 is pressed.

When sensing the laundry amount, the controller P uses the current value applied to or sensed from the drive portion 32.

However, when the drive portion 32 is not controlled, the laundry treating apparatus according to the present disclosure may finalize the amount of the laundry as a reference value.

The fact that the drive portion 32 is not controlled may include a state in which the drive portion 32 is unable to operate, a state of not accurately rotating at the instructed rotation angle, or a state in which the drive portion 32 is overloaded.

Because the drive portion 32 has the motor structure such as the stator and the rotor, when the drive portion 32 is overloaded or overheated, a magnetic flux may weaken or an error in a control location may increase, so that the control may not be performed properly, and in severe cases, the operation of the drive portion 32 itself may fail.

Such overload of the drive portion 32 may occur when new course and option are performed again immediately after the laundry treating apparatus has performed the course and the option. Additionally, such overload of the drive portion 32 may occur when the new course and option are performed again after the course and the option are interrupted while being performed.

In any case, when the drive portion 32 is in the overloaded state, the controller P is not able to perform the accurate laundry amount sensing.

The controller P may wait until the overloaded state of the drive portion 32 is resolved and then control the drive portion 32 again to perform the laundry amount sensing. However, a time it takes for the overloaded state of drive portion 32 to be resolved may be greater than a time interval for the user to press the execution portion P47 after pressing the power portion P46, and there may be a risk that the user does not receive the information corresponding to the laundry amount until pressing the execution portion P47.

To prevent such problems, when the laundry amount sensing is impossible because of the overload of the drive portion 32 or the like, the laundry treating apparatus according to the present disclosure may stop the laundry amount sensing and display the laundry amount by temporarily assigning the reference value to the laundry amount.

The display portion P8 may display information corresponding to the reference value. That is, the display portion P8 may be controlled to display one or more of a weight, a course execution time, and a detergent amount corresponding to the reference value.

For example, the reference value may correspond to the greatest amount. As such, the user may be informed that the course execution time corresponding to the greatest amount is required. Accordingly, the user may confirm a future schedule, so that disruptions to the user's schedule may be prevented. In addition, by inducing the user to add the detergent of an amount corresponding to the greatest amount, a washing effect may be prevented from being reduced because of a lack of detergent.

Additionally, the reference value may correspond to a reference laundry amount. The reference laundry amount may be a weight laundry amount, an average laundry amount mainly used by the user, or a previously used laundry amount.

As a result, the user may be informed that an average course execution time is required. Accordingly, a difference between an actual course end time and the expected execution time may be reduced, preventing an unreasonable change in the user's schedule from occurring.

Additionally, by inducing the user to add a regular amount of detergent, addition of excessive detergent may be prevented.

In one example, the laundry treating apparatus according to the present disclosure may re-sense the laundry amount when the motor overload is resolved. As a result, the laundry treating apparatus according to the present disclosure may correct and display the information corresponding to the re-sensed laundry amount.

As a result, the user may finalize the schedule or adjust the amount of detergent to be input by checking the information corresponding to the corrected laundry amount.

In one example, even when the laundry amount sensing fails, the laundry treating apparatus according to the present disclosure may repeatedly attempt the laundry amount sensing until whether the motor is overloaded is finalized. Accordingly, when the laundry amount sensing is not performed because of a temporary error, the laundry amount sensing may be quickly re-attempted and the information corresponding to the laundry amount may be transmitted to the user.

For example, the laundry treating apparatus according to the present disclosure may re-attempt the laundry amount sensing during a reference time when the laundry amount sensing fails. The laundry treating apparatus according to the present disclosure may sense the laundry amount by rotating the drum less than once, so that even when the reference time is small, the laundry amount sensing may be re-attempted at least three times.

For example, the reference time may correspond to 3 seconds.

However, when the repeated attempts at the laundry amount sensing fail during the reference time, the laundry treating apparatus according to the present disclosure may stop the laundry amount sensing for a specific time. The specific time may be set to be equal to or greater than a time for the motor overload to be resolved. For example, the specific time may be set to a time for a temperature of the motor to be lowered, and may be set to 3 minutes or greater.

Alternatively, when failing to perform the laundry amount sensing, the laundry treating apparatus according to the present disclosure may further perform the laundry amount sensing a reference number of times. Because the laundry amount sensing may be performed within 1 second, the reference number of times may be set to 3.

When the laundry amount sensing fails during the reference number of times, the laundry treating apparatus according to the present disclosure may stop the laundry amount sensing for a specific time.

In one example, the course may be changed as the manipulation portion P7 is pressed during the specific time. However, the expected execution time for the course may be fixed. This is to avoid misleading the user by changing the expected execution time because the reference value is a temporary value.

The laundry treating apparatus according to the present disclosure may display information corresponding to the reference value before the pressing of the execution portion P47 even when the laundry amount sensing is impossible because of the overload of the drive portion 32. Therefore, the user may not doubt a performance or a function of the laundry treating apparatus.

Additionally, during the specific time, the execution portion P47 may be pressed to execute the course and the option. When the execution portion P47 is pressed, the locker L may lock the door 132 to the cabinet 1 to prevent the door from being opened.

In this case, the course and the option may be performed first with a laundry amount corresponding to the reference value, so that a washing delay may be prevented. This is because, as 3 minutes, the specific time, may typically correspond to a time for water to be supplied, water may be additionally supplied when the laundry amount sensing is successful after the specific time and the laundry amount is great.

Thereafter, the course and the option may be performed, usually starting with the water supply. In one example, when the specific time elapses while the course and the option are being performed, the laundry amount may be re-sensed.

Conversely, in the laundry treating apparatus according to the present disclosure, when the laundry amount is not sensed during the reference time, the course and the option may wait without being performed even when the execution portion P47 is pressed. In other words, the laundry treating apparatus according to the present disclosure may not execute the course and the option even when the execution portion P47 is pressed until the laundry amount is sensed. This is because when the laundry amount is not sensed because of a problem in another component rather than because of the overload of the motor, there is no need to forcefully supply water into the tub 2.

When the laundry amount is re-sensed, the display portion P8 may display the state of re-sensing the laundry amount. As a result, the user may recognize that the laundry treating apparatus is re-sensing the laundry amount, and may more trust the content displayed by the laundry treating apparatus.

In one example, the laundry treating apparatus according to the present disclosure may sense the laundry amount again after the specific time elapses. The laundry treating apparatus according to the present disclosure may display an error on the display portion P8 when the laundry amount is not able to be sensed even when the laundry amount sensing is re-performed after the specific time elapses.

This is because it may be finalized that the reason for the laundry amount sensing being impossible is not the overload of the drive portion 32 because the overloaded state of the drive portion 32 is mostly relieved after the specific time elapses.

The error may be a notice phrase such as "Laundry amount sensing is impossible" or direct information such as "A problem has occurred in the motor," or may be comprehensive information such as "Contact the administrator".

As a result, the user may recognize that there is a problem in the laundry treating apparatus by checking the error display and may not forcefully operate the laundry treating apparatus.

In one example, in the laundry treating apparatus according to the present disclosure, when the laundry amount sensing is re-performed after the specific time elapses and the laundry amount sensing is successful, the display portion P8 may correct and display one or more of the weight, the execution time, and the detergent amount corresponding to the sensed laundry amount.

As a result, the user may check the information corresponding to the accurately sensed laundry amount.

In addition, the laundry treating apparatus according to the present disclosure may display the expected execution time of the course corresponding to the corrected laundry amount. This allows the user to accurately identify a time when the course ends.

In addition, the laundry treating apparatus according to the present disclosure may immediately re-sense the laundry amount when the overload of the drive portion 32 is resolved, and accurately transmit the information corresponding to the laundry amount to the user. In addition, by correcting the execution time or the like of the course and the option with the sensed laundry amount, the washing performance may be guaranteed and energy waste may be prevented.

Hereinafter, with reference to FIG. 24, an embodiment in which the above-described process may be implemented as a control method will be described.

The laundry treating apparatus according to the present disclosure may include a power supply step (Z1) of receiving the power command to supply the power to the controller P by pressurizing the power portion P47.

The laundry treating apparatus according to the present disclosure may perform a door sensing step (Z2) of sensing whether the door is opened or closed or whether the door has closed the opening via the sensor S when the power supply step (Z1) is input.

The laundry treating apparatus according to the present disclosure may perform a laundry amount sensing step (Z3) of sensing the laundry amount by rotating the drum 3 less than once when the power supply step (Z1) and the door sensing step (Z2) are completed.

The laundry treating apparatus according to the present disclosure may perform a sensing checking step (Z4) of checking whether the sensing of the laundry amount has been completed in the laundry amount sensing step (Z3).

When the laundry amount sensing is completed in the sensing checking step (Z4), an information display step (Z5) of displaying the information corresponding to the sensed laundry amount on the display portion P8 may be performed.

The information corresponding to the laundry amount may be at least one of the weight, the expected execution time of the course corresponding to the laundry amount, and the required amount of detergent corresponding to the laundry amount.

When the information display step (Z5) is completed, an execution input step (Z10) in which the controller P receives the execution command to perform the course selected with the manipulation portion P7 may be performed, and when the execution input step (Z10) is performed, a locking step (Z11) in which the locker L fixes the door 132 to the opening 111 may be performed.

Thereafter, a washing step (Z16) in which the washing cycle is performed with the selected course and option may be performed and the control method may be ended.

However, when it is not sensed that the laundry amount sensing is completed in the sensing checking step (Z4), an attempt may be made to re-sense the laundry amount. The reference time may correspond to 3 seconds.

Specifically, when the laundry amount sensing is not completed in the sensing checking step (Z4), a sudden braking step (Z6) of stopping the rotation of the drum may be performed.

Further, after the sudden braking step (Z6), a number of times determining step (Z7) of check whether the laundry amount has been sensed as much as a reference number of times N may be performed. The reference number of times N may correspond to 3.

When the number of times of the sensing is smaller than the reference number of times in the number of times determining step (Z7), the laundry treating apparatus according to the present disclosure may perform the laundry amount sensing step (Z3) again.

However, when the number of times of the sensing reaches the reference number of times N, the controller P may determine that the laundry amount sensing is no longer meaningful, and perform a laundry amount assigning step (Z8) of forcibly assigning a value to the laundry amount.

The value assigned to the laundry amount in the laundry amount assigning step may correspond to the reference value.

The controller P may perform a temporary display step (Z9) of displaying the information corresponding to the laundry amount corresponding to the reference value on the display portion P8.

The temporary display step (Z9) may be performed before the execution input step (Z10). In one example, even when the execution input step (Z10) is performed before the temporary display step (Z9), the temporary display step (Z9) may be performed as is.

When the execution input step (Z10) is performed, the door locking step (Z11) may be performed.

However, the laundry treating apparatus according to the present disclosure may perform a re-sensing step (Z12) of re-sensing the laundry amount after a specific time elapses. The specific time, as a time for the motor overload to be resolved, may correspond to 3 minutes.

A re-sensing checking step (Z13) of determining whether the laundry amount sensing has been completed in the re-sensing step (Z12) may be performed.

In one example, the washing step (Z16) may be performed only when the sensing of the laundry amount is completed in the re-sensing checking step (zl3).

However, the washing step (Z16) may be performed first in the re-sensing step (Z12). This may prevent the washing delay. However, when the laundry amount is not sensed in the re-sensing checking step (Z13), the washing step (Z16) may be stopped.

When the sensing of the laundry amount is completed in the re-sensing checking step (Z13), an information change step (Z17) of correcting the information corresponding to the sensed laundry amount and displaying the corrected information on the display portion P8 may be performed.

However, when the sensing of the laundry amount is still not completed in the re-sensing checking step (Z13), the controller P may perform an error display step (Z15) of displaying an error phrase on the display portion P8.

In the error display step (Z15), performing of the washing step (Z16) may be blocked.

Figure 26:
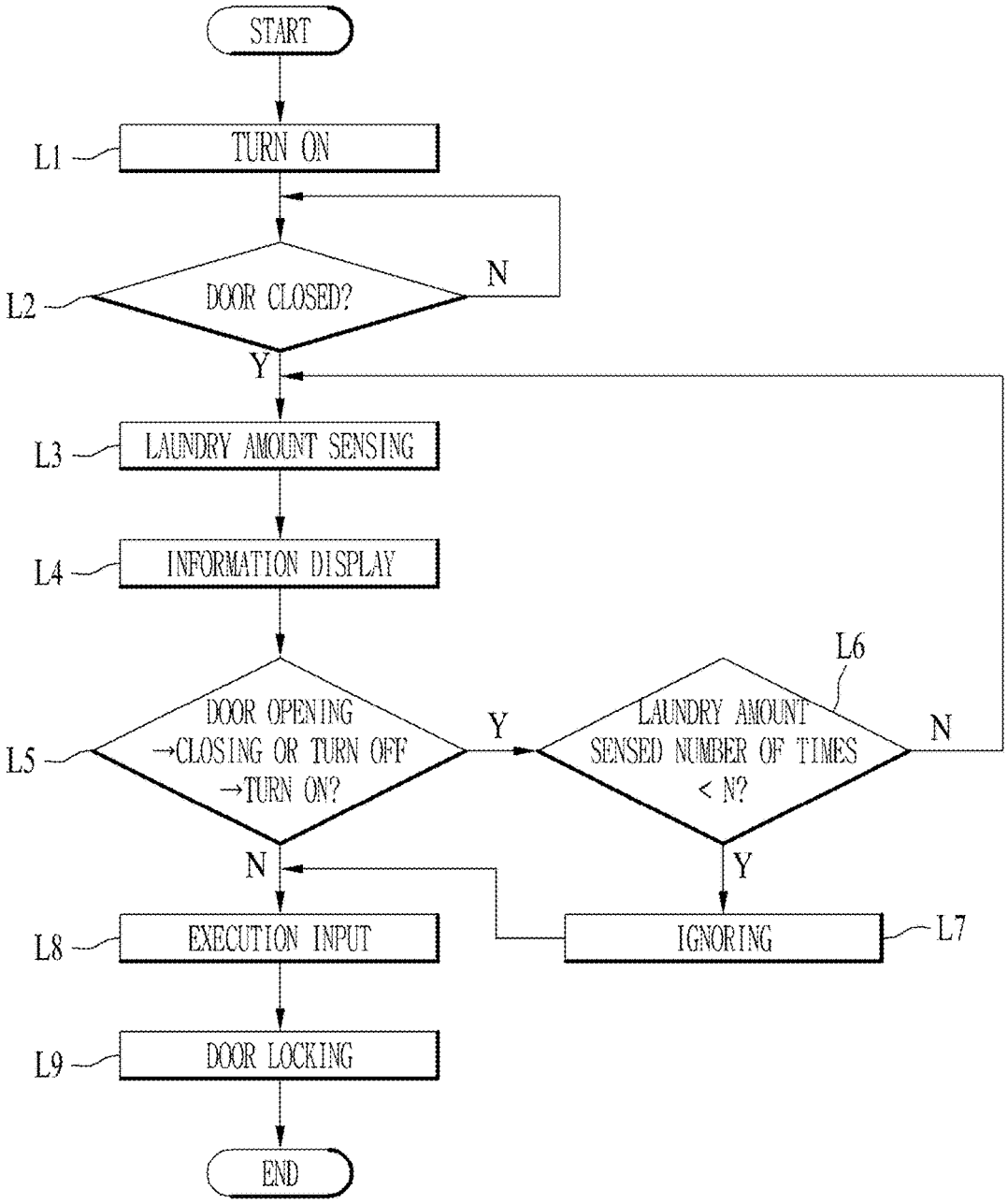
FIG. 26 shows an embodiment in which a laundry treating apparatus according to the present disclosure determines whether to additionally perform laundry amount sensing.

FIG. 26 shows an embodiment in which a laundry treating apparatus according to the present disclosure determines whether to additionally perform laundry amount sensing.

As described above, the laundry treating apparatus according to the present disclosure may perform the laundry amount sensing before pressing the execution portion P47. This is possible because the laundry treating apparatus according to the present disclosure may sense the laundry amount by rotating the drum less than once. For example, the laundry treating apparatus according to the present disclosure may sense the laundry amount within 1 second and display the information related to the laundry amount within 3 seconds.

However, the laundry treating apparatus according to the present disclosure may re-perform the laundry amount sensing whenever it senses that the door 132 opens or closes the opening 111.

This is because the opening and closing of the opening 111 by the door 132 may mean additional input of the laundry into the drum 3 or the withdrawal of the laundry inside the drum 3 via the opening 111.

In other words, because the state inside the drum 3 is likely to be varied, the laundry treating apparatus according to the present disclosure may re-sense the laundry amount every time the door 132 opens and closes the opening 111 and display the information corresponding to the sensed laundry amount on the display portion P8.

In addition, the laundry treating apparatus according to the present disclosure may re-perform the laundry amount sensing whenever the power portion P46 is re-pressed and the power is supplied to the controller P again.

When the power portion P46 is re-pressed and the power supply to the controller P is cut off, the laundry amount remembered by the controller P may be deleted. This is because there is a concern that even when the state inside the drum 3 has been changed as the door 132 opens and closes the opening 111 in the state in which the power supply to the controller P is cut off, the controller P may not recognize the change.

In other words, when the power portion P46 is pressed and the power supply to the controller P is cut off and then the power portion P46 is pressed again and the power supply to the controller P is performed again, there is a high possibility that the state inside the drum 3 has varied in the meantime. Therefore, the laundry treating apparatus according to the present disclosure may re-sense the laundry amount every time the power portion P46 is repeatedly pressed, and display the information corresponding to the sensed laundry amount on the display portion P8.

To this end, the laundry treating apparatus according to the present disclosure may allow the locker L to wait in the state of not locking the door 132 until the execution portion P47 is pressed. As a result, the door 132 may open the opening 111 when sensing the laundry amount.

In addition, when the laundry treating apparatus according to the present disclosure may control the locker L to release the locking of the door 132 when the power portion P46 is pressed and the power supply to the controller P is cut off. As a result, when the power is cut off, the door 132 may open the opening 111.

However, in the laundry treating apparatus according to the present disclosure, even when the door 132 opens or closes the opening 111 again or the power portion P46 is re-pressed and the power is supplied to the controller P again after being cut off, when the number of re-sensing the laundry amount exceeds a limit value, the amount of the laundry may not be re-sensed even when the power portion P46 is re-pressed or the door 132 opens and closes the opening 111 again.

In other words, the laundry treating apparatus according to the present disclosure may be set to block the re-sensing of the laundry amount when the number of times the laundry amount is re-sensed before the pressing of the execution portion P47 exceeds the limit value.

Performing the laundry amount sensing a number of times corresponding to the limit value means that the door 132 has re-opened and re-closed the opening 111 a limit number of times and the power portion P46 has been re-pressed a limit number of times or twice the limit number of times.

The limit value and the limit number of times may be set to a maximum number of times the user may reasonably be assumed to have added or withdrawn the laundry. For example, the limit value and the limit number of times may be set to 10 or greater.

As a result, the laundry treating apparatus according to the present disclosure may prevent performing of unnecessary laundry amount sensing because opening or closing the door 132 the limit number of times before pressing the execution portion P47 or before the door 132 locks the opening 111, or pressing the power portion P46 the limit number of times is an abnormal situation.

In other words, opening and closing the door 132 the limit number of times or pressing the power portion P46 the limit number of times may not be considered as a state in which the laundry has been additionally input into or withdrawn from the drum 3.

For example, it may be a situation in which the user, such as a child, accidentally presses the power portion P46 or repeatedly opens and closes the door 132 for fun.

In this case, by not automatically performing the laundry amount sensing, the laundry treating apparatus according to the present disclosure may save the energy and prevent the excessive load on the controller P or the drive portion 32.

Specifically, the laundry treating apparatus according to the present disclosure may perform a power input step (L1) in which the power command to supply the power to the controller P is input via the pressing of the power portion P46. Thereafter, the controller P may perform a door sensing step (L2) of sensing whether the door 132 has closed the opening 111.

When the door 132 closes the opening 111, a laundry amount sensing step (L3) of sensing the laundry amount by rotating the drum less than once may be performed.

The laundry amount sensing step (L3) is for sensing the laundry amount via the current value applied or output when the drum rotates less than once. The rotation angle of the drum may be set to be equal to or smaller than the angle at which the laundry is separated from the inner wall of the drum or the arrangement of the laundry varies.

In the laundry amount sensing step (L3), the controller P may calculate the laundry amount within 2 seconds after the drum rotates, and an information display step (L4) of displaying the information related to the sensed laundry amount on the display portion P8 may be performed within 3 seconds.

Thereafter, the controller P may perform a state sensing step (L5) of sensing whether the door 132 opens and closes the opening 111 or the power portion P46 is re-pressed before the execution portion P47 is pressed.

In the state sensing step (L5), when sensing that the door 132 reopens or recloses the opening 111 or the power portion P46 is pressed again and the power is supplied to the controller P again after being cut off, the controller P may perform a limit determining step (L6) of determining whether the number of times the laundry amount is sensed exceeds the limit value N.

When the number of times the laundry amount is sensed does not exceed the limit value N in the limit determining step (L6), the controller P may perform the laundry amount sensing step (L3) again, and perform the information display step (L4) again to correct the existing information with the information corresponding to the re-sensed laundry amount.

On the other hand, when the number of times the laundry amount is sensed exceeds the limit value N in the limit determining step (L6), an ignoring step (L7) in which the controller P no longer performs the laundry amount sensing even with the reopening and reclosing of the door and the re-pressing of the power portion.

While the ignoring step (L7) is being performed or the information display step (L4) is being performed, the execution portion P47 may be input to perform an execution input step (L8) of receiving the execution command to execute the course and the option selected via the manipulation portion P7.

When the execution input step (L8) is performed, a door locking step (L9) in which the locker L locks the door 132 to the cabinet 1 to block the opening 111 from being opened may be performed.

Figure 27:
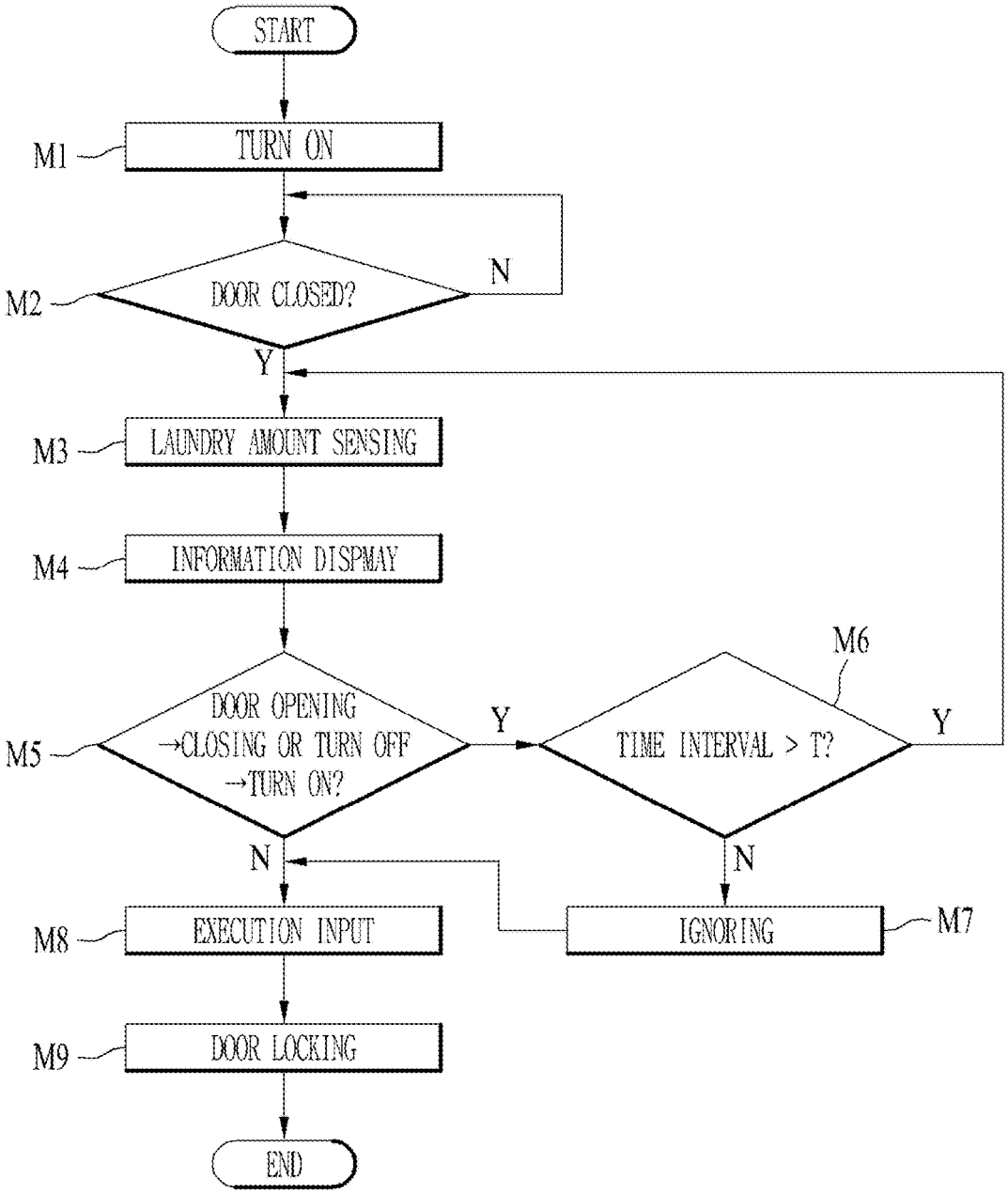
FIG. 27 shows another embodiment in which a laundry treating apparatus according to the present disclosure determines whether to additionally perform laundry amount sensing.

FIG. 27 shows another embodiment in which a laundry treating apparatus according to the present disclosure determines whether to additionally perform laundry amount sensing.

As mentioned above, the laundry treating apparatus according to the present disclosure performs the laundry amount sensing again when the door 132 reopens or recloses the cabinet 1 or the power portion P46 is re-pressed and the power is supplied to the controller P after being cut off.

However, when a time during which the door 132 is opened and closed is much smaller than a time limit T required when the laundry is put into the drum 3, the internal state of the drum 3 is unlikely to vary. In addition, when a time during which the power portion P46 is re-pressed and the power is re-supplied to the controller P is much smaller than the time limit T for the laundry to be input, there is little possibility that the internal state of the drum 3 varies.

Therefore, the laundry treating apparatus according to the present disclosure may not additionally perform the laundry amount sensing when the time during which the door 132 is re-opened and re-closed or the time during which the power portion P47 is re-pressed is smaller than the time limit T.

Accordingly, when the user accidentally opens and then quickly closes the door 132 or accidentally presses and then re-presses the power portion P47, the laundry treating apparatus according to the present disclosure may block the laundry amount sensing from being performed to block the unnecessary energy consumption.

The controller P may sense a time interval between the pressing and the re-pressing of the power portion P46, and may also sense a time interval between the opening and closing of the opening 111 by the door 132 via the sensor S or the locker L.

The time limit T may correspond to, for example, less than 1 second.

In one example, the sensor S may be formed as the hall sensor or the reed switch that may be disposed on the cabinet 1 to face the door 132 or to be adjacent to the door 132 to sense a signal such as a magnetic field generated from the door 132. An opening angle of the door 132 may also be sensed by sensing an intensity of the magnetic field.

For example, when the sensor S does not sense the magnetic field, it may be determined that the door 132 has opened the opening 111 by a spacing equal to or greater than an input spacing, which is a minimum spacing at which the laundry may be input. when the sensor S senses the magnetic field, it may be determined that the door 132 has opened the opening 111 by a spacing equal to or smaller than the input spacing.

Additionally, the sensor S may be disposed at a hinge portion that pivotably couples the door 132 to the cabinet 1 to sense the opening angle of the door 132.

As such, when the door 132 opens and closes the opening 111 by the spacing equal to or smaller than the input spacing, the laundry treating apparatus according to the present disclosure may determine that the state inside the drum 3 may not be varied and not perform the laundry amount sensing.

The input spacing may be set to smaller than 10 centimeters or the like.

Specifically, the laundry treating apparatus according to the present disclosure may perform a power input step (M1) in which the power command for supplying the power to the controller P is input via the pressing of the power portion P46. Thereafter, a door sensing step (M2) of sensing whether the door 132 has closed the opening 111 may be performed.

When the door 132 closes the opening 111, a laundry amount sensing step (M3) of sensing the laundry amount by rotating the drum less than once may be performed.

The laundry amount sensing step (M3) is for sensing the laundry amount via the current value applied or output when the drum rotates less than once. The rotation angle of the drum may be set to be equal to or smaller than the angle at which the laundry is separated from the inner wall of the drum or the arrangement of the laundry varies.

In the laundry amount sensing step (M3), the controller P may calculate the laundry amount within 2 seconds after the drum rotates, and an information display step (M4) of displaying the information related to the sensed laundry amount on the display portion P8 may be performed within 3 seconds.

Thereafter, the controller P may perform a state sensing step (M5) of sensing whether the door 132 opens and closes the opening 111 or the power portion P46 is re-pressed before the execution portion P47 is pressed.

In the state sensing step (M5), when sensing that the door 132 reopens or recloses the opening 111 or the power portion P46 is pressed again and the power is supplied to the controller P again after being cut off, the controller P may perform a limit determining step (M6) of determining whether the time during which the door 132 is re-opened and re-closed or the time during which the power portion P46 is repeatedly pressed is within the time limit.

When the time during which the door 132 is re-opened and re-closed or the time during which the power portion P46 is repeatedly pressed is equal to or greater than the time limit in the limit determining step (M6), the laundry amount sensing step (M3) may be performed again, and the information display step (M4) may be performed again to correct the existing information with the information corresponding to the re-sensed laundry amount.

On the other hand, when the time during which the door 132 is re-opened and re-closed or the time during which the power portion P46 is repeatedly pressed smaller than the time limit T in the limit determining step (M6), an ignoring step (M7) in which the controller P no longer performs the laundry amount sensing even with the re-opening and re-closing of the door and the re-pressing of the power portion may be performed.

In the limit determining step (M6), whether a degree, a spacing, or an angle to which the door 132 opens the opening 111 is smaller than the input spacing at which the input of the laundry is possible may be determined.

For example, the sensor S disposed on the cabinet 1 may identify the degree of openness of the door 132 by calculating the degree of the sense value sensed by the hall sensor or the like, or the hinge portion disposed on the door 132 may sense the opening angle.

While the ignoring step (M7) is being performed or the information display step (M4) is being performed, the execution portion P47 may be input to perform an execution input step (M8) of receiving the execution command to execute the course and the option selected via the manipulation portion P7.

When the execution input step (M8) is performed, a door locking step (M9) in which the locker L locks the door 132 to the cabinet 1 to block the opening 111 from being opened may be performed.

Figure 28:
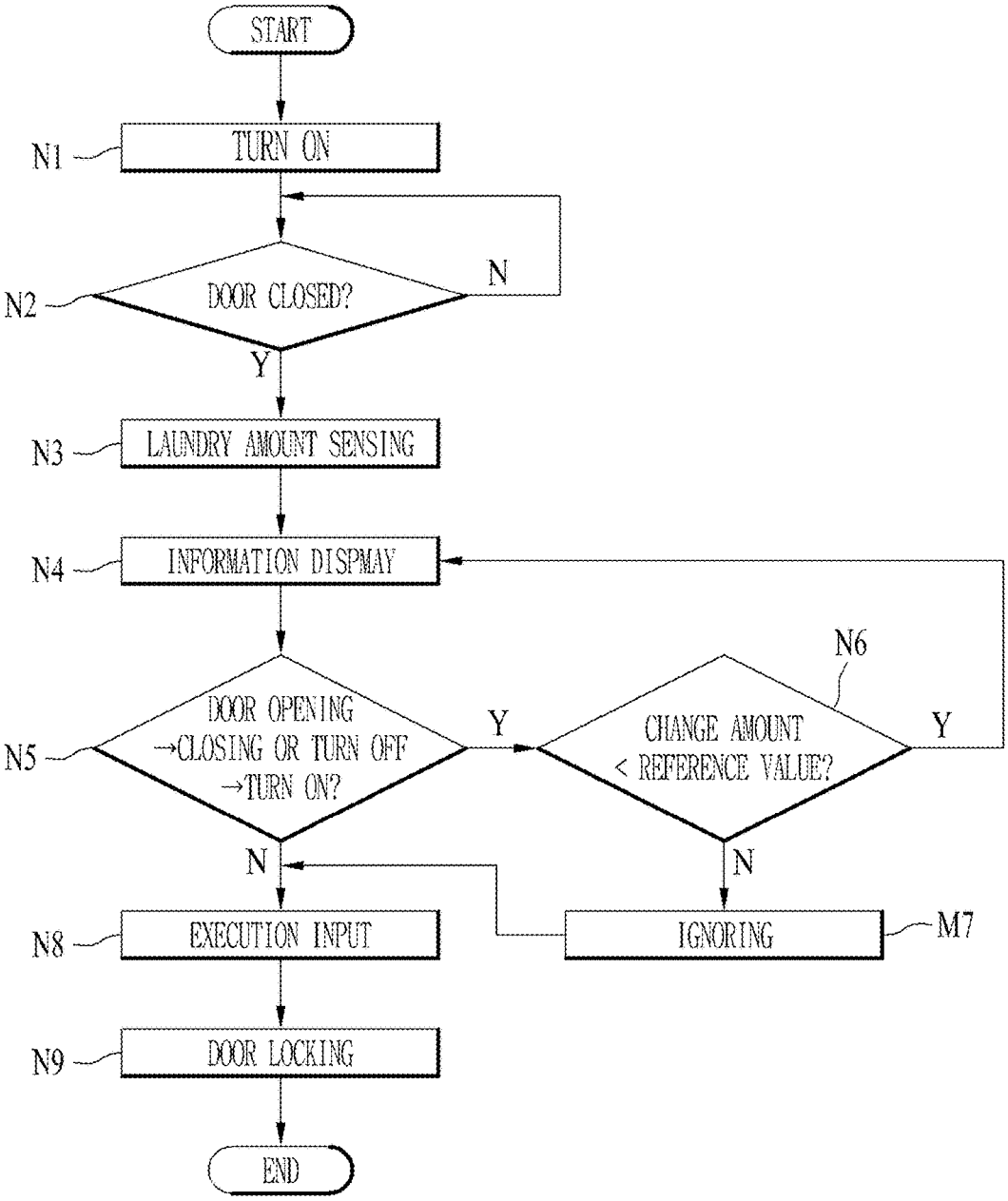
FIG. 28 shows a final embodiment in which a laundry treating apparatus according to the present disclosure determines whether to additionally perform laundry amount sensing.

FIG. 28 shows a final embodiment in which a laundry treating apparatus according to the present disclosure determines whether to additionally perform laundry amount sensing.

As described above, the laundry treating apparatus according to the present disclosure may perform the laundry amount sensing again, correct one or more of the weight, the course execution time, and the detergent amount to correspond to the re-sensed laundry amount, and display the corrected information when the door 132 is opened or closed or the power portion P46 is re-pressed.

However, the laundry treating apparatus according to the present disclosure may block the information corresponding to the laundry amount displayed on the display portion P8 from being changed when an amount of change between the re-sense laundry amount and the previously sensed laundry amount is not great.

Specifically, the laundry treating apparatus according to the present disclosure may block the information corresponding to the laundry amount displayed on the display portion P8 from being changed when a change value of the laundry amount is equal to or smaller than a comparison value.

The comparison value may be set as a threshold at which the re-sensed laundry amount changes the course execution time or the detergent amount corresponding to the previously sensed laundry amount.

For example, in the laundry treating apparatus according to the present disclosure, when the detergent amount or the execution time of the course are set to vary in 3 KG and 5 KG sections, and when the initial laundry amount value is 4.4 KG and the laundry amount sensed thereafter is 4.5 KG, because the detergent amount or the execution time does not change, the information related to the laundry amount may be blocked from being changed.

As a result, the laundry treating apparatus according to the present disclosure may block the unnecessary change to the content displayed on the display portion P8. In addition, when the re-sensed laundry amount value is different from an amount of laundry actually input or withdrawn because of a sensing error, sensing distribution, or the like in the laundry amount sensing, a situation in which incorrect information is displayed externally and distrust of the user is caused may be blocked.

The laundry treating apparatus according to the present disclosure may sense whether an amount of change obtained by comparing the re-sensed laundry amount with the laundry amount sensed immediately before is equal to or smaller than the comparison value.

In addition, the laundry treating apparatus according to the present disclosure may sense whether an amount of change obtained by comparing the re-sensed laundry amount with the initially sensed laundry amount is equal to or smaller than the comparison value.

In addition, the laundry treating apparatus according to the present disclosure may determine whether an absolute value of the re-sensed laundry amount exceeds the threshold range.

Specifically, the laundry treating apparatus according to the present disclosure may perform a power input step (N1) in which the power command for supplying the power to the controller P is input via the pressing of the power portion P46. Thereafter, a door sensing step (N2) of sensing whether the door 132 has closed the opening 111 may be performed.

When the door 132 closes the opening 111, the laundry amount sensing step (N3) of sensing the laundry amount by rotating the drum less than once may be performed.

The laundry amount sensing step (N3) is for sensing the laundry amount via the current value applied or output when the drum rotates less than once. The rotation angle of the drum may be set to be equal to or smaller than the angle at which the laundry is separated from the inner wall of the drum or the arrangement of the laundry varies.

In the laundry amount sensing step (N3), the controller P may calculate the laundry amount within 2 seconds after the drum rotates, and an information display step (N4) of displaying the information related to the sensed laundry amount on the display portion P8 may be performed within 3 seconds.

Thereafter, the controller P may perform a state sensing step (N5) of sensing whether the door 132 opens and closes the opening 111 or the power portion P46 is re-pressed before the execution portion P47 is pressed.

In the state sensing step (N5), when sensing that the door 132 reopens or recloses the opening 111 or the power portion P46 is pressed again and the power is supplied to the controller P again after being cut off, the controller P may perform a change determining step (N6) of comparing the re-sensed laundry amount with the previously or initially sensed laundry amount and sensing whether the change amount exceeds a reference value or a threshold.

The change determining step (N6) may be viewed as a step of re-performing the laundry amount sensing and comparing the re-sensed laundry amount with the previous laundry amount.

When the amount of change is equal to or greater than the threshold in the change determining step (N6), the information display step (N4) may be performed again to correct the existing information with the information corresponding to the re-sensed laundry amount.

In one example, when the change amount is equal to or smaller than the threshold in the change determining step (N6), an ignoring step (N7) in which the controller P no longer performs the laundry amount sensing even with the re-opening and re-closing of the door and the re-pressing of the power portion may be performed.

While the ignoring step (N7) is being performed or the information display step (N4) is being performed, the execution portion P47 may be pressed to perform an execution input step (N8) of receiving the execution command for executing the course and the option selected via the manipulation portion P7.

When the execution input step (N8) is performed, a door locking step (N9) in which the locker L locks the door 132 to the cabinet 1 to block the opening 111 from being opened may be performed.

In one example, in the change determining step (N6), the controller P may not determine the change amount, but may sense whether the re-sensed laundry amount exceeds or changes in a threshold section or a threshold range where the detergent amount or the execution time may be changed.

In this regard, when the re-sensed laundry amount exceeds the threshold section or is disposed in another threshold section, the information displayed in the information display step (N4) may be changed.

However, at this time, when the re-sensed laundry amount is within the threshold section, the ignoring step (N7) may be performed.

Figure 29:
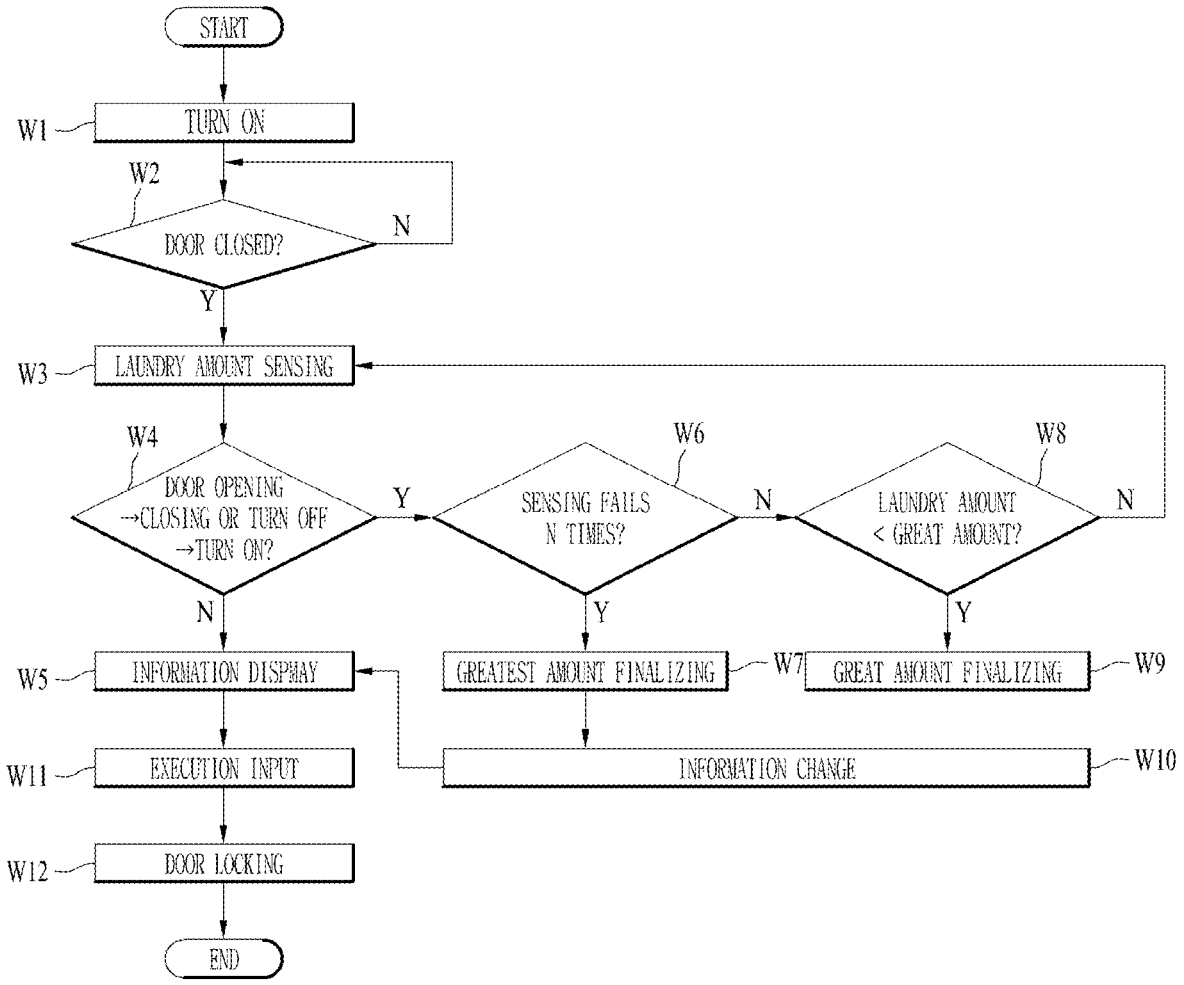
FIG. 29 shows a corresponding embodiment when a door is opened during laundry amount sensing in a laundry treating apparatus according to the present disclosure.

FIG. 29 shows an embodiment corresponding to when a door is opened when sensing a laundry amount in a laundry treating apparatus according to the present disclosure.

The laundry treating apparatus according to the present disclosure does not lock the door when performing the laundry amount sensing.

In other words, the locker L of the laundry treating apparatus according to the present disclosure may lock the door only when the laundry amount sensing is completed. In addition, the locker L of the laundry treating apparatus according to the present disclosure may lock the door only when the execution portion P47 is pressed.

As a result, the door may be opened when the laundry treating apparatus according to the present disclosure performs the laundry amount sensing.

When the door is opened during the laundry amount sensing process, the laundry amount sensing may be stopped.

Therefore, when the door is closed again, the laundry amount sensing may be performed again.

However, when there is the greatest amount of laundry, such as a blanket, accommodated inside the drum 3, the door 132 may be opened even when the drum 3 is rotated a little. Even in this case, when the laundry amount sensing is continuously attempted until the laundry amount sensing is completed, there is a high probability that the door will be opened, which may cause the washing delay or make the washing itself impossible.

Accordingly, when there is a great or greatest amount of laundry, the laundry treating apparatus according to the present disclosure may quickly finalize the laundry amount and lock the door 132 to block the door from opening.

Specifically, the laundry treating apparatus according to the present disclosure may determine whether a number of failures caused by the door opening is greater than a finalization number of times when performing the laundry amount sensing or when the laundry amount sensing fails because of the door opening.

For example, when the number of failures caused by the door opening during the laundry amount sensing is greater than the finalization number of times, the amount of the laundry may be finalized as the greatest load and the locking of the door 132 may be performed. In other words, the washing delay may be prevented by stopping the laundry amount sensing and performing the washing based on the greatest load.

The finalization number of times may be a number of fails occurred sequentially or a sum of the number of fails that occurred intermittently. For example, the finalization number of times may be set to be equal to or greater than 2.

In one example, the laundry treating apparatus according to the present disclosure may successfully sense the laundry amount at least once when performing the laundry amount sensing, and the sensed laundry amount may be the great amount. In this case, in a situation in which the door 132 is re-opened and re-closed to additionally perform the laundry amount sensing, when the laundry amount sensing fails because of the door being opened, the laundry amount may be finalized as the great amount and the locking of the door 132 may be performed.

In other words, the washing delay may be prevented by stopping the laundry amount sensing and performing the washing based on the great load.

On the other hand, in the laundry treating apparatus, when performing the laundry amount sensing, the sensed laundry amount may be a small amount. In this case, the laundry amount sensing may be performed each time the door 132 is re-opened or re-closed.

Additionally, in the situation in which the laundry amount is sensed as the small amount, when the door is reopened and reclosed and the laundry amount is additionally sensed, a case in which the laundry amount sensing fails because of the opening of the door may be seen that the user has opened the door rather than the laundry has pushed the door. Therefore, when the laundry amount is sensed as the small amount, the laundry treating apparatus according to the present disclosure may repeatedly perform the laundry amount sensing in both of a situation in which the laundry amount sensing fails and a situation in which the door is opened and closed again after completion of the laundry amount sensing.

Specifically, the laundry treating apparatus according to the present disclosure may perform a power input step (W1) in which the power command for supplying the power to the controller P is input via the pressing of the power portion P46. Thereafter, a door sensing step (W2) of sensing whether the door 132 has closed the opening 111 may be performed.

When the door 132 closes the opening 111, a laundry amount sensing step (W3) of sensing the laundry amount by rotating the drum less than once may be performed.

When the laundry amount sensing step (W3) is performed, an opening sensing step (W4) of sensing whether the door has been opened or closed again may be performed.

When the door is not further opened or closed and the laundry amount sensing is also completed in the opening sensing step (W4), an information display step (W5) of displaying the information corresponding to the sensed laundry amount on the display portion P8 may be performed.

Thereafter, alternatively, when an execution input step (W11) in which the execution portion P47 is pressed to receive the execution command of the course or the option is performed, a locking step (W12) of locking the door 132 may be performed immediately.

However, when sensing that the door is opened and closed again in the opening sensing step (W4), the laundry amount sensing may be re-performed. In this regard, when the laundry amount sensing fails because of the door opening, the laundry amount sensing may be attempted again.

Thereafter, a failure sensing step (W6) of checking whether the laundry amount sensing has failed the finalization number of times N or more may be performed. The failure sensing step (W6) may be a step of sensing whether the laundry amount sensing has failed the finalization number of times N continuously. Alternatively, it may be a step of sensing whether a sum of the failures in the laundry amount sensing has reached the finalization number of times N, even intermittently.

When the laundry amount sensing fails the finalization number of times N or more, the laundry amount sensing may be stopped and a greatest amount finalizing step (W7) of finalizing the laundry amount as the greatest amount may be performed.

On the other hand, when the failures occur the finalization number of times N or less in the failure sensing step (W6), a laundry amount checking step (W8) of checking whether the laundry amount sensed at least once is the great amount may be performed. When the laundry amount sensed at least once in the laundry amount checking step (W8) is finalized as the great amount, because there is a high probability that the laundry amount is the corresponding great amount or greater, a great amount finalizing step (W9) of finalizing the laundry amount as the great amount may be performed.

When the laundry amount has not been sensed as the great amount at least once or has only been sensed as the small amount in the laundry amount checking step (W8), the laundry amount sensing step (W3) may be repeatedly performed until the laundry amount sensing is completed.

In one example, when the greatest amount finalizing step (W7) or the great amount finalizing step (W9) is performed, an information change step (W10) of changing the finalized laundry amount to the sensed laundry amount or finalizing the finalized laundry amount may be performed. Thereafter, the information display step (W5) in which the information corresponding to the finalized laundry amount is displayed on the display portion P8 may be performed.

In this regard, a door locking step (W12) of preventing the withdrawal of the laundry by locking the door 132 may be performed in advance.

Alternatively, when the execution portion P47 is pressed and the execution input step (W11) of receiving the execution command of the course and the option is performed, the locking step (W12) of locking the door 132 may be performed immediately.

It will be apparent to those skilled in the art that various modifications and variations can be made in the present disclosure without departing from the spirit or scope of the inventions. Thus, it is intended that the present disclosure covers the modifications and variations of this disclosure provided they come within the scope of the appended claims and their equivalents.

What is claimed is:

1. A laundry treating apparatus comprising:

a cabinet that defines an opening at a front side thereof;

a door coupled to the cabinet and configured to open and close the opening;

a locker configured to lock the door to the cabinet and to unlock the door from the cabinet;

a drum disposed inside the cabinet and configured to accommodate laundry;

a motor connected to the drum to rotate the drum;

a display portion disposed on the cabinet to display information; and a power portion disposed on the cabinet to receive a command to supply power, wherein the motor is configured to rotate the drum while the door is unlocked, wherein the display portion is configured to display weight information of the laundry after the drum starts rotating, and wherein the display portion is configured to display reference information based on a rotation of the drum not being controlled while the door is unlocked.

2. The laundry treating apparatus of claim 1, wherein the reference information is predetermined regardless of a weight of the laundry in the drum.

3. The laundry treating apparatus of claim 1, wherein in a state in which the door is unlocked and the rotation of the drum is not controlled, the motor is configured to attempt to rotate the drum for a reference time while the door is unlocked.

4. The laundry treating apparatus of claim 3, wherein the motor is configured to stop rotation of the drum for a specific time, based on that the rotation of the drum is out of control even if the rotation of the drum is attempted during the reference time.

5. The laundry treating apparatus of claim 4, wherein the motor is configured to attempt to rotate the drum again after the specific time.

6. The laundry treating apparatus of claim 5, wherein the display portion is configured to change the reference information into a weight information of the laundry based on that (i) the motor rotates the drum during the reference time or (ii) after the specific time after the reference information is displayed thereon.

7. The laundry treating apparatus of claim 5, wherein the display portion is configured to display error information including a state in which rotation of the drum is impossible, in a case in which the door is unlocked and the rotation of the drum is out of control even after the specific time.

8. The laundry treating apparatus of claim 5, further comprising an execution portion disposed on the cabinet and configured to receive an execution command for executing a course, wherein the locker is configured to lock the door based on that the executing portion is input.

9. The laundry treating apparatus of claim 8, further comprising:

a tub accommodated in the cabinet and configured to store water, the tub accommodating the drum; and a water supply valve coupled to the cabinet and connected to an external water supply source, wherein the water supply valve is configured to be opened during the reference time or a preset rest time after the reference information is displayed on the display portion.

10. The laundry treating apparatus of claim 9, wherein the water supply valve is configured to be closed based on that the rotation of the drum is out of controlled even after the specific time.

11. The laundry treating apparatus of claim 1, further comprising:

a tub accommodated in the cabinet and configured to store water, the tub accommodating the drum; and a water supply valve coupled to the cabinet and connected to an external water supply source, wherein the water supply valve is configured to be closed until the drum begins to rotate while the reference information is displayed on the display portion.

12. The laundry treating apparatus of claim 5, wherein the motor is configured to rotate the drum less than one revolution after the specific time, wherein the display portion is configured to change tentative weight information to the weight information of the laundry after the drum begins to rotate less than one revolution.

13. The laundry treating apparatus of claim 1, further comprising a selection portion disposed on the cabinet and configured to receive a selection command for selecting or changing a course, wherein the weight information includes an execution time of the course based on a weight of the laundry, wherein the display portion is configured to display a reference execution time of the course, and wherein the execution time on the display portion is fixed, even if the course selected by the display portion is changed even if the course changes by the selection portion.

14. The laundry treating apparatus of claim 1, wherein the motor is configured to rotate the drum less than one rotation while the door is unlocked based on the power portion being input, and wherein the display portion is configured to display weight information of the laundry after the drum begins to rotate less than one revolution.

15. The laundry treating apparatus of claim 1, wherein the reference information comprises prior weight information of laundry that is treated in a previously performed course.

16. The laundry treating apparatus of claim 1, further comprising a control panel comprises a plurality of buttons, wherein at least one of the plurality of buttons is corresponding to the power portion.

17. The laundry treating apparatus of claim 16, wherein at least one of the plurality of buttons is configured to corresponding to an execution portion.

18. The laundry treating apparatus of claim 16, wherein the control panel comprises a rotary knob configured to receive a selection command for selecting a course among a plurality of courses to treat the laundry.

19. A method for controlling a laundry treating apparatus, the laundry treating apparatus including a cabinet that defines an opening at a front side thereof, a door coupled to the cabinet and configured to open and close the opening, a locker configured to lock the door to the cabinet and to unlock the door from the cabinet, a drum disposed inside the cabinet and configured to accommodate laundry, a motor connected to the drum to rotate the drum, a display configured to display information, and a controller, the method comprising:

receiving a power command for supplying power to the controller;

controlling the motor to rotate the drum while the door is unlocked;

controlling the display to output weight information of the laundry that is obtained by rotating the drum while the door is unlocked; and based on failing to obtain the weight information by rotating the drum while the door is unlocked, controlling the display to output reference information.

20. The method of claim 19, wherein the reference information is predetermined regardless of a weight of the laundry in the drum.

* * * * *